US009916757B2

(12) United States Patent
Ippolito et al.

(10) Patent No.: US 9,916,757 B2
(45) Date of Patent: Mar. 13, 2018

(54) SMART LOOP TREADLE HAVING BOTH AN EDDY CURRENT SENSOR AND A FERROMAGNETIC SENSOR

(71) Applicants: William Ippolito, Hagerstown, MD (US); Balaji Gurusala Sreeramulu, Germantown, MD (US)

(72) Inventors: William Ippolito, Hagerstown, MD (US); Balaji Gurusala Sreeramulu, Germantown, MD (US)

( * ) Notice: Subject to any disclaimer, the term of this patent is extended or adjusted under 35 U.S.C. 154(b) by 0 days.

(21) Appl. No.: 15/183,054

(22) Filed: Jun. 15, 2016

(65) Prior Publication Data

US 2017/0358205 A1 Dec. 14, 2017

Related U.S. Application Data

(60) Provisional application No. 62/347,795, filed on Jun. 9, 2016.

(51) Int. Cl.
*G08B 21/00* (2006.01)
*G08G 1/042* (2006.01)

(52) U.S. Cl.
CPC ..... *G08G 1/042* (2013.01); *G06Q 2240/00* (2013.01)

(58) Field of Classification Search
CPC ..... G08G 1/042; G08G 1/052; G08G 1/056
USPC ..... 340/933, 935, 936, 941
See application file for complete search history.

(56) References Cited

U.S. PATENT DOCUMENTS

2008/0143555 A1* 6/2008 Allen ..... G08G 1/01 340/933
2009/0174576 A1* 7/2009 Allen ..... G07B 15/063 340/941

* cited by examiner

*Primary Examiner* — Jeffery Hofsass
(74) *Attorney, Agent, or Firm* — Merek, Blackmon & Voorhees, LLC

(57) ABSTRACT

Lanes sensors are used to count the number of wheel assemblies on vehicles passing over roadway sensors. Lane sensors can also be used to classify vehicles at single and multiple lane sites for tolling and/or traffic planning. For counting vehicles, the Smart Loop Treadle of the present invention is designed for both tire and wheel assembly detection using inductive loop sensors for toll roads in single (Conventional) lane applications. The sensors detect the tire assemblies of both vehicles and vehicle trailers being towed to provide the sum of axle assemblies. For vehicle characterization, the sensor arrangement can have a combination of unique sensors that include tire/wheel detection sensors and vehicle lane position sensors. The characteristics of the vehicle, travel direction, speed, in lane position of the vehicle can be detected using combination of these sensors.

17 Claims, 39 Drawing Sheets

Total Dimension: 16" L X 9' 10" W

A: Represents Segments 22"W X 16" L

B: Represents Segments 15"W X 15" L

Overall Dimension: 9 feet Wide X 16" Long

A: Represents 22"Wide X 16"Long Segments

B: Represents 15"Wide X 16" Long Segments

Total Dimension: 11'-1" W X 16" L

A: Represents 22" X 16" Segments

B: Represents 15" X 16" Segments

SMART LOOP TREADLE HAVING BOTH AN EDDY CURRENT SENSOR AND A FERROMAGNETIC SENSOR

CROSS REFERENCE TO RELATED APPLICATIONS

This application claims the benefit of U.S. Provisional Application 62/347,795, filed Jun. 9, 2016, entitled SMART LOOP TREADLE, which is incorporated herein by reference.

BACKGROUND OF INVENTION

Field of Invention

Transportation Planning and Toll Agencies monitor and count the volume and types of vehicles in the roadway. They require information to be collected and used for roadway design and toll road revenue assessment.

The use of various detection sensors is frequently combined into an apparatus to profile or identify a detected vehicle and match it with a vehicle classification scheme in example the FHWA classification schema for traffic monitoring.

The prior art includes vehicle classification systems for detecting vehicles using various types of detection including road tubes, piezo sensors, tape switches, fiber optic sensors, Radar, video, audio, LASARS, and inductive loop sensors. These different technologies provide detection from above and below the roadway. These sensor technologies all have various levels of accuracy and durability. FIG. 5 illustrates prior art of various combinations of Wheel Sensors and Loops used for vehicle classification. Prior art includes using two inductive loops in a travel lane to measure vehicle speed and length for "Speed Monitoring" programs. Prior art includes placing one or two wheel sensors between the two loops to provide vehicle classification (500) and placing two sensors adjacent to the leading and trailing edge of an inductive loop (501) in a travel lane and placing a inductive loop followed by two wheel sensors (502) for vehicle classification.

The traffic monitoring program and toll industry count the axles on vehicles using various types of wheel sensors and treadle assemblies. Prior art in tolling frequently use a combination of a booth loop or payment loop located at the toll collection booth window and a treadle in the roadway that counted the number of axles present on each vehicle after the payment was made by the vehicle operator. This prior art is illustrated in FIG. 5A showing the Treadle in the center of the booth/payment loop (510) and the booth/payment loop is followed by the treadle (511). The advantage of using the inductive loop sensor is the reliability and durability of the sensor. When installed correctly the sensor will last and function as long as the integrity of the road surface is stable.

The present invention, namely, the "Smart Loop Treadle" uses a combination of sensors of the Eddy Current effect type and the Ferromagnetic effect type of tire assembly sensors and the lane Position sensor to define the attributes of a motor vehicle traveling over the sensors.

Background of Invention and Related Art

There are Eddy Current sensor designed to detect wheel assemblies on vehicles that have non-steel belted reinforced tires described in this patent and are unique by providing signatures that include a distinction between the wheel assemblies and the vehicle chassis. There are Ferromagnetic sensor designs to detect steel belted reinforced tires on vehicles described in prior art, which and in this patent contain two new sensor designs that use the ferromagnetic effect to detect steel belted reinforced tires and identify dual tires present on vehicles. This patent describes a unique Lane Position sensor for detecting a vehicle's position in the travel lane that has applications in open road tolling and all electronic tolling. There is a description of a new Smart Loop treadle that contains at least one sensor for non-steel belted tire detection and one sensor for steel belted tire detection. The preferred embodiment contains two of each type for tolling applications where conventional toll booths are present. This provides the vehicle direction of travel and redundancy for wheel detection. The smart loop treadle can identify the presence of dual tires on a vehicle. This design is unique since it detects both steel belted reinforced tires and wheel assemblies without steel belted tires using loop circuits exclusively.

This invention also includes a Lane Position Sensor that identifies the vehicle's position in the travel lane by determining when the vehicle is traveling on the left side of the lane, in the center of the lane, or on the right side of the lane and also supports detection of motorcycles and/or wide or oversized vehicles. The sensor aids in associating the passing vehicle with the Radio Frequency Identification (RFID) and vehicle image in electronic tolling.

The combination of Eddy Current sensor, Ferromagnetic sensor, and the Lane Position sensor described in this patent provides vehicle classification in toll and planning applications.

The invention device is also comprised of a data processing controller, traffic loop amplifier, and at least one tire sensor. The invention's use of Tire Assembly Sensors for detecting vehicle wheel assembly characteristics can be used in combination with presence sensors using flux fields providing a combination of sensor inputs processed by the device controller to identify vehicle attributes. The captured vehicle tire characteristics are used to identify the number of wheeled axle assemblies that are present on a vehicle that can be applied to the vehicle classification or vehicle type.

Each wheel assembly sensor has multiple flux fields that can be used alone or in combination with other Tire Assembly sensors and presence sensors to identify various attributes of vehicles as they pass over a sensor and/or combination of sensors.

The Smart Loop Treadle design is for conventional single toll lanes and includes a multi-circuit wheel assembly device to detect tire assemblies and vehicle direction. The Smart Loop Treadle device contains multiple loop circuits to provide the vehicle direction and presence sensors to identify various attributes of vehicles as they pass over a combination of wheel assembly loop sensors. This Smart Loop Treadle can be used as a replacement for the axle counting treadles commonly used in conventional lanes.

The device can be used with multiple sensors to measure vehicle speed, length and the characteristics of wheel axle assemblies present on vehicles for traffic monitoring and tolling applications. The device can be used for monitoring single lane or multiple lanes of a roadway for planning or all electronic tolling/open road tolling. The multi-lane system includes a lane position sensor for detecting the vehicle's position in the lane and vehicle characteristics.

The frequency signal changes vary between different vehicle types (cars, trucks) and produce an increase or decrease in the sensor output frequencies when they pass over the sensor. Prior art publication No. FHWA-IP-90-002 "Traffic Detector Handbook", page 49 and 50, FIG. 48 illustrate "Typical Vehicle Signatures" from the different types of vehicle chassis can be used to identify various vehicle classes (i.e. Bus, Car, Truck, and Van). These vehicle signatures occur from the Eddy Current effect that lowers the loop circuit frequency as the vehicles pass over an inductive loop. The different frequency values are generated by vehicles having different chassis attributes and applied to the vehicle signature to discriminate between the various vehicle chassis types or class of vehicles. These signatures do not identify the number of wheel assemblies or the number of axles present on a vehicle as provided by the Eddy current sensor discussed in this patent. In example the prior art would not distinguish if the trucks and buses had two or three axles whereas the Eddy current sensor discussed in this patent does detect the number of wheeled axles present on a vehicle.

Prior art publication No. FHWA-IP-90-002 "Traffic Detector Handbook", page 9 addresses the increase in the loop inductance by the presence of ferrous materials as a "Ferromagnetic effect". The digital loop amplifiers produce an oscillating frequency that can increase from the ferromagnetic effect when ferrous materials on the vehicle pass over the sensors. A variety of patterns are produced that include frequency increases in the loop circuit from the Ferromagnetic effect that are caused from the different ferrous parts of the vehicle passing over the inductive loop sensors.

This invention uses unique tire assembly sensors that optimize the ferromagnetic effect using the traffic loop detector. The controller processes the signals from the traffic loop detector to determine the vehicle's tire characteristics. The present invention tire assembly sensor produces an output signal that can be used to distinguish between single tire assemblies and multiple (Dual) tire assemblies.

The ferromagnetic sensor 3-6-6-3 described in this patent is not shaped in a serpentine manner on a plan as in the Allen patent. The 3-6-6-3 is shaped by using an alternating winding pattern of clockwise, counterclockwise, and clockwise on a plan to form three rectangular loop circuits connected in series Aturn is single complete winding of wire around a rectangle. The number of turns in each rectangular loop circuit can be increased or decreased on an individual basis. The Allen patent uses an equal number of turnings in a serpentine manner. The sensor designation of 3-6-6-3 represents the number of wire turnings contained in each flux threshold or side of the rectangle that is perpendicular to the direction of travel. This designation represents 3 turns and 6 turns and 6 turns and 3 turns (See for example, FIG. 3A-310) that are perpendicular to the direction of travel. Using the same method to describe the Allen patent would result in a 2-2-2-2-2-2-2-2-2-2 (FIG. 9 section A-A).

Each rectangular loop circuit is wide enough (measured perpendicular to the travel direction) to provide detection of both wheel paths in the travel lane and is four (4) inches in length (measured parallel to the travel direction) and the sum of the length of three rectangular loop circuits has a nominal length that is at least 12 inches and the overall length can be increased up to 40 inches by the addition of rectangular circuits. The nominal lengths of the rectangular loops circuits are preferably always equal to 4 inches and do not change in length as in the Allen patent. The number of rectangular circuits can be increased from 3 to 10 by continuing the alternating pattern of clockwise to counterclockwise windings as additional rectangular circuits are added while maintaining the same length of 4 inches unlike the Allen patent that uses different lengths of polygons to exhibit a gradient characteristic.

The ferromagnetic sensor 2-4-4-4-4-4-4-4-4-4-2 can contain up to ten (10) rectangular loop circuits in a series having a nominal length of 40 inches and is not limited to eight 8 contiguous polygons as in the Allen patent.

The use of the ferromagnetic loop sensors has been used to detect tire assemblies reliably. The present invention ferromagnetic sensor 3-6-6-3 has the ability to detect and discriminate between a pickup truck with single tire assembly on the rear axle and a rear axle with dual tire assemblies ("dualies") on the rear axle. This ability to make this distinction and detect dual wheel assemblies present has applications for tolling to assess a higher rate for commercial vehicles or vehicles designed to haul more weight.

The Ferromagnetic sensor 2-4-4-2 can have the number of windings increased to make a 3-6-6-3 or 4-8-8-4 one complete revolution around a rectangle with the loop wire is known as a "turn". The number of turns for each rectangle can be increased on an individual basis to change the inductance of the sensor. These numbers represent the number of turns present in the sides of the rectangular circuit that are perpendicular to the direction of travel and still have the same footprint. In example the 2-4-4-2 has two turns and four turns and four turns and two turns. The 4-8-8-4 has four turns and eight turns and eight turns and four turns. This design flexibility has two advantages when compared to previous designs found in the Lees and Allen patents. First, by increasing the number of turnings in the sensor, this increases the inductance and the sensor response. The additional turns improve the inductance of the sensors and prevent a loss of sensitivity that can occur when the distance from the sensor in the roadway to the loop detector termination is longer than 300 feet.

The second advantage is that the design addresses the very common problem with the Lees and Allen designs, namely, that of frequency noise on the axle sensors from other sensors in adjacent lanes. The present design can use Ferromagnetic sensors that have a different number of windings and be installed in the alternating pattern in multilane installations. For example, the Ferromagnetic sensor 2-3-3-2 has an average frequency of 48 KHz and an inductance of 90 micro-Henry. The Ferromagnetic sensor 3-6-6-3 has an average frequency of 34 KHz and an inductance of 180 micro-Henry. This provides a significant separation in Frequency and eliminates frequency noise from sensors in adjacent lanes.

In the prior art sensors, this frequency noise interferes with the proper detection of small wheel assemblies found on small cars and small trailers that have steel belted reinforced tires. The common source of the noise is from the sensors in the adjacent lane(s). In multi-lane applications, noise on the Ferromagnetic loops is commonly referred to as crosstalk. The noise can cause false detections or reduce the sensitivity of the wheel sensor. When the installation is in concrete, the presence of iron reinforcing bars in concrete can propagate the loop frequency noise from adjacent lanes. For example, Toll plazas with lane dividing islands for toll booths typically have a lot of rebar present between the lanes. This propagation can cause cross talk between the adjacent lanes. In open road tolling application that has reinforced concrete pavement, cross talk can also occur. The root of the problem is that the operating frequency of the loops in the adjacent lanes are operating in frequencies that are very close. In prior art systems, the loop detectors are typically adjusted to different frequencies to increase the difference in frequency by adjustments of loop detector that utilizes changing capacitors in the loop circuit to change the frequency of the circuit. This change in frequency is often unsuccessful and intermittent frequency noise can still occur when the loop circuit frequencies drift or change during detection. The flexibility of the present design allows for the use of additional wire turnings to change the inductance and frequency of the circuit. This increases the inductance of the sensor and provides greater frequency changes to reduce the probability of crosstalk.

U.S. Pat. No. 5,614,894 (Mar. 25, 1997) to Stanczyk shows one prior art system. FIG. 6 of this application illustrates a loop design of Stanczyk having a single rectangular loop in at least one or both wheel paths of a roadway in the direction of travel (600). The preferred widths (601) are from 1.5 meters (4.92 ft.) to 2.0 meters (6.56 ft.) with winding from 1 to 10 turnings (602). This prior art sensor detects the presence of the vehicle chassis and vehicle wheels when they travel over a rectangular loop having one rectangular winding that is less than the diameter of the wheels to be identified. The preferred size in the direction (603) of travel is from 0.15 to 0.30 meters (5.90 inches to 11.81 inches). The Stanczk invention divulges using an electromagnetic detector that measures the increase and decrease in voltages (from 200 to 800 millivolts) from the detector signal. The patent divulges that voltage decreases are from rotating vehicle wheel assemblies and voltage increases from the vehicle chassis moving over the sensor. The plots illustrated in the Stanczyk patent showed that the signatures contain both increases and decreases in voltage. The positive voltage reading is from the chassis. The negative voltage is from the wheels of the vehicle. When the Stanczyk loop sensor is increased in width, the voltage increase from the chassis dominates the signature and not the decrease in voltage from the wheel assemblies.

This prior art (Stanczyk) design limits the signature length having only two flux thresholds FIG. 6, (603) or fields one on each side of the rectangular winding. The sensor design is required to being smaller than the diameter of the wheel. The patent divulges the sensor produces a signature containing both a voltage increase from the chassis and voltage drop from wheels when the vehicle passes over the sensor.

The patent divulges that the design produces a very limited signature sample size because the sensor length must be less in size than the diameter of the wheel. When the vehicle's travel speed increases the signature length is further reduced in length and the wheel detection sample is diminished.

The preferred widths of the Stanczyk design (601) are from 1.5 meters (4.92 ft.) to 2.0 meters (6.56 ft.) with winding (602) from 1 to 10 turnings. The preferred size in the direction (603) of travel is from 0.15 to 0.30 meters (5.90 inches to 11.81 inches). In contrast, the present invention sensors can be wider than the diameter of the tire assembly being detected which was a limitation of the Stanczyk design.

Also, the present invention uses a digital signature that is based on frequency changes and not voltage changes. The Stanczyk design produces both voltage increases and decreases in the signature.

In contrast, the present invention has two types of sensors, namely, one sensor type to optimize the Eddy currents effect from wheel assemblies and one sensor type to optimize the Ferromagnetic effect from steel belted tires. The Eddy current sensors are designed to optimize the Eddy current effect from the wheel assemblies and not the vehicle chassis that cause a decrease in frequency of the loop sensor when the vehicle wheel assemblies having non-steel belted tires pass over the sensor. The present invention also has the Ferromagnetic type sensor to optimize the Ferromagnetic effect from steel belted reinforced tires that cause an increase in the loop frequency. The Ferromagnetic type sensor is optimized to have the frequency increase when vehicles having steel belted tires pass over the sensor minimizing the Eddy current effect that decreases the frequency. The present invention Ferromagnetic type sensor, in contrast to the Stanczyk system, contains a series of three or more rectangular sensors connected in series to provide more flux thresholds and a longer signal input when vehicles traveling at high speeds pass over the sensor. The Ferromagnetic sensor described in this invention can have a greater length than the wheel diameter.

The Eddy current effect sensor in contrast to the Stanczyk sensor can be longer than the wheel diameter. The longer length of the Eddy current sensor improves the amount of processed information about the tire assembly. In contrast, to the Stanczyk sensor the Ferromagnetic type sensor have multiple rectangular loops in a series that exceed the diameter of the wheel assemblies being identified and provide longer wheel assembly signatures samples as the wheeled vehicle pass over the sensor. The higher speed that the vehicle is traveling over the sensor, the shorter the sampling time and the signature length is shortened. The increase in sensor length improves the sample size at high speeds and is not adversely affected by the eddy currents from the chassis.

U.S. Pat. No. 6,483,443 B1 to Lees (Nov. 19, 2002) shows another prior art system. The prior art loop sensing apparatus shown in Lees detects the presence of the vehicles wheels when they travel along the lane. FIG. 7 illustrates the sensor design divulged in the Lees patent. The vehicle's direction of travel is indicated in detail 700. The sensing apparatus consists of two loop circuits in each wheel path (701). Each sensing apparatus has two loop circuits a larger outer quadrupole loop (702) and smaller inner quadrupole loop (703) located inside the larger quadrupole loop and used to provide detection for one-wheel path (701). The different sized quadrupole loops both have a central axis having three flux thresholds (704) and provide separate detection as a vehicle travels over the two loop circuits (702 and 703). The preferred design has two loop circuits in each wheel path (705) and a total of four loop circuits per lane of travel. The quadrupole loop has a figure eight winding (706) with a central axis (707) and is bilaterally symmetric.

The present invention includes two sensors types. The first Eddy Current type is designed to detect non-steel belted tires and are optimized to detect these non-steel belted tires. The Lees patent contains loops that are optimized to respond to the ferromagnetic effect and not the Eddy current effect. The present invention has a second design type of sensor that optimizes the ferromagnetic effect to detect steel belted tire assemblies. This ferromagnetic sensor (FIG. 3A), the Ferromagnetic sensor 3-6-6-3, and FIG. 3J, the Ferromagnetic sensor 2-3-2-3-2, incorporates multiple flux thresholds that are illustrated in FIG. 3A, (311) having four flux thresholds. FIG. 3J shows four rectangular loops having five flux thresholds (401) connected in a series on a single circuit to optimize the ferromagnetic effect from ferrous tire assemblies. The windings are not in a figure eight like the quadrupole design as described in the Lees patent. The present invention by contrast has multiple rectangular loops connected in series that can be increased in number and length to provide longer sample signatures and not wound in a figure eight quadrupole. The present invention sensor width can vary from 8 ft. to 16 ft. wide in contrast to the Lees sensor width of only 2 meters (6.56 feet). The present invention single ferromagnetic sensors are designed to capture two wheel paths from each vehicle. The length of the sensor is measured in parallel with the direction of traffic over the sensor.

The bicycle loop prior art publication No. FHWA-IP-90-002 "Traffic Detector Handbook", page 93, FIG. 94 is illustrated in FIG. 8 and used for stop bar detection in a bicycle lane. The loop layout illustrates a serpentine loop winding of polygons. Each polygon is 18 inches wide by 54 inches long (800) having 4 turns. FIG. 8 illustrates the serpentine windings detail 801 of the bicycle loop. The prior art was designed and used to detect the presence of bicycles at an intersection using a loop amplifier with a contact closure and not as a signature analysis sensor. The bicycles would travel over the sensor (802) or stop at an intersection and be detected by the loop detector. Also, the length of this previous design does not support detection of individual axles (800) when detecting vehicles or multiple axles on trailers being towed by vehicles. The geometry of the rectangular turnings (803) produced a flux field. The presence of a bicycle in the field produces a change in frequency. The bicycle presence is detected by a loop detector. The bicycle loop width (804) was designed to provide complete detection coverage of the bicycle lane. The present invention is designed to optimize the Eddy Current effect from the tire assemblies of motorcycles, cars, trailers being towed and trucks passing over the sensor. The width of the sensor in the present invention is adapted to provide complete lane coverage FIG. 2 (203). The length of the sensor in the present invention can vary from 12 inches long to 36 inches long. See FIG. 2 (204). The present invention has incorporated a shorter length of the sensor to optimized the Eddy Current effects from the wheel assemblies and minimize the Eddy currents from the vehicle chassis as vehicles pass over the sensor.

The Allen patent discloses Prior art U.S. Pat. No. 7,015,827 B2 (Mar. 21, 2006)

Prior Art FIG. 9 illustrates the design divulged in the patent (900). A Ferromagnetic loop design FIG. 9 consists of multiple polygons (901) in which the windings are wrapped in a serpentine manner (902). The sensor contains polygons that are not uniform and contains two different sizes, namely, larger polygons (903) and smaller polygons (904). The patent does divulge that the width of the polygons can also be uniform and perpendicular to the direction of travel. The two different lengths of polygons occur in the axis parallel to the direction of travel (905).

The present invention tire sensor (Ferromagnetic type) sensor incorporates multiple flux thresholds of rectangular loops connected in a series. The Ferromagnetic 2-4-4-2 in FIG. 3 (304) and Ferromagnetic 3-6-6-3 windings FIG. 3A (310) of the rectangular loops are in the series wound in alternating directions from clockwise to counter clockwise and this is constant for all the rectangles and in contrast is not wound in a serpentine manner.

The present invention sensor is designed to be extended into a series-connected arrangement of multiple uniform rectangular loops all, preferably having the same length as shown in example FIG. 3A (311) of the 3-6-6-3 windings. This present invention of a ferromagnetic sensor does not have a serpentine winding (313).

A second present invention design for the Ferromagnetic type sensor design (3-2-3-2-3) FIG. 3J (400) has a unique winding and is not a serpentine winding as described in the Allen patent. This loop has five flux thresholds (401). The sequence is based on the direction of travel that is perpendicular to the flux thresholds of the sensor and the number of wire turnings for each threshold is listed from the leading edge to the trailing edge is 2 turns, 3 Turns, 2 Turns, 3 turns, 2 turns (400) and these turnings are not equal like the windings divulged in the Allen patent.

The prior art publication No. FHWA-IP-90-002 "Traffic Detector Handbook", page 61, FIG. 59 illustrate of Directional detection using two rectangular loops using two detection channels one for each circuit and using directional logic. FIG. 10 illustrates the two loops overlapping by 6 inches. The sequence of the loop activation is used determine direction. This publication also divulges "Counts by Loop Detectors" illustrating in two travel lanes the placement of three loops on page 60 (FIG. 58), one loop in the center of each lane and one loop centered between the two lanes. This loop configuration is used to count vehicles when lane discipline is not good.

A third present invention Lane Position sensor design consists of two loop circuits that overlap and can determine the vehicle path of travel in the lane. FIG. 4 illustrates the Lane Position sensor. The present invention has two rectangular loops (431) and (432) that are configured in a single lane of travel. This configuration provides sensor detection to determine the position of the vehicle in the lane if a vehicle is in the left side of the lane, center of the lane, or right side of the lane. This sensor can be used in open road tolling and planning applications. The additional information can be used to associate a vehicle lane position with the electronic toll tag reading, vehicle photo, or lane straddle. This loop configuration is also beneficial for counting motorcycles, since they usually travel in the left or right wheel path of the roadway and not the center of the lane. The combinations of the two loops can also detect wide vehicles traveling in a single lane. The two loops in the circuit can also be installed in an offset to detect the vehicle's lane position and direction for reversing direction lanes.

SUMMARY OF INVENTION

The present invention has applications for vehicle tolling and traffic monitoring. The sensors in this patent detect wheel and tire assemblies when vehicles pass over the sensors. The invention also provides the detection of the position of the vehicle whether it is in the right side, center, or left side of the travel lane.

The present invention includes an Eddy current sensor that detects non-steel belted wheel assemblies and can detect wheel assemblies with steel belted reinforced tires. Two Ferromagnetic sensor designs that detect steel belted tires and discriminated between single tire assemblies and dual tire assemblies. A lane position sensor is described that can detect the travel position of the vehicle in the lane.

The preferred embodiment for wheel and tire detection includes at least one Eddy current sensor and one Ferromagnetic sensor together. The two different types of sensors (Eddy Current and Ferromagnetic) are placed together in the same lane of travel and provide the number of axles or wheels present on a vehicle. The combination of both types of sensors provides detection of the non-steel belted wheel assemblies and of the steel belted tires. The smart loop treadle can provide a single threshold or assembled as a double threshold smart loop treadle as illustrated in FIG. 1. FIG. 1 illustrates the Eddy current sensor (101) and the Ferromagnetic sensor (102) combined form a smart loop treadle assemble (100). The double threshold smart loop treadle contains two smart loop treadles (100) installed adjacent to one another. The double threshold treadle contains two pairs of the combination Eddy current sensor and Ferromagnetic sensor. The Eddy current sensor (101) is installed below the Ferromagnetic sensor (102) as a pair. The double threshold smart loop treadle provides the direction of vehicle travel and can be used detect if a vehicle reverses its direction. This is important when used in a conventional toll lane application. This design also provides for a redundant detection of the wheel assemblies. The single threshold smart loop treadle (100) contains a single pair of sensor one Eddy current sensor (101) and one Ferromagnetic sensor (102).

The system components for a conventional toll lane application are illustrated in FIG. 1A. These system components include a double threshold Smart Loop Treadle (118) having two Eddy current sensors (110) and two Ferromagnetic sensors (111). A traffic loop amplifier (114) provides the input frequency to the sensors and the output frequency to the controller (115). The controller processes the inputs from the sensors, stores the information and distributes the information about the vehicles passing over the sensor regarding the vehicle direction of travel, number of wheel assemblies, and presents of dual tires.

The system components for a multilane open road tolling application or traffic monitoring application are illustrated in FIG. 1C. Each lane contains a unique combination of sensors that provide the following vehicle characteristics direction of travel, speed, number of axles, dual tires presence, vehicle length, axle spacing, vehicle travel position in the lane, and vehicle classification. The sensors include the Smart Loop Treadle sensor assembly (details 132 & 133) and the Lane Position Sensor (details 130 & 131).

The Smart Loop Treadle assembly provides vehicle signatures when vehicles pass over the sensors. The vehicle signatures samples are processed by controller and software into vehicle characteristics. These vehicle characteristics are applied to the application requirements for conventional toll lanes, multiple tolling lanes and multiple lane traffic monitoring applications. FIG. 1D illustrates a signature sample from an SUV vehicle towing a steel flatbed single axle trailer. The signature from the Ferromagnetic loop (140) has a resident frequency of 65,200 Hertz. The frequency of the Ferromagnetic loop (141) increases when the steel belted tires of a SUV pass over the sensor and increase the frequency to of 65,325 Hertz. This is an increase of 125 hertz when the front and rear tires (141) pass over the sensor. However, the trailer being towed by the SUV has polyester reinforced tires and the Ferromagnetic sensor has a slight increase in frequency from the steel flatbed trailer chassis but does not increase from the polyester reinforced tire wheel assembly. The ferromagnetic sensor does not detect or count the polyester reinforced tire. In contrast, the signature from the Eddy current sensor (142) has a decrease in frequency from the SUV wheels and chassis. The resident frequency of the Eddy current sensor 65,200 Hertz and the front wheel assemblies (143) of the SUV cause a decrease in the frequency of the sensor 65,050 Hertz. The rear wheel assemblies of the SUV cause a decrease the frequency of the Eddy current sensor down to 65,100 Hertz (143). The trailer wheel assembly with the polyester reinforced tire cause a decrease in the frequency of the Eddy current sensor below 65,050 Hertz (144) and is detected (counted) as an axle. This illustrates the benefit of using both an Eddy current sensor for polyester reinforced tires and a Ferromagnetic sensor to detect steel belted reinforced tires commonly found on vehicles. The Lane Position sensor is beneficial in multilane tolling application since it provides the position of the vehicle in the lane. This information is used to associate the passing vehicle with the RFID reading and vehicle captured image when the vehicle is not traveling in the center of the lane.

The frequency of a Ferromagnetic Sensor increases when the vehicle wheels pass over the sensor. The sensor is typically 11 feet wide by 12 inches long.

Figure 4:
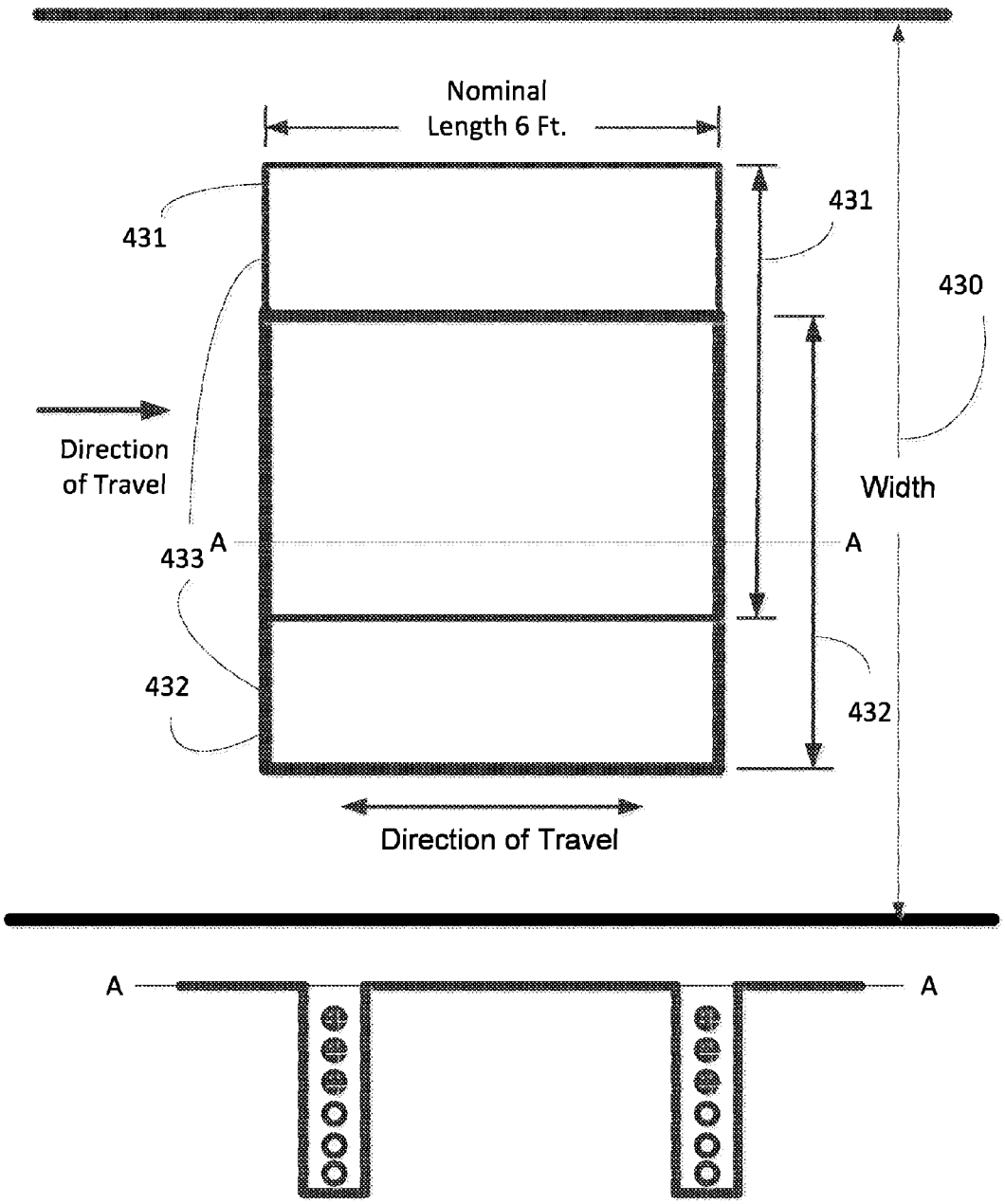

FIG. 4 is a diagrammatic view of lane position sensor plan view and cross section of parallel installation. The sensor is composed of two separate wire windings and they are identical in the shape and number of turns. The pair of loops overlap in the center of the travel lane. They do not overlap on the left side and right side on the lane. The cross section of the loop illustrates the area where the two circuit overlap.

Figure 4A:
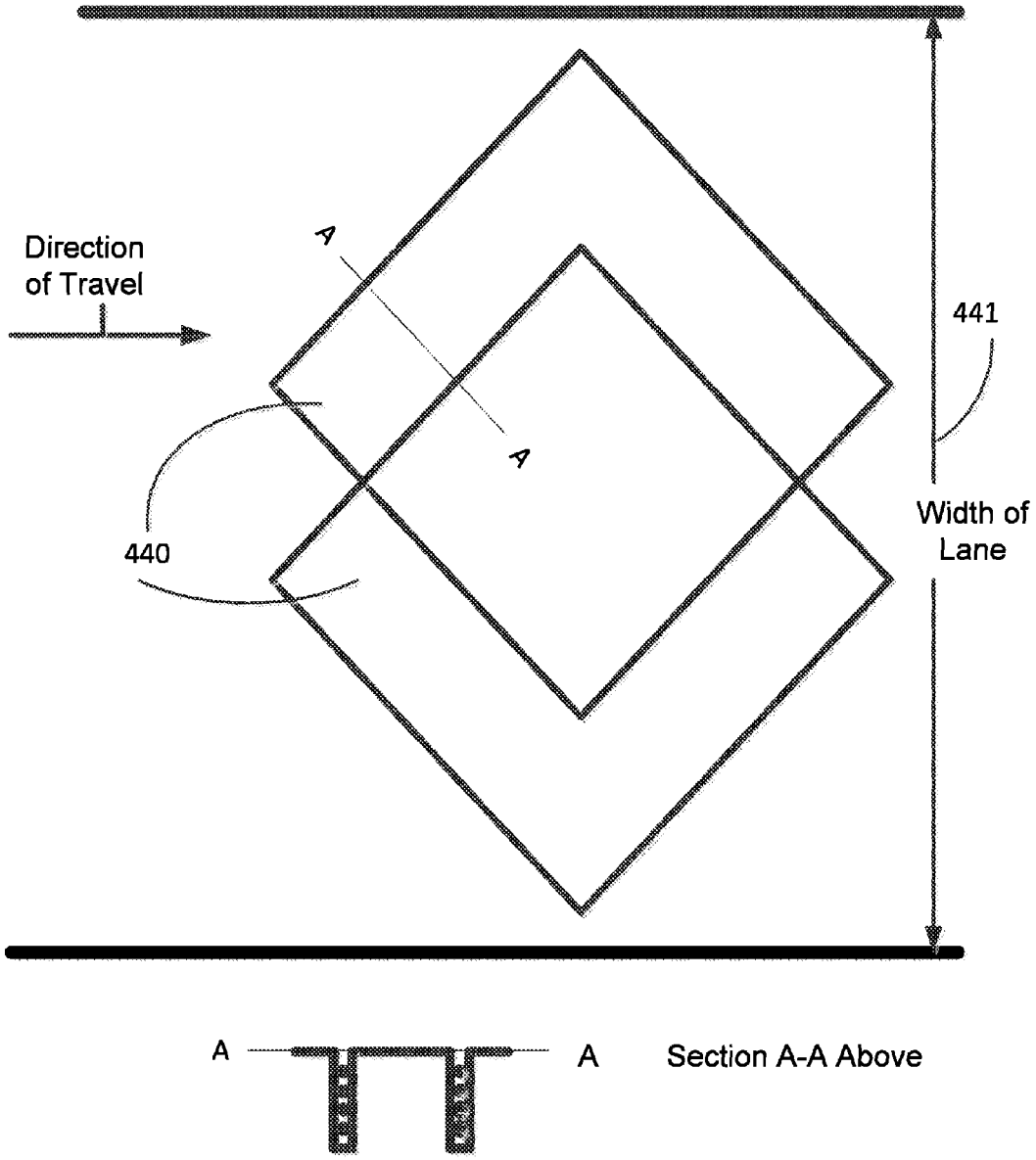

FIG. 4A is a diagrammatic view of lane position sensor plan view and cross section of diamond installation. The sensor is composed of two separate wire windings and they are identical in the shape and number of turns. They are installed at an angle of 45 degrees to the direction of travel. The pair of loops overlap in the center of the travel lane. They do not overlap on the left side and right side on the lane. The cross section of the loop illustrates the area where the two circuit overlap.

Figure 4B:
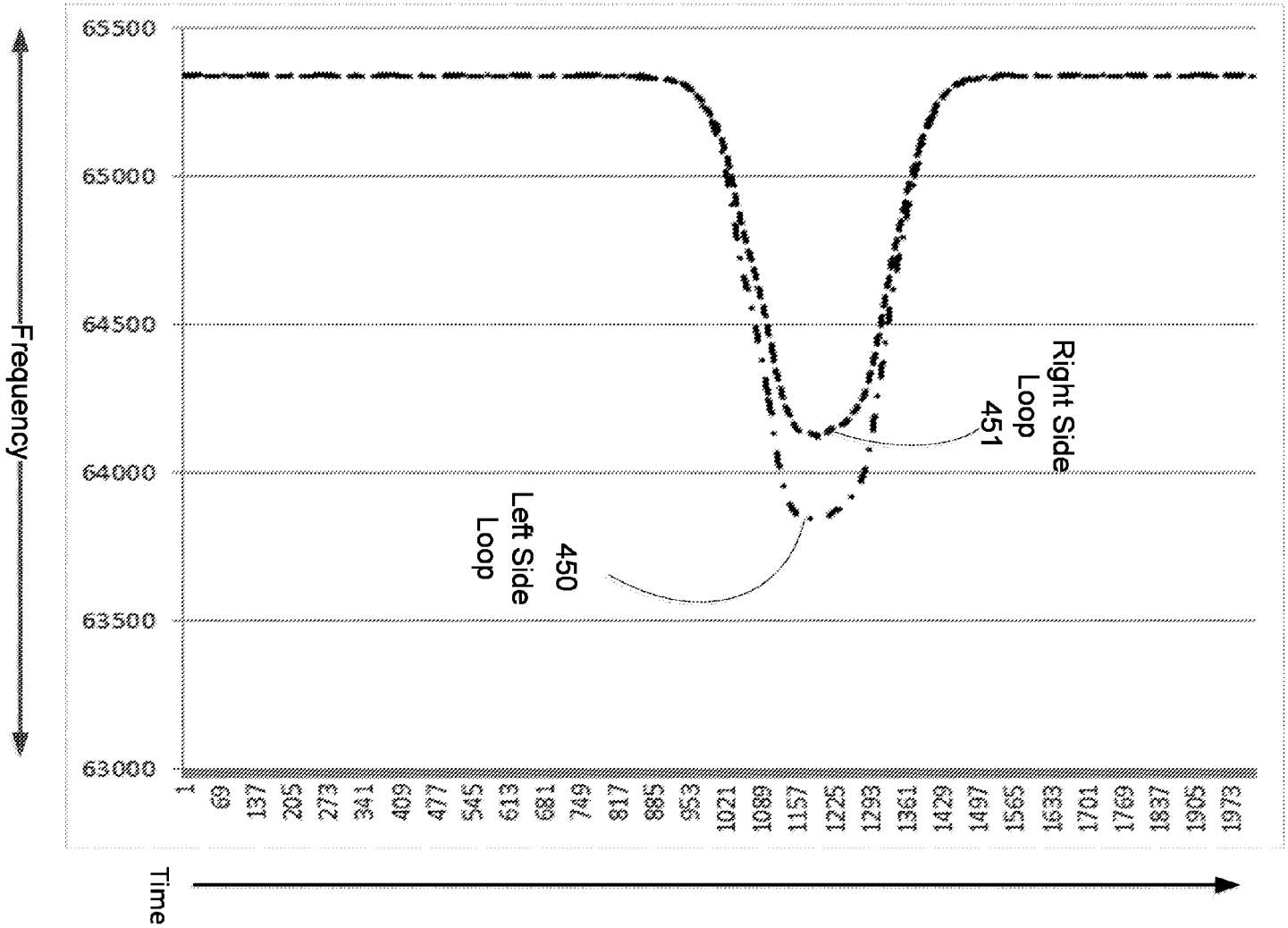

FIG. 4B is a diagrammatic view of sample signature of vehicle traveling on the left of the lane. The signature indicates that the vehicle is traveling on the left side of the lane. The change in frequency is greater in the left loop circuit. This information can aid in correlating the toll tag read and/or the vehicle image in toll applications.

Figure 4C:
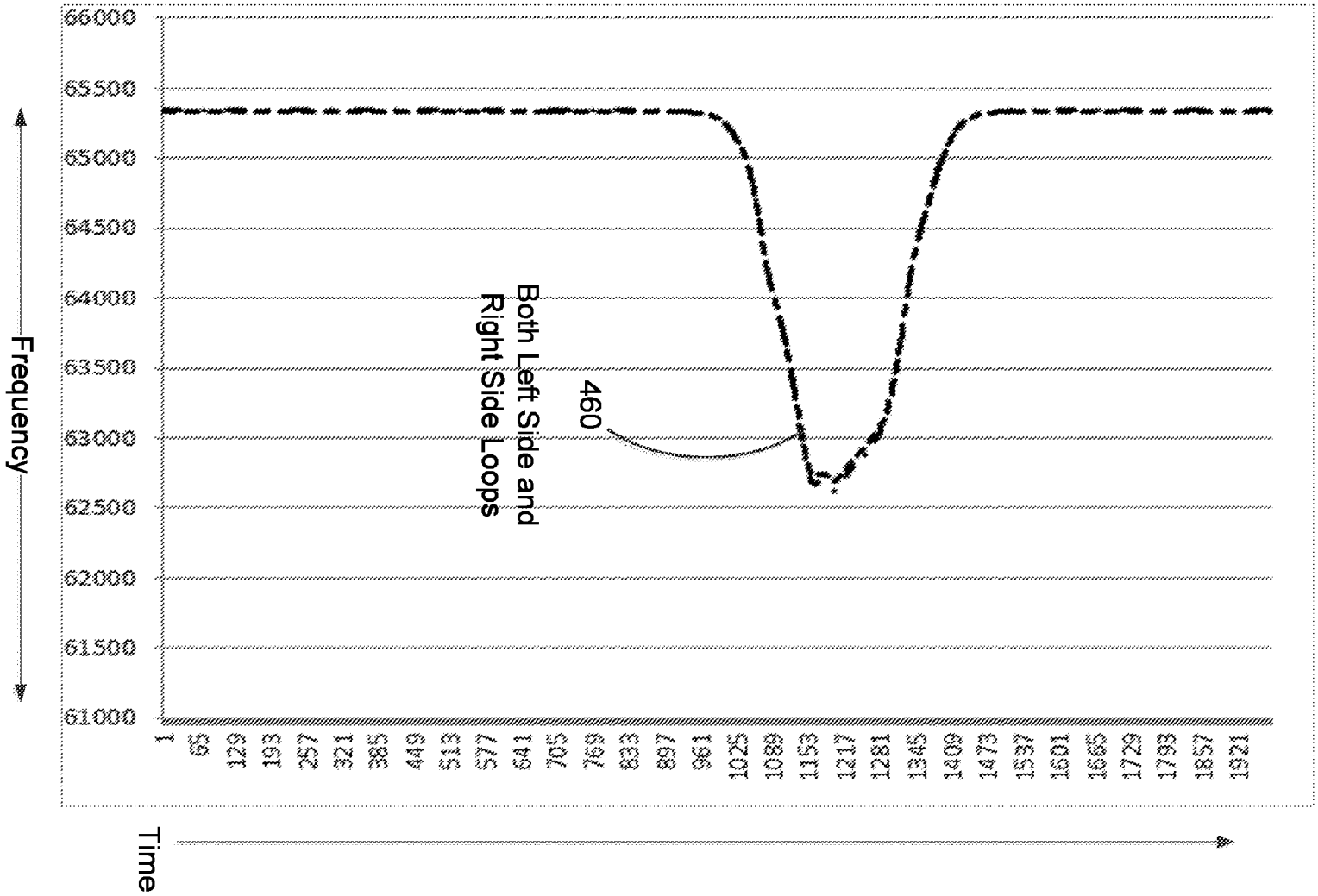

FIG. 4C is a diagrammatic view of sample signature of vehicle traveling in the center of the lane. The signature indicates that the vehicle is in the center of the lane and the change in frequency is equal in both he left and right loop circuit. This information can aid in correlating the toll tag read and/or the vehicle image in toll applications.

Figure 4D:
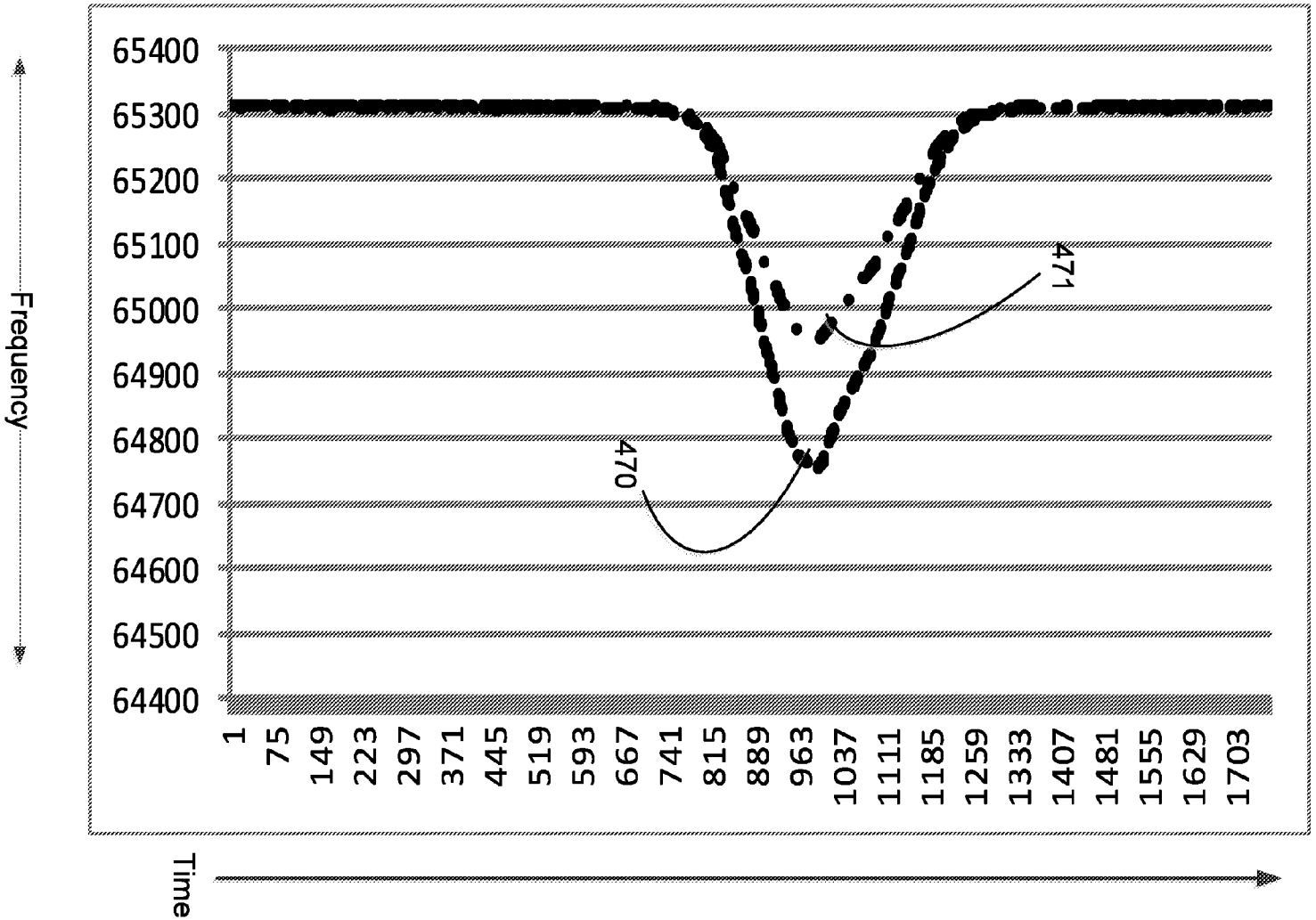

FIG. 4D is a sample signature of vehicle traveling on the right side of the lane. The signature indicates that the vehicle is traveling on the right side of the lane. The change in frequency is greater in the right loop circuit. This information can aid in correlating the toll tag read and/or the vehicle image in toll applications.

Figure 5:
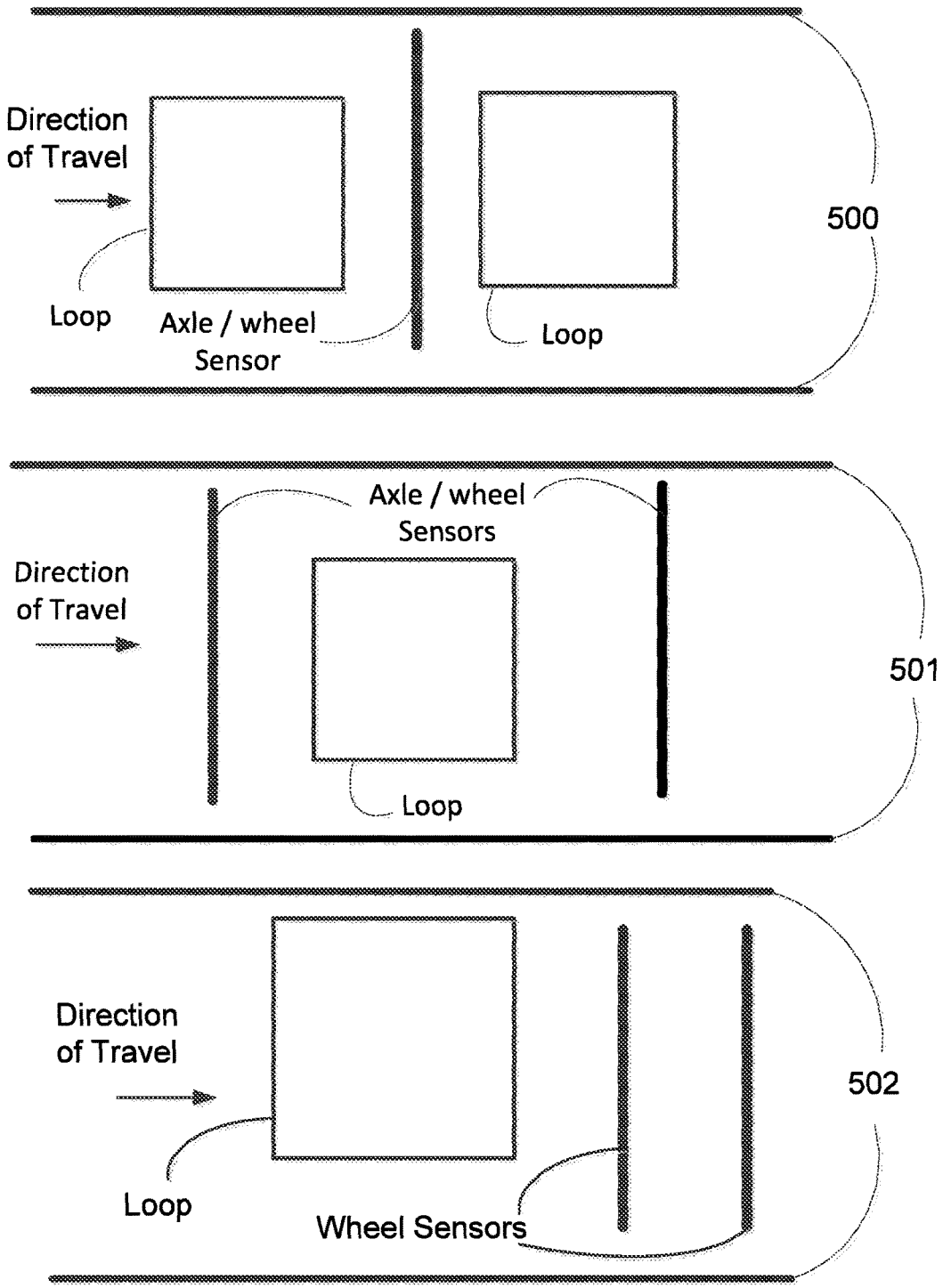

FIG. 5 is a diagrammatic view of prior art of wheel sensors and loop arrangements. This drawing illustrates three arrangements of sensors in a lane that are used for vehicle classification in a lane. These sensor arrangements include wheel sensors and inductive loops.

Figure 5A:
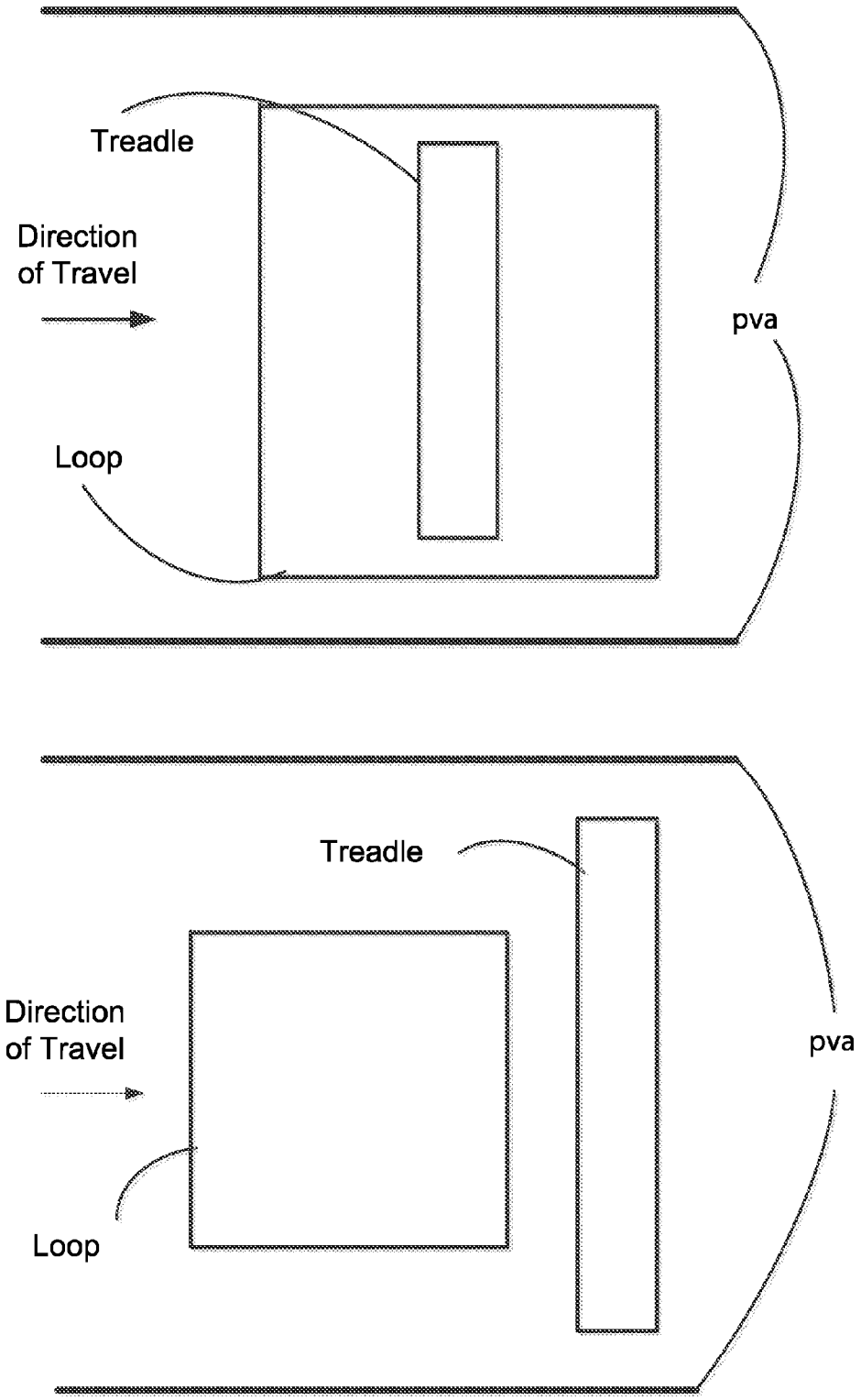
Figure 5A PRIOR ART

FIG. 5A is a diagrammatic view of prior art of toll lanes with treadle. This drawing illustrates two arrangements of sensors in a lane that are used for toll collection at a toll booth. These sensor arrangements include a treadle and an inductive loop.

Figure 6:
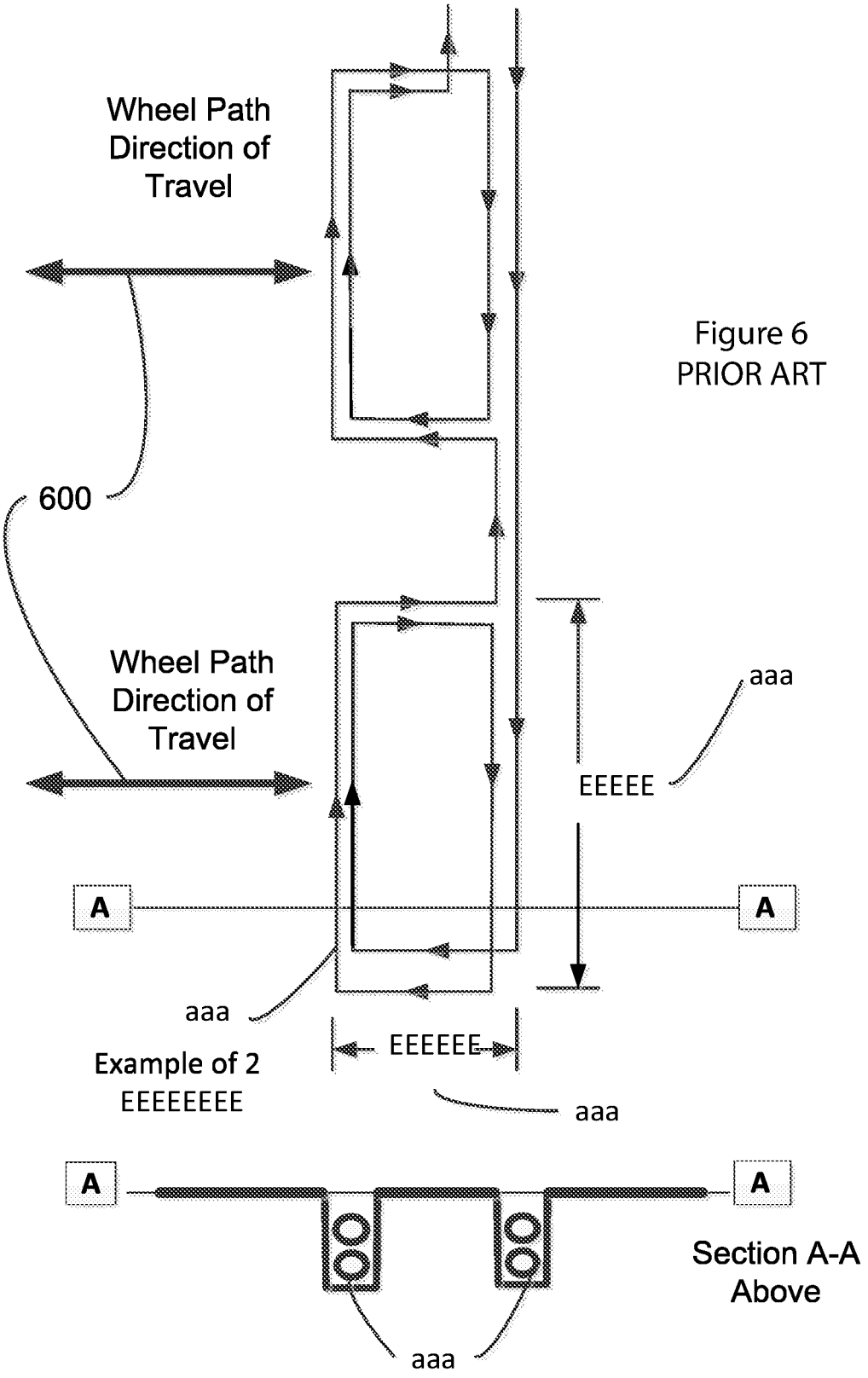
Figure 6 PRIOR ART

FIG. 6 is a diagrammatic view of a prior art Stanczyk cross section wheel detection on a rectangular type loop. This illustrates the single rectangular winding of the sensor as divulged in the patent. The sensor provides two thresholds and is restricted in its length geometry to being smaller than the diameter of the wheel. The sensor detects both the wheel assemblies and the chassis. The positive voltage reading is from the chassis. The negative voltage is from the wheels of the vehicle.

Figure 7:
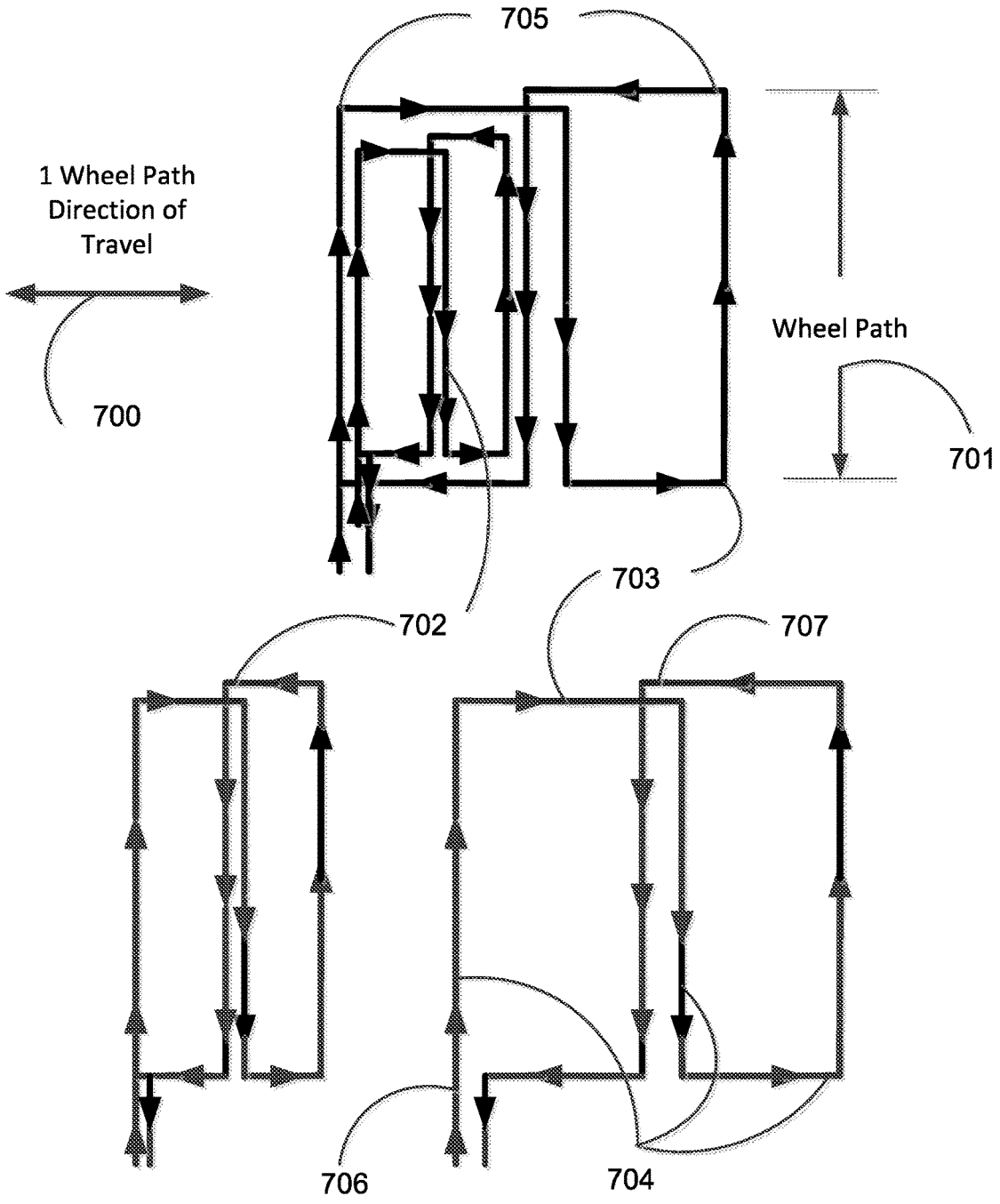
Figure 7 PRIOR ART

FIG. 7 is a diagrammatic view of a prior Art Lee cross section wheel detection on quadrupole type loop. This illustrates the quadrupole or figure eight winding. This design incorporates multiple sensors with figure eight winding circuits. There are typically two loop circuits per wheel path and a total of four used per lane for detection.

Figure 8:
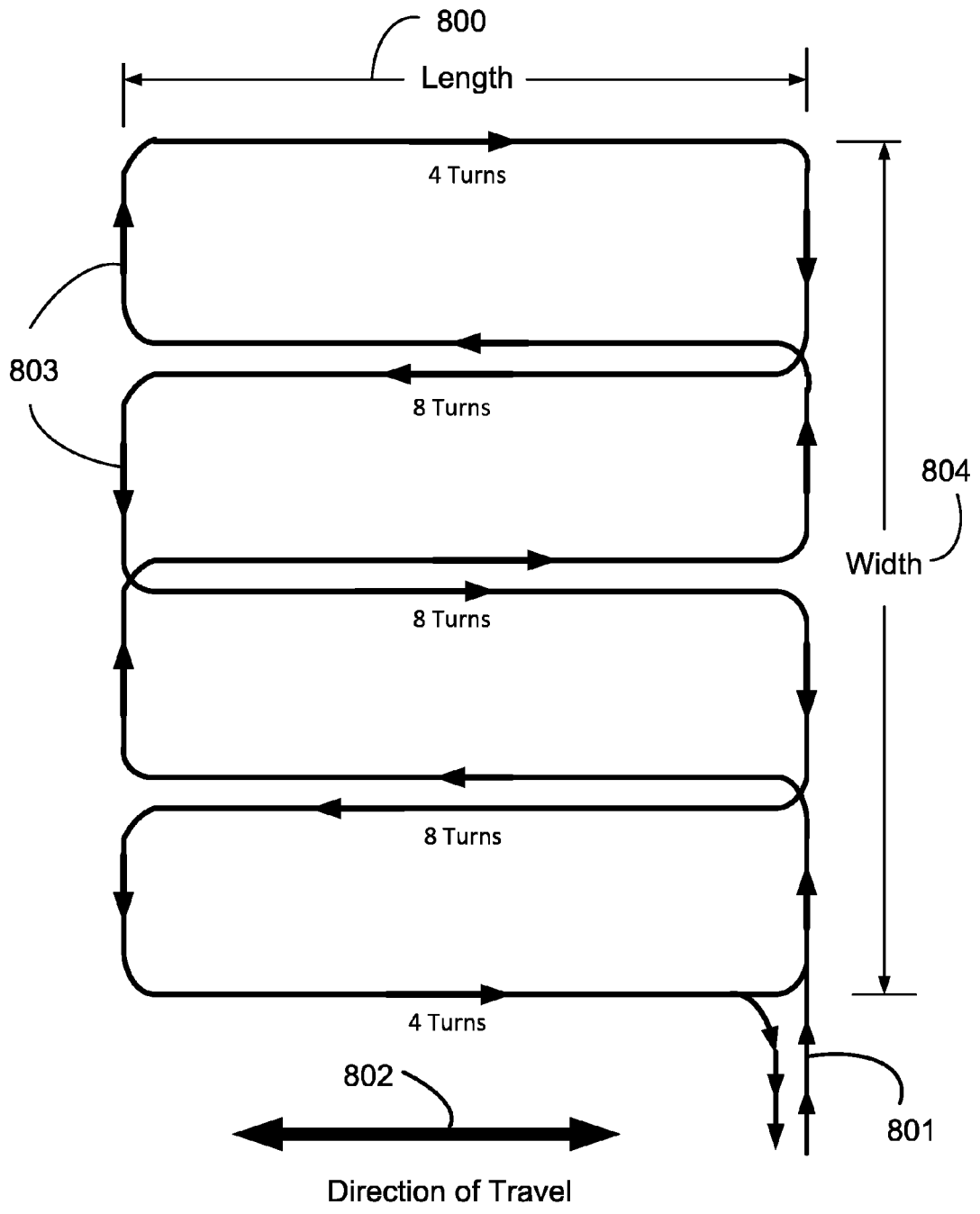
Figure 8 PRIOR ART

FIG. 8 is a diagrammatic view of a prior art publication no. FHWA-IP-90-002, bicycle lane loop layout. This serpentine pattern of wire turnings was also divulged and used in the bicycle loop in Publication "Traffic Detection Handbook, Second Edition, Publication No. FHWA-IP-90-002 date July 1990, page 93 FIG. 94. Bicycle lane loop layout.

Figure 9:
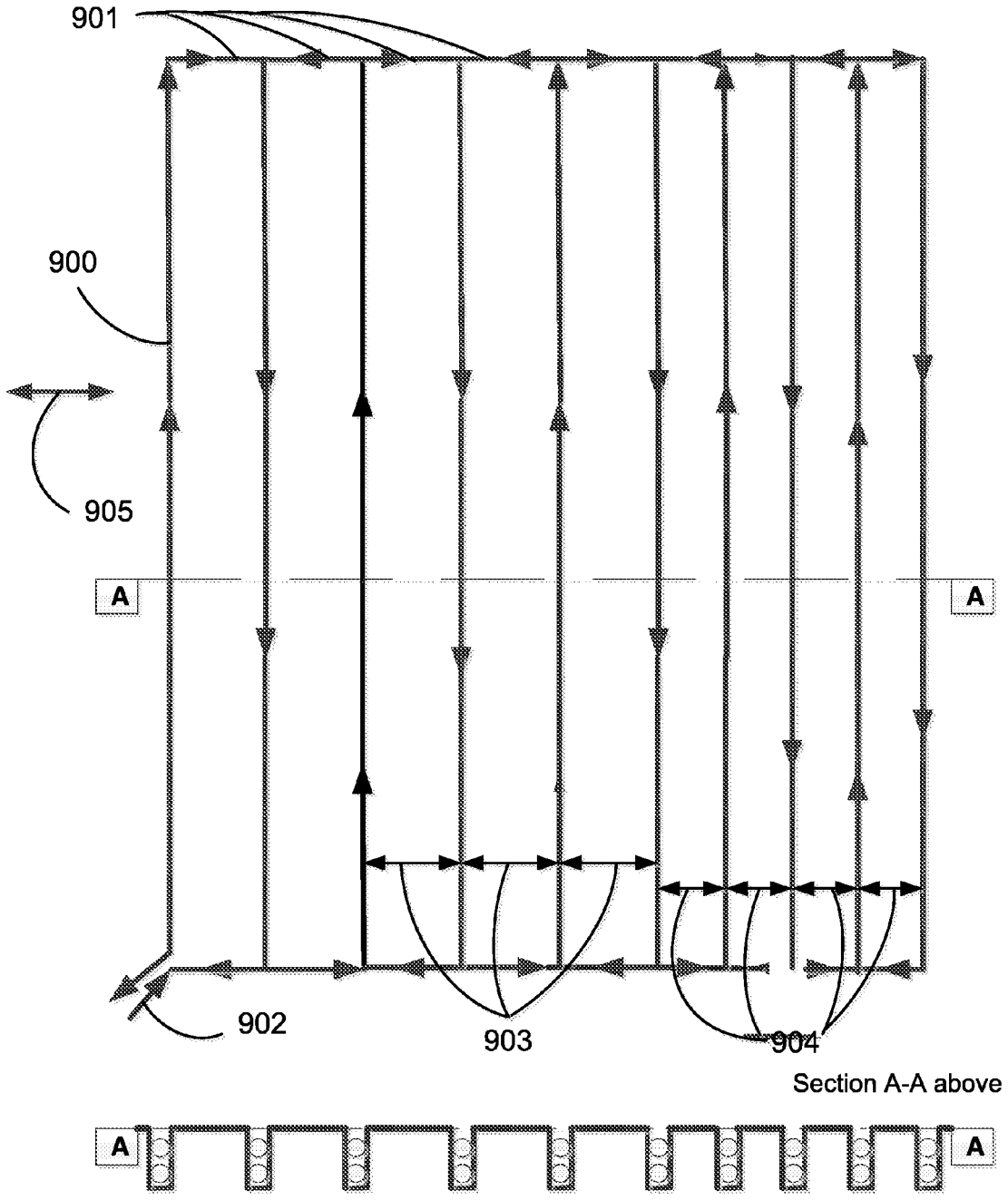
Figure 9 PRIOR ART

FIG. 9 is a diagrammatic view of a prior art Allen cross section wheel detection on a serpentine polygon loop. This illustrates the series serpentine windings in a rectangular pattern. The preferred design has two different lengths of rectangles in a single circuit.

Figure 10:
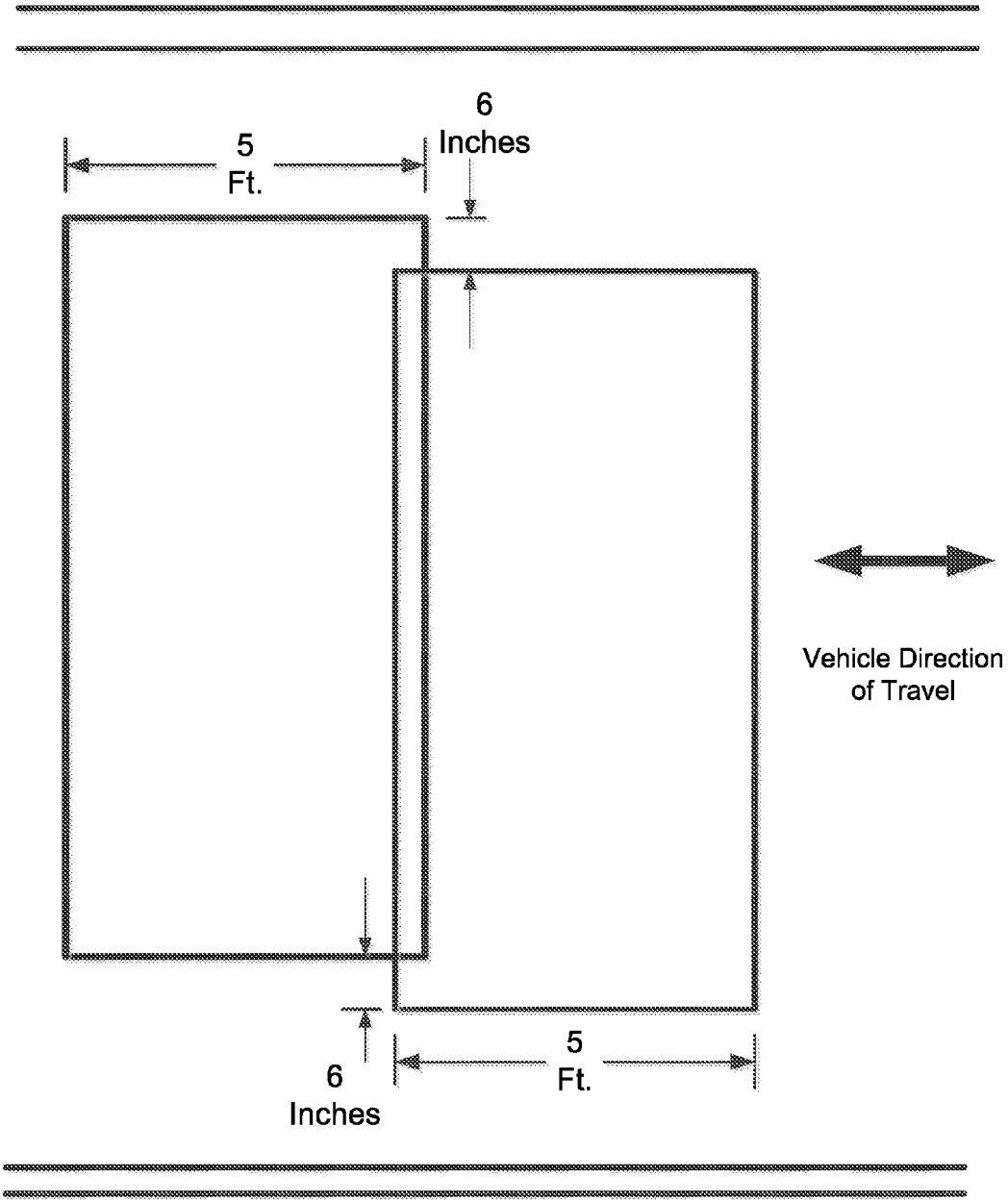
Figure 10 PRIOR ART

FIG. 10 is a diagrammatic view of a Prior Art Publication No. FHWA-IP-90-002, Directional detection. The use of two rectangular loops on separate circuits can be used to support directional logic.

DETAILED DESCRIPTION OF THE INVENTION

Figure 1:
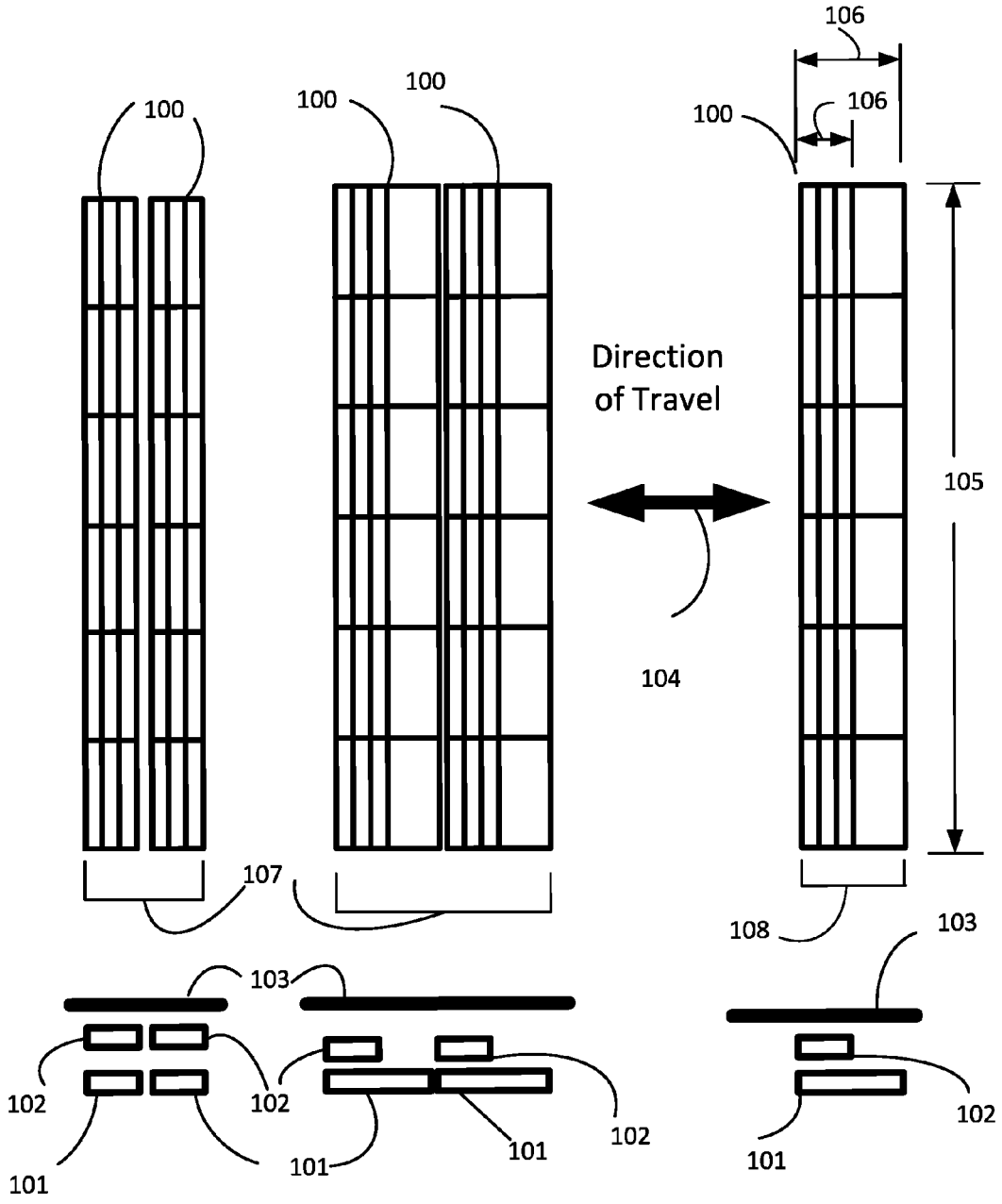
FIG. 1 is a diagram of smart loop treadle with a double threshold and a single threshold in a single toll lane. This combination allows for the detection of wheel assemblies having steel belted tires and non-steel belted tires. Also, the system detects the direction of vehicle travel and can detect a reversal in the direction of a vehicle traveling over the sensor. The sensor is bidirectional. The double threshold smart loop treadle contains two Eddy current sensor (22×24 with 5 turns and 6 segments) and two Ferromagnetic sensors (3-6-6-3). The single threshold sensor contains one Eddy current sensor and one Ferromagnetic sensor.

System Description FIG. 1 illustrates the preferred installation of the Smart Loop Treadle with a double threshold smart loop treadle (107) having two pairs of sensors. Each pair of sensors contains one Eddy current sensor (101) and one Ferromagnetic sensor (102) creating a Smart Loop Treadle assembly. The Eddy current sensor is installed below the ferromagnetic sensor. Two smart loop treadle assemblies (100) are installed in the roadway side by side. The single threshold Smart Loop Treadle (100) contains one Eddy Current effect type sensor and one Ferromagnetic effect type sensor. These sensors are arranged in the roadway by having the Eddy current sensor installed in the roadway below the Ferromagnetic sensor that is installed in the roadway close to the surface of the roadway The preferred method of installation is having the Eddy Current type sensor (101) installed below the Ferromagnetic effect type sensor (102). These two types of sensors provide the detection of two types of wheel assemblies: the non-ferrous wheel assemblies (Eddy Current Type) such as a wheel assembly with a polyester tire and the ferrous materials (Ferromagnetic Type) such as a wheel assembly with a steel belted tire. The sensors are installed on top of the roadway or near the surface of the roadway (103). Also, the direction of vehicle travel (104) is perpendicular to the width (105) of the sensor and the length of the sensor (106) is parallel to the direction of travel. The Smart Loop Treadle can be installed providing a double threshold (107) to detect a reverse in the direction of a vehicle traveling over the sensor. This also provides redundant wheel detection. A Smart Loop Treadle sensor can be installed having a single threshold (108) configuration. This can be used in applications where detection of vehicles reversing direction is not required or additional sensors are present to support the detection of vehicle's reversing their direction of travel.

Figure 1A:
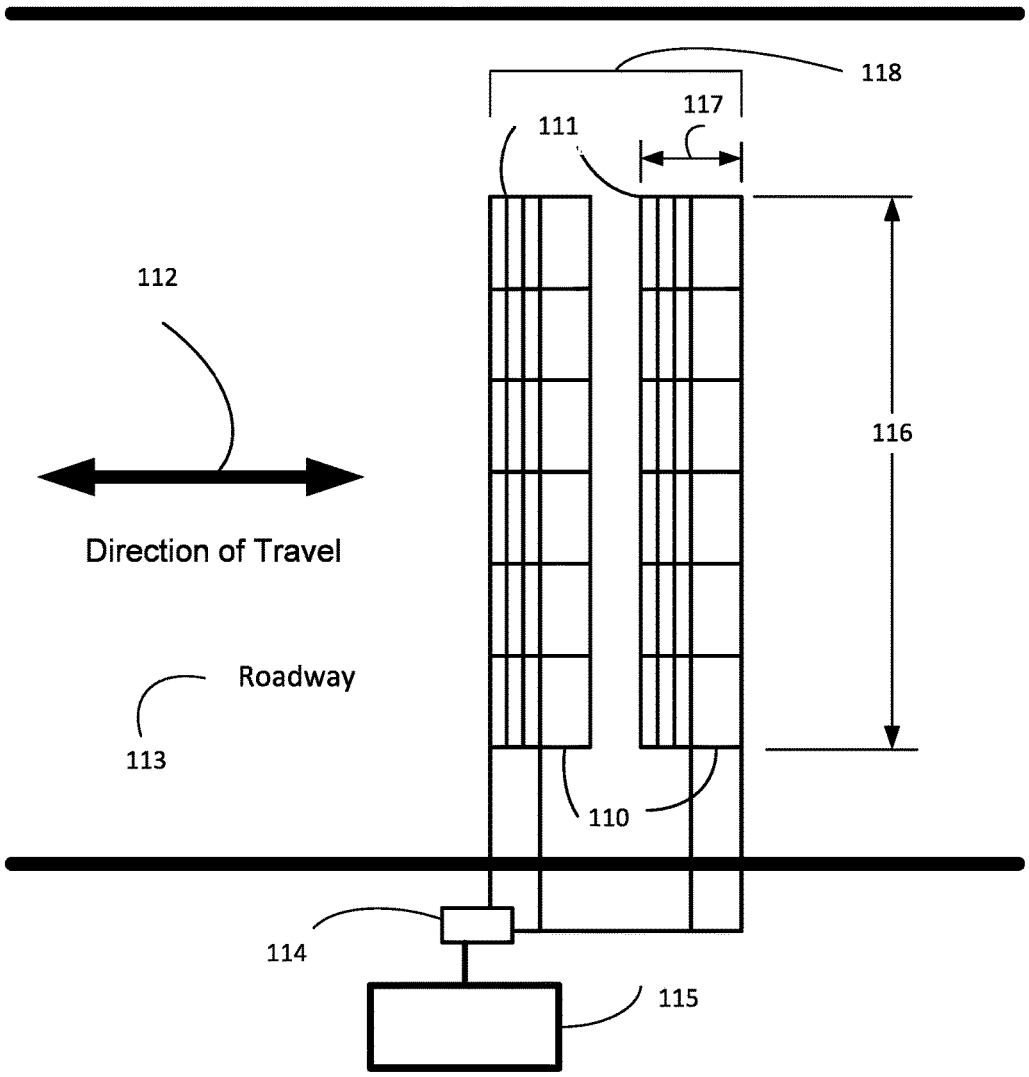
FIG. 1A is a system block diagram of smart loop treadle in single toll lane. The three primary components of the system include the four sensors, a loop amplifier, and a controller. The Smart Loop Treadle assembly includes two Eddy Current sensors and two Ferromagnetic sensors. These sensors are installed on or near the road surface.

FIG. 1A is a system diagram that illustrates the components of a Smart Loop Treadle having a double threshold sensor array composed of two Smart Loop Treadle assemblies (118). The Eddy current sensors (110) are all designed to optimize the detection of wheel assemblies while minimizing the detection of the vehicle chassis and the Ferromagnetic sensor (111) is optimized to detect steel belted reinforced tires. This installation can also be used for the single threshold Smart Loop Treadle that includes one Eddy current sensor (110) and one Ferromagnetic sensor (111).

The Smart Loop Treadle assemblies provide detection of both steel belted reinforced tires and non-steel belted tires in, for example, wheel assemblies that contain polyester reinforced tires. The Smart Loop Treadle is designed to provide the detection of a vehicle's direction of travel (112) as the vehicles pass over the Smart Loop Treadle located in the roadway (113). The detection of both wheel assemblies with non-steel ferrous tires and steel belted reinforced tires are detected this is very important since both types of tires exist in the general vehicle population. Also they both can occur in combination on the same vehicle when trailers are towed by vehicles.

This detection is accomplished by using two distinctly different sensor designs described in this patent. One sensor type is designed to optimize the detection of wheels with non-steel belted tires by responding with a decrease in frequency when wheel assemblies having non-steel belted tires pass over the sensors (110). The second sensor type is designed to optimize the detection ferrous materials and reinforced steel belted tires by responding with an increase in frequency when the steel belted reinforced tires pass over the sensor (111).

This invention works by using a Eddy current loop sensor that is installed in the roadway and below the surface at the preferred depth of 3 to 6 inches. The sensor's magnetic field is intersected by the wheels of vehicles passing over the sensor. When the wheels intersect the magnetic fields of the sensor the resonant frequency of the loop sensor decreases and these frequency changes are measured to detect to wheels on the vehicles.

The ferromagnetic sensor is installed in the roadway and near the surface at the preferred depth of 1 to 2 inches. When vehicles wheels pass over the ferromagnetic loop sensor the steel belted tires can conduct the magnetic fields. This causes an increase in the magnetic fields strength and will cause the frequency of the loop circuit to increase. The increase in frequency is measured to detect the steel belted tires on tires on the vehicle. The sensor loop wire is activated with an oscillating frequency by the loop detector amplifier and acts like an antenna. Each sensor has magnetic fields associated with the loop circuit. This oscillating loop circuit has a resonant frequency that is provided as an output. The output frequency is sent and monitored by the controller. When vehicles pass over the sensor's loop wire the frequency of the loops circuit will change by increasing and/or decreasing. The controller contains software algorithms that interrupts the outputs from the various sensors and records the results. These results are processed to provide the number of vehicle axles and vehicle classification.]

For example, the non-ferrous tire wheel assemblies are detected by sensors that are designed to optimize the effect of Eddy currents that generate resistive losses that are a source of energy loss and lower the residence frequency of the loop circuit when the non-ferrous wheel assemblies pass over the sensor (110). In contrast, steel belted reinforced tires are detected from the rotatory magnetism by loop sensors designed to optimize the ferromagnetic effect that provides an increase in the loop residence frequency when the steel belted reinforced tires pass over the sensor (111).

The use of both types of sensors in the Smart Loop Treadle provides very high accuracy for wheel assembly detection. Vehicles with non-steel belted tires such as small cars, motorcycles, and small trailers are detected by the first type of sensors that optimize the Eddy current effect (110). Vehicles containing steel belted reinforced tires such as cars or trucks are detected by the second type of sensor that optimizes the ferromagnetic effect (111).

The Smart Loop Treadle design can be used by transportation planning and tolling agencies for vehicle classification. The sensors generate an electromagnetic flux field that can be used to distinguish single tire wheel assemblies from dual tire wheel assemblies. The information can be used to levy toll revenue.

The Smart Loop Treadle sensor assembly provides the direction of the vehicle and can detect when a vehicle reverses direction. The assembly contains both types of sensors and can accurately count the number of wheel assemblies when a vehicle traveling over the sensors has steel belted tires and is towing a vehicle or trailer that has non-steel belted tires.

This invention, the Smart Loop Treadle in FIG. 1A (details 110 & 111), is used in combination with two other components: a traffic loop amplifier (114), and signal processing controller (115). The tire assembly sensors (details 110 &111) are activated by a traffic loop amplifier (114). The loop amplifier (114) provides oscillating frequencies into the sensor circuits, creating fields of flux and the frequencies of the sensors change when the vehicles on the roadway pass through the fields of flux present in the sensors. This causes changes in the resident frequency of the sensors that are sent from the loop amplifier to the controller. The traffic loop detector processes these frequency changes and they are expressed in a digital data stream to the data processing controller (115).

The digital data stream from the loop amplifier is processed and analyzed by the signal processing controller (115) to identify the vehicle tire assembly characteristics from a vehicle traveling over a sensor or sensors. This information is associated with the vehicle attributes and applied to the sum of axles present on the vehicle or applied to classify the vehicles. The data processing controller is composed of communication ports for inputs and outputs of the processed sensor information. The controller processes the input and outputs storing the vehicle characteristics and can transmit the processed information to other devices as required by the application.

Figure 1B:
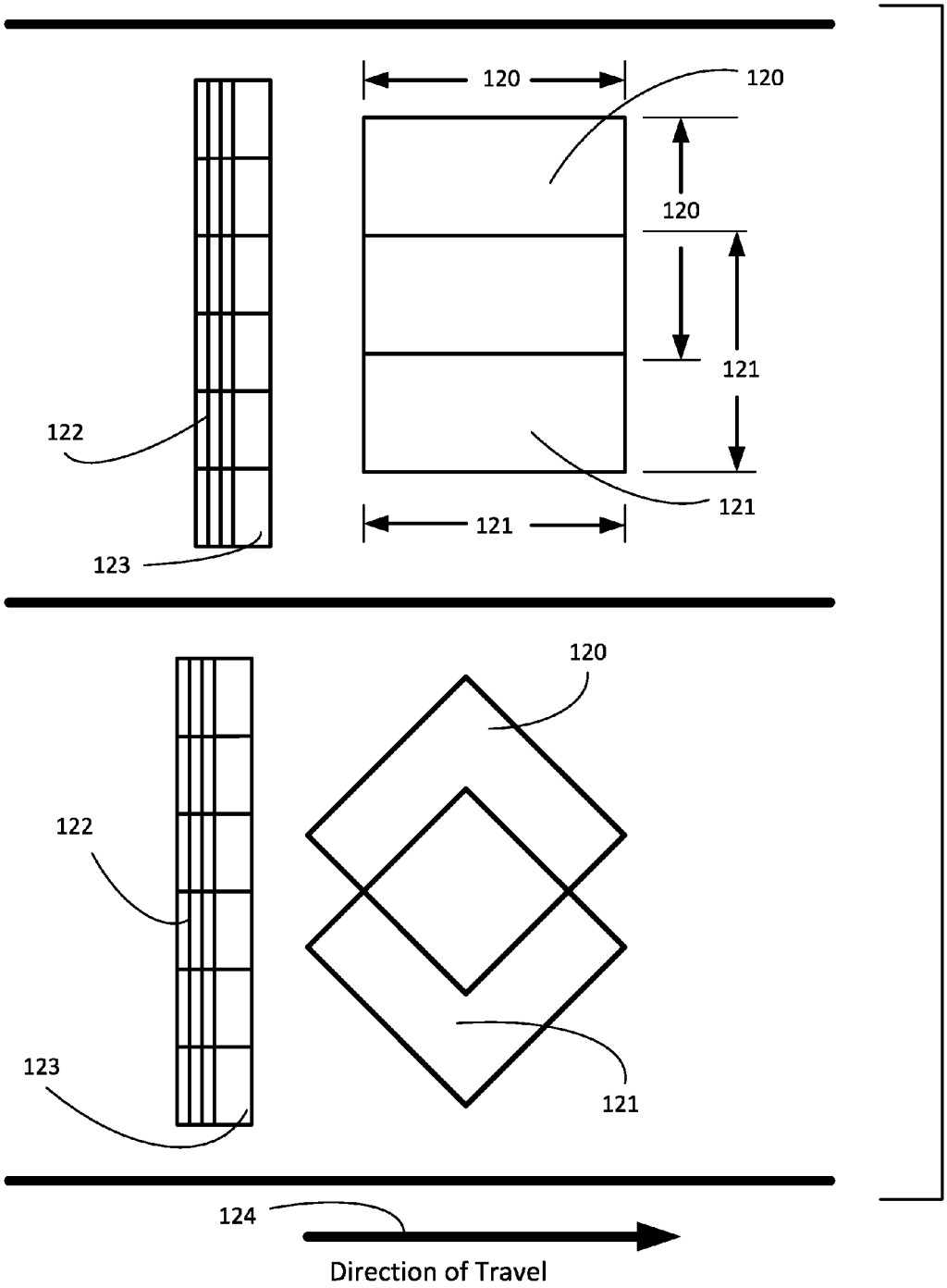
FIG. 1B is a diagrammatic view of a multiple lanes application with smart loop treadle sensors and a lane position sensor. The device assembly shown illustrates the primary lane components relationship including the two loop circuits in the Lane Position sensor and the Smart Loop Treadle sensors that include an Eddy Current sensor and Ferromagnetic sensor. This illustrates an alternative lane layout of the Lane Position sensor. The two loop circuits can be installed with the loop sensor leading edge perpendicular to the direction of traffic and having each loop circuit rotated forty-five degrees to the direction of traffic.

A multiple lane installation is illustrated in FIG. 1B each lane has a Lane Position Sensor (details 120 & 121), Ferromagnetic Sensor (122) and Eddy Current Sensor (123). The Lane Position Sensor contains two loop circuits a left side loop circuit (120) and a right side loop circuit (121). The lane position sensor identifies the vehicle position in the travel lane by determining if the vehicle is traveling on the left side of the lane, in the center of the lane or on the right side of the lane. The lane position sensor contains two separate loop circuits in a travel lane. The loops overlap each other and one loop is place towards the left side of the lane and the other loop is placed towards the right side of the lane. The two loop sensors are connected to loop amplifier. The loop sensor frequency of both loops is monitored by the controller. The amplitude of the signatures are compared. When a vehicle passes over the loops the frequency of the loops changes. The amount of frequency change that occurs in each loop is compared. When the vehicle is traveling in the center of the lane the amount of frequency change in the two loops is equal. This indicates that the vehicle is traveling in the center of the lane.

When a vehicle travels on the left side of the lane the amount of frequency change in the two loops is compared and the loop located towards the left side of the lane has a greater change in frequency than the loop located towards the right side of the lane. This indicates that the vehicle is traveling on the left side of the lane.

When a vehicle travels on the right side of the lane the change in loop frequencies is compared. The loop located towards the right side of the lane has a greater change in frequency. This indicates that the vehicle is travel on the right side of the lane.

Figure 1C:
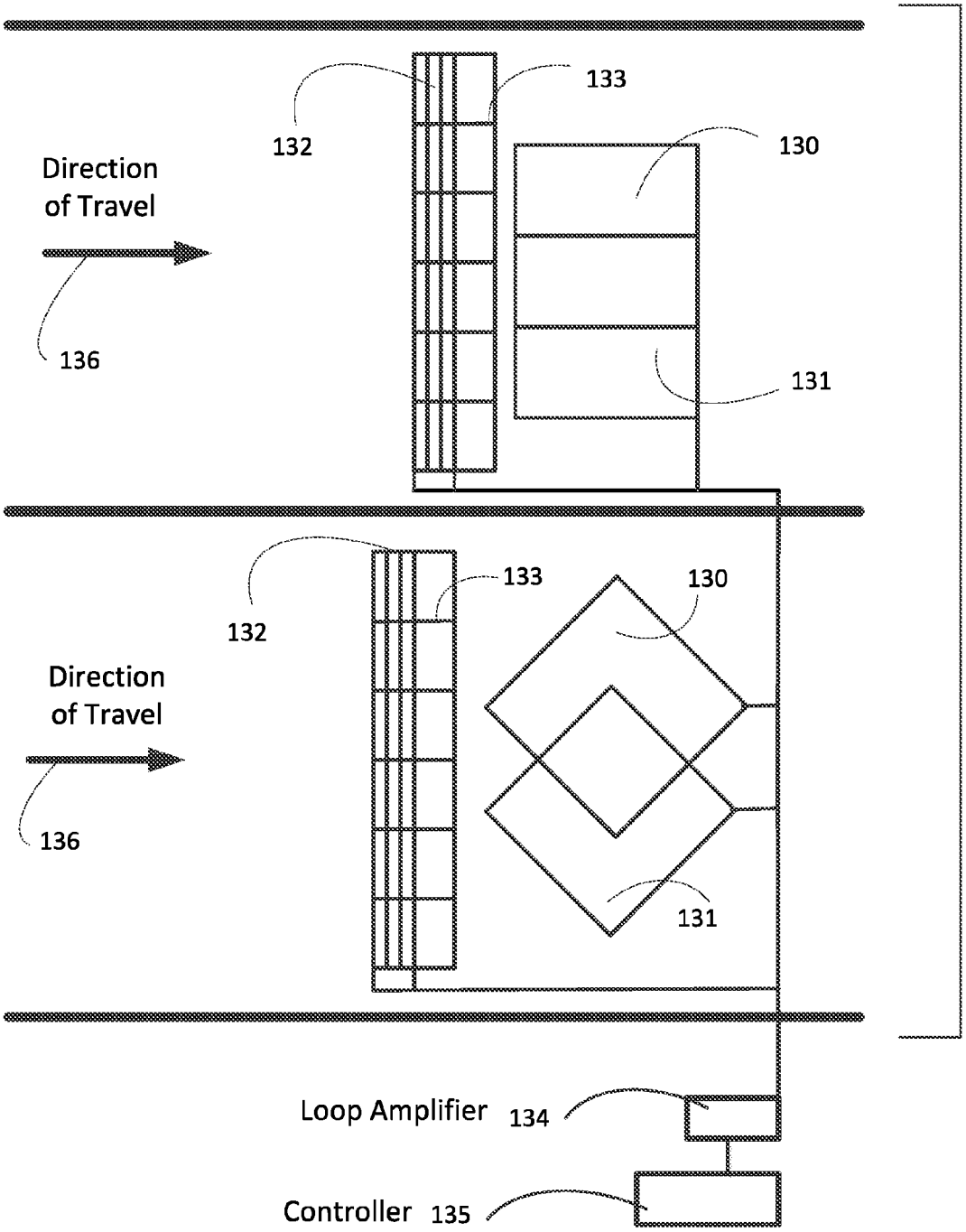
FIG. 1C is a system block diagram of multiple lane installation. The system block diagram illustrates the primary components relationships including the Eddy Current Sensor, Ferromagnetic Sensor, Lane Position Sensor, Loop detector, and Processing Controller.

In FIG. 1C, the system block diagram of a multiple lane installation is illustrated. The primary components include the three sensors the Lane Position Sensor (130 & 131), Ferromagnetic Sensor (132), and Eddy Current Sensor (133). These sensors are connected to a traffic loop amplifier (134). The traffic loop detector is connected to the processing Controller (135). The processing controller can store vehicle classification information and transmit the information for toll and traffic planning applications. When used for tolling applications the Smart Loop Treadle can detect and identify different wheel assemblies such as single tire assemblies and dual tire assemblies present on vehicles. This information is used to assign the amount of payment due in the tolling operation. This same information can be used for planning applications to classify the type of vehicle.

The number of lanes can be increased or decreased depending on the sight requirements. Each lane contains the same sensor layout. This sequence of sensors includes the Ferromagnetic Sensor (132), and the Eddy Current Sensor (133), and the vehicle position sensor (130 & 131). The direction of travel (136) provides the sequence of sensor signatures. This combination of sensors provides digital signatures that are processed into vehicle classification as required by the FHWA traffic monitoring guide or can be configured to provide a different schema.

Figure 1D:
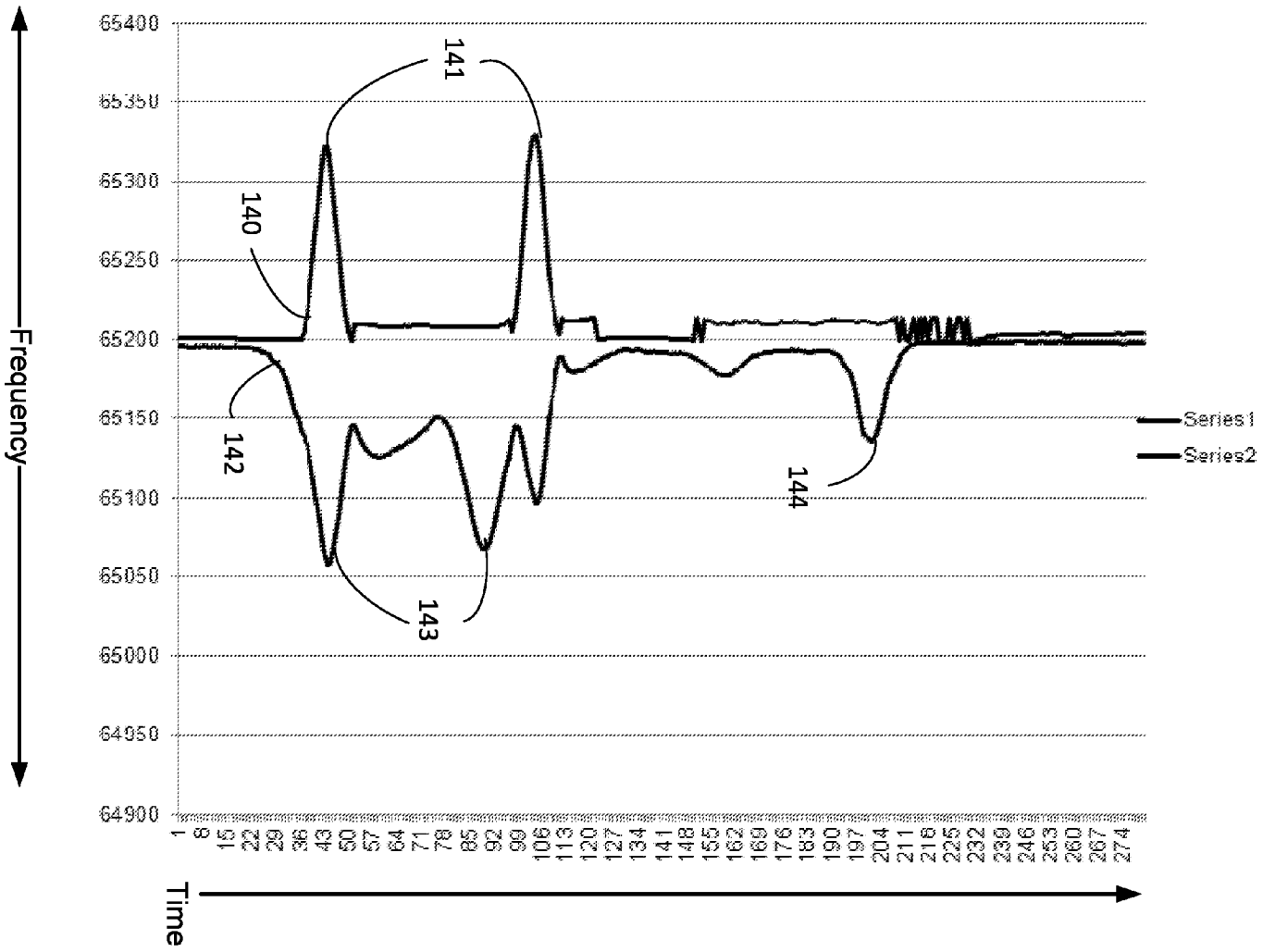
FIG. 1D is a graph showing an eddy current sensor and ferromagnetic sensor-signature of a SUV vehicle towing a trailer with 1 axle. The signature from Eddy Current sensor illustrates how the frequency of the sensor is lowered from the eddy current effect when a vehicles towing a trailer passes over the sensor. The signature from a Ferromagnetic sensor illustrates how the frequency of the sensor increases from the Ferromagnetic effect when a vehicle towing a trailer passes over the sensor.

The Test Signature of FIG. 1D illustrates the signature for an SUV with Steel Belted tires towing a single axle trailer with polyester reinforced tires. The SUV steel belted tires are detected by the Ferromagnetic sensor (140) and produce an increase in frequency illustrated by the two peaks (141) from the front and rear SUV axles.

The Eddy current sensor (142) shows a decrease in frequency from the eddy currents caused by the SUV front and rear wheel assemblies (143) and detects the trailer wheel assembly (144) with the polyester tire. This is where the frequency decreased and then returns to the base line frequency. In contrast the Ferromagnetic sensor does not detect the trailer wheel.

Figure 2:
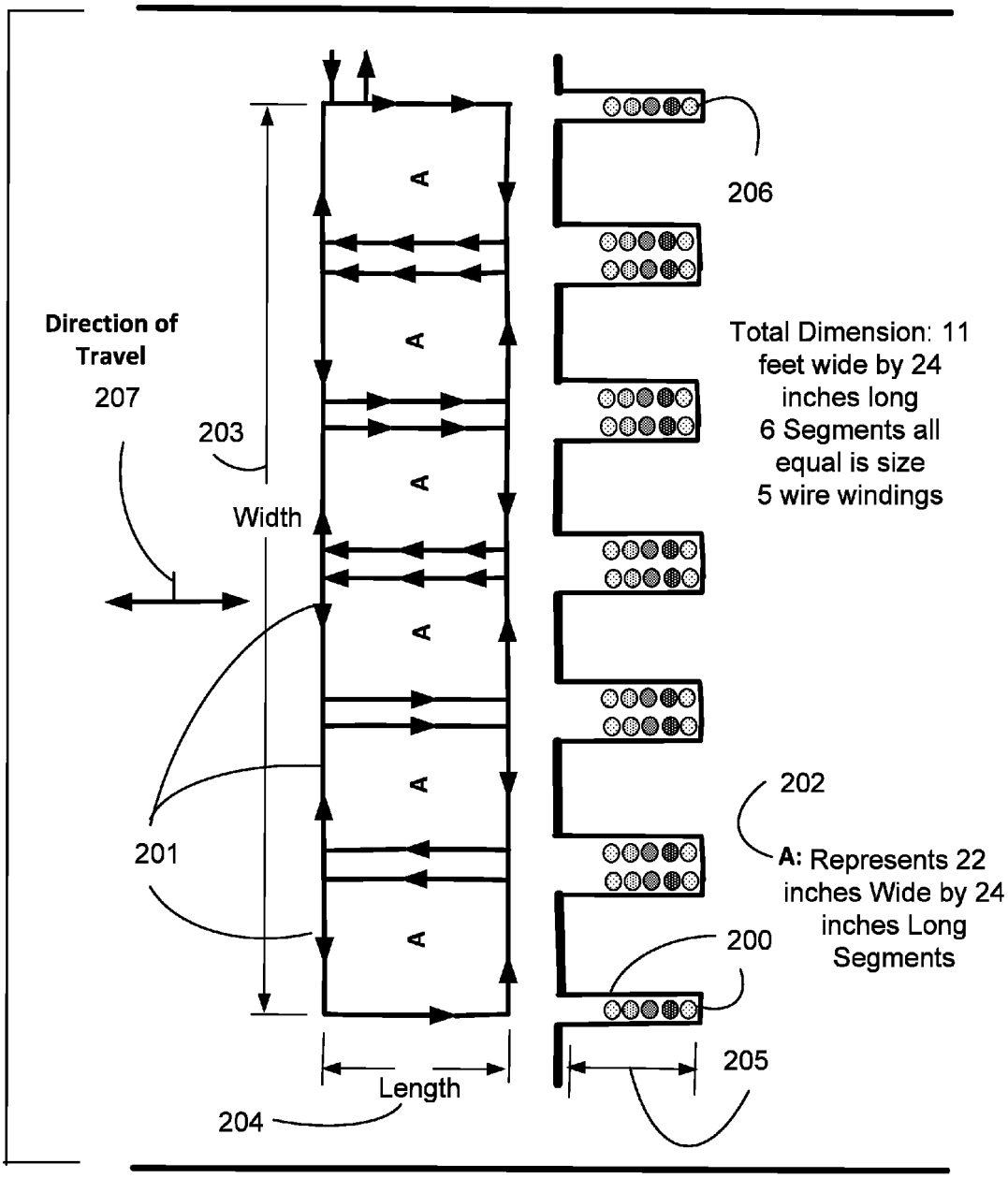
FIG. 2 is a graph showing an eddy current sensor with six (6) equal segments and five (5) turnings. The drawing illustrates the construction and installation of an Eddy Current sensor having six equal segments and five wire turnings. The sensor provides detection for the entire lane of travel. This example of an Eddy Current sensor has six segments each 22 inches wide by 24 inches long. The single sensor circuit has five wire turnings.

Eddy Current Sensor This embodiment has two Eddy Currents Effect sensor designs. The first design has a series of rectangular segments that are equal in size (FIG. 2). The second design has a series of rectangular segments that are not all equal in size. The significant difference in this design when compared to a Ferromagnetic Loop Sensor is the Eddy Current Sensor is designed to have the vehicles travel over the sensor parallel with the dominant primary flux fields. The Ferromagnetic Loop Sensor is designed to have the vehicles travel over the sensor perpendicular to the dominant primary flux fields.

Each Eddy Current Sensor is made of multi-stranded copper electrical wire. The wire is installed on the top of the roadway or in the roadway in the surface. The Eddy current sensor has multiple rectangular wire coils connected in series. The number of wire turnings can range from 2 turns up to 6 turns to achieve the desired inductance of the sensor (200). This unique series of rectangles are on a single circuit. The rectangles provide multiple electrical flux thresholds for wheel assembly detection as vehicles pass over the sensors installed on or in the roadway FIG. 2 (201).

The first design type of Eddy Current Effect sensor design consists of a multiple rectangular segments uniform in size connected in series in a single circuit (202). The number of rectangles in the series can be increased or decreased in the sensor to change the width of the sensor in order to provide detection the full width of the travel lane and the sensor width is the of the sum of rectangular loop segments (203). The length of the loop (204) can be increased to increase the data signature sample collected from the sensor. The length for each sensor is directly related to the sample length, since the sample rate of the loop detector occurs on a fixed time basis as the vehicles pass over the sensor. The increased number of samples is beneficial for wheel detection. When the vehicle speeds increase, the length of the loop can be increased by increasing the length (204) of the loop the number of samples or signature lengths from the wheel assembly is increased. The width (203) of each rectangular segment can range from 14 inches to 24 inches wide.

The length of the rectangular loop segments (204) can range from 12 inches to 36 inches long. Again, all the rectangular segments are equal in size (202) in the sensor.

The first Eddy current sensor design is described above and is illustrated in FIG. 2. The preferred method of installation is at a depth of 3 to 6 inches below the roadway (205). The preferred width of the rectangular segment (203) is 22 inches. The preferred number of wire wound turnings (200) is five (5). The preferred length (204) of this sensor is 24 inches long. The direction of travel for the vehicles is parallel to the primary flux fields of the sensor (207).

The first design is described above and illustrated in FIG. 2. The sensor can include six (6) segments and have an overall width of 11 feet and is preferably used in lanes that are 12 feet to 13 feet wide. The sensor can include five (5) segments (202) and have an overall width of 9.16 feet (203) and used in narrow lanes that are 10 feet wide.

The preferred width of the segments (202) is 22 inches. The length (204) of each segment can vary from 12 inches to 36 inches. The preferred length (204) is equal to the length of the Ferromagnetic effect type sensor being used in combination with the Eddy Currents effect sensor for the Smart Loop Treadle. The preferred method of installation is at a depth of 3 to 6 inches below the roadway (205). The preferred number of wire wound turnings (200) is five (5). The preferred loop windings are 14-gauge multi-stranded copper wire (206). The geometry and size of the rectangular segments are designed to optimize the Eddy Currents from the wheel assemblies and minimize the Eddy Currents from the chassis of the vehicles when they pass over the sensor.

Figure 2A:
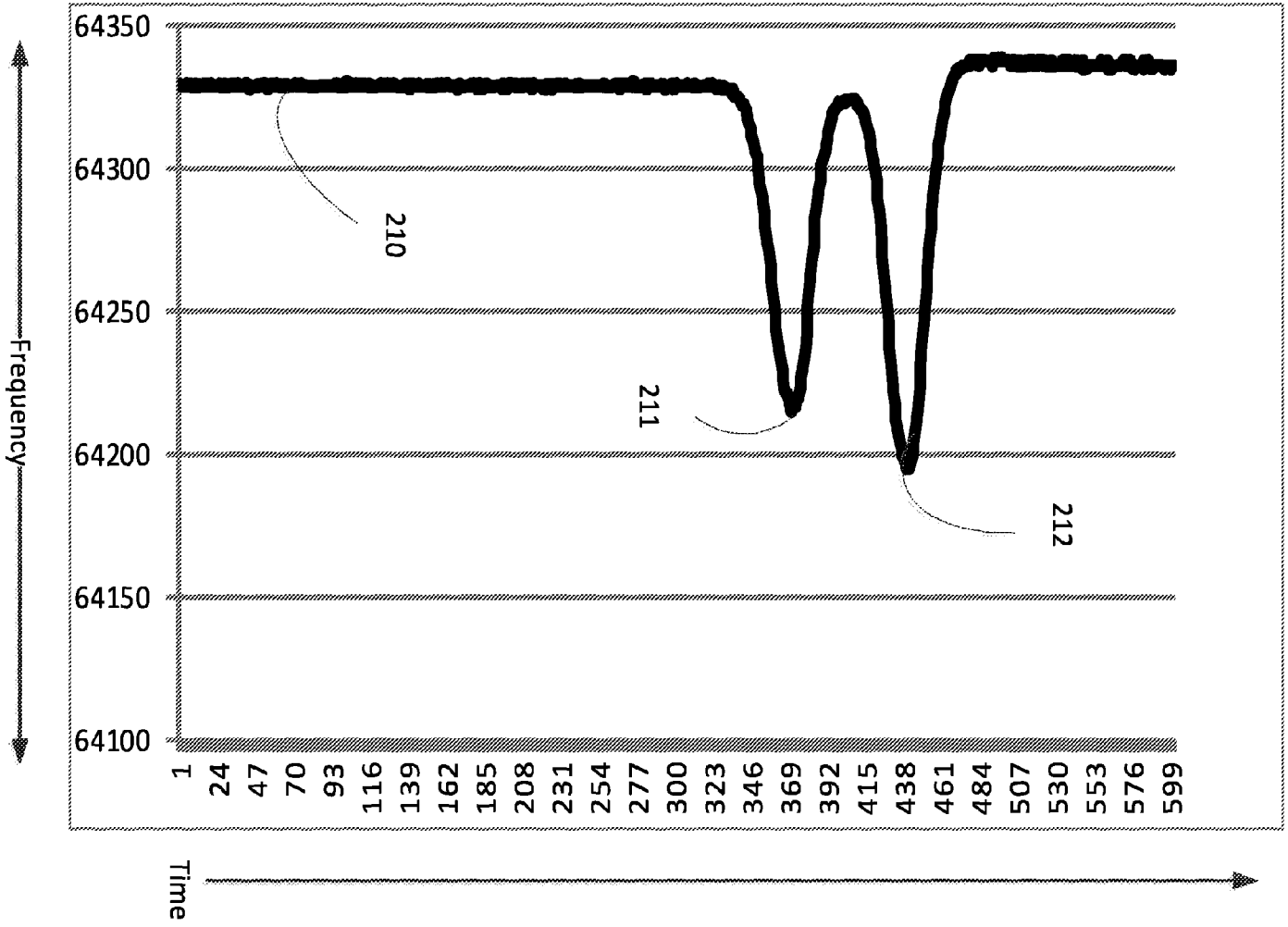
FIG. 2A is a graph showing an eddy current sensor with equal segments' signature of motorcycle with polyester reinforced tires. The signature from the Eddy Current sensor has a decrease in the frequency when the motorcycle passes over the sensor. The two decreases in the frequency are from the eddy currents that are created when the front and rear wheel travel over the sensor.

FIG. 2A illustrates the detection signature using the above Eddy Current Sensor with 6 rectangular segments (22 inches wide by 24 inches long), and five wire turnings. The signature is from a Motorcycle have polyester reinforced tires. The signature of the loop (210) has two sharp decreases in the frequency from the front wheel (211) and from the rear wheel (212).

Figure 2B:
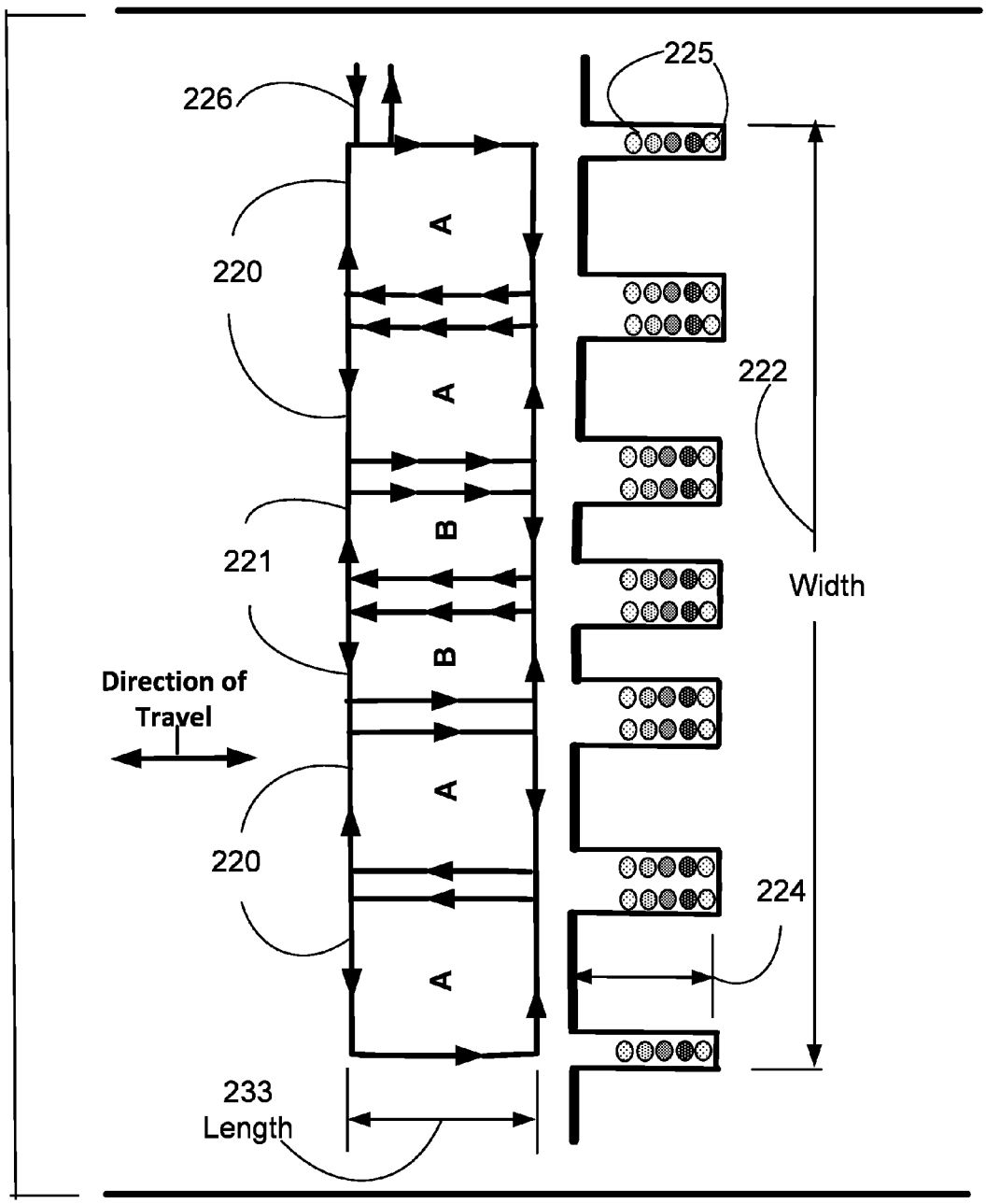
FIG. 2B is a diagrammatic view of an eddy current sensor with unequal segments four (4) (22W×16L) and two (2) (15W×16L) with five (5) windings. The drawing illustrates an Eddy Current Loop having a total of six (6) rectangular segments that are unequal in widths and the sum of the segments creates a sensor 9 feet 10 inches wide by 16 inches long. This sensor length can be used in a lane 11 feet wide. This sensor width can be adjusted to provide for the detection of the full width of lane by using segments that have different lengths.

The second Eddy Current sensor design has rectangular segments that are unequal in size FIG. 2B. Toll plazas and divided highways can have a variety of lane widths. They can range in width from narrow lanes only 8 feet wide to lanes designed for extra wide loads that are 16 feet wide. The second Eddy Current sensor design can be used for this Toll plaza application and secondary roadways for planning applications. This design contains a combination of rectangular segments (details 220 and 221) having different widths. The use of different segment widths provides adjustment in the sensors overall width (222). This allows the sensor overall width to be adjusted to provide full detection coverage of the lane. The length of the sensor (223) can be adjusted for the application. The preferred method of installation is at a depth of 3 to 6 inches below the roadway surface (224). This Eddy current sensor example has five (5) wire turnings (225).

This design can be adjusted to fit different lane width by changing the number of segments and the width of the segments. The number of wire turning can be changed to change the field strength of the loop segments. The number of turning changes the inductance and sensitivity of the loop circuit.

FIG. 2B the Eddy Currents Effect sensor has a combination of four (4) large rectangular segments (220) and two smaller rectangular segments (221). This sensor has four (4) 22 inches wide by 16 inches long rectangular segments (220) and two (2) segments 15 inches wide by 16 inches long (221). The number of these segments can be reduced to reduce the overall width for narrow lanes or can be increased for wider lanes.

The length of the sensors (223) can also be increased to increase the sample length. The number of wire wound turnings (225) can be increased or decreased to adjust the sensor inductance. The FIG. 2B illustrates four (4) wire turnings (225). The loop windings are made using 14 gauge multi-stranded copper wires (226).

Figure 2C:
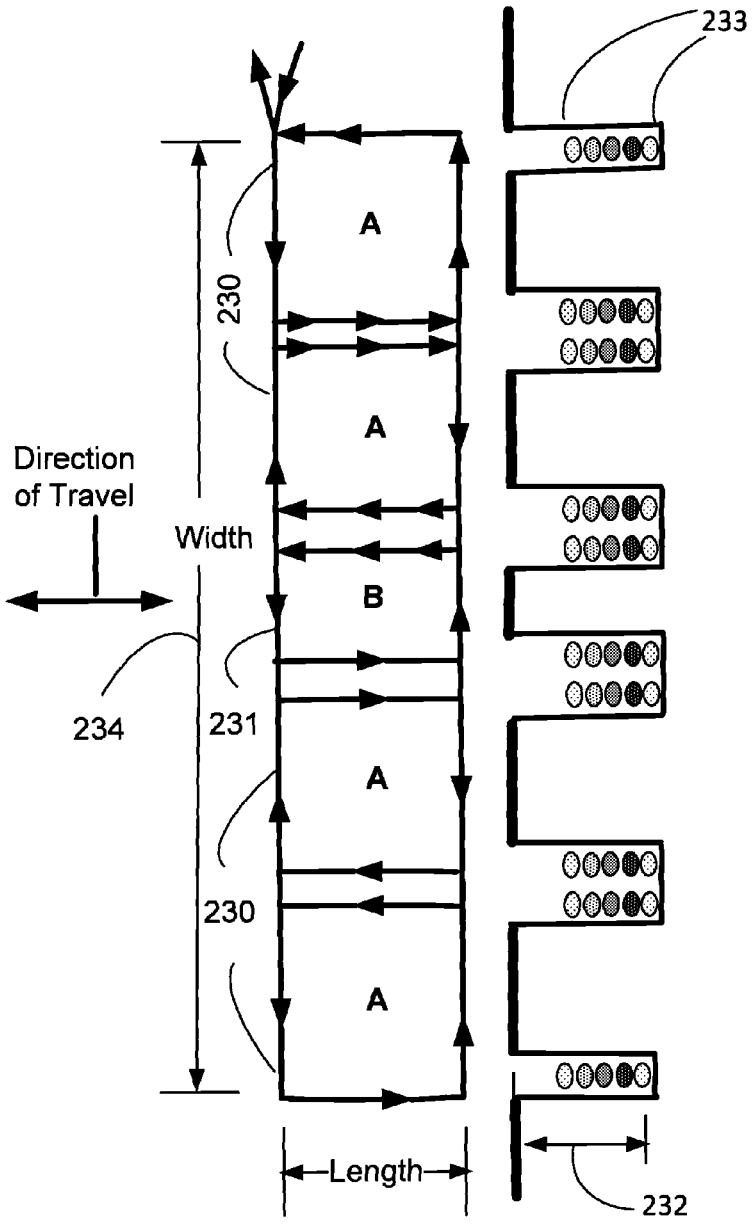
FIG. 2C is a diagrammatic view of an eddy current with segments that have unequal widths the sum of the segments width is 9 feet wide and this sensor can be used for lanes 10 feet wide. The drawing illustrates an eddy current loop having a total of five rectangular segments that are unequal. This sensor width can be adjusted to provide detection the full width of lane by using segments that have different lengths. This sensor is designed to provide full coverage in a travel lane ten (10) feet wide.

FIG. 2C is an example of an Eddy Current sensor with unequal segments that is designed for a lane 11 feet wide. This Eddy Currents Effect sensor has a combination of four (4) large rectangular segments (230) and one smaller rectangular segment (231). The sensor has four (4) 22 inches wide by 16 inches long rectangular segments (230) and one (1) segments 20 inches wide by 16 inches long (231). The preferred method of installation is at a depth of 3 to 6 inches (232) below the roadway. This preferred number of wire turnings for this sensor is (233) is five (5). This sensor is 10 feet wide (234).

Figure 2D:
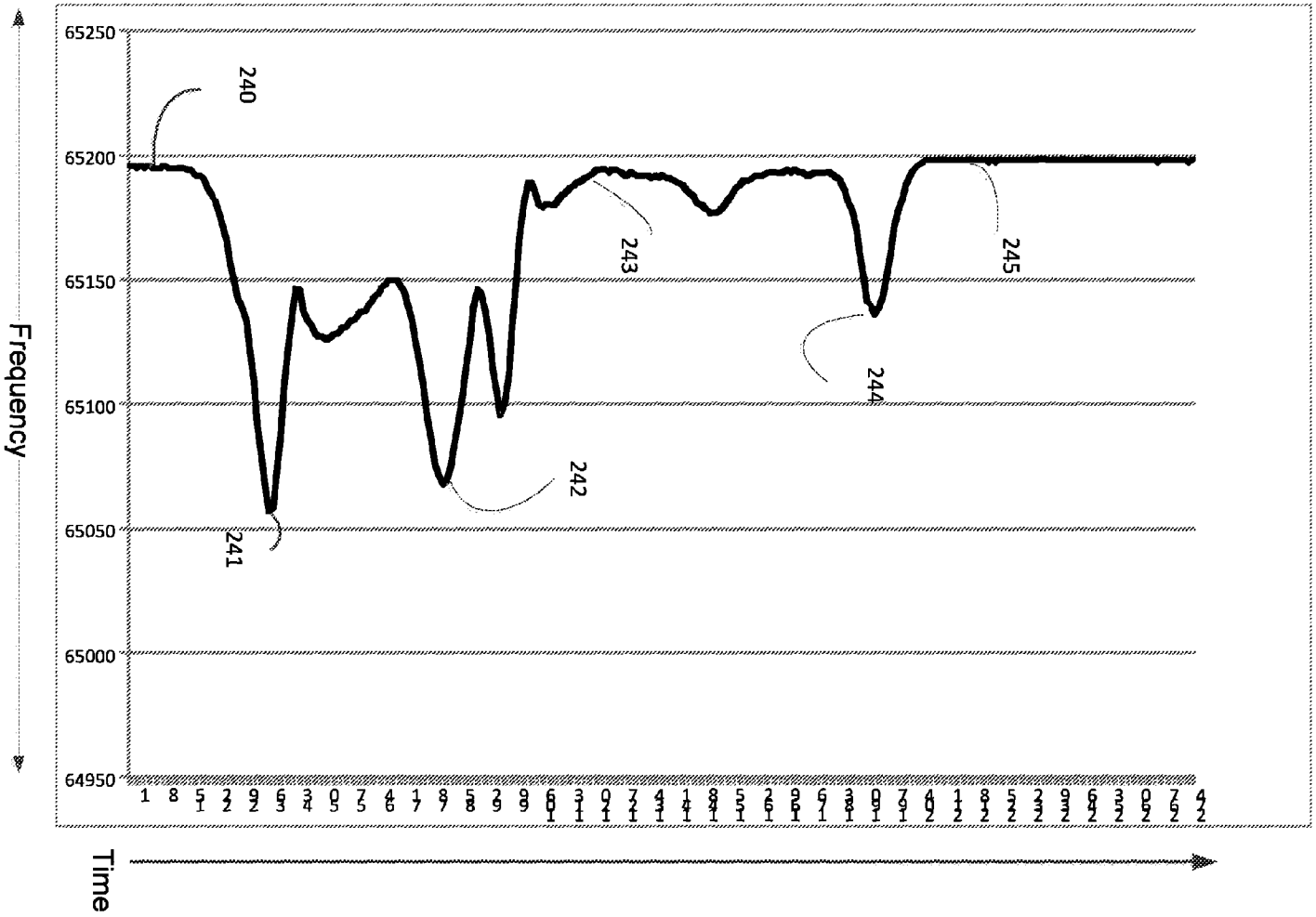
FIG. 2D is a diagrammatic view of an eddy current sensor's signature of a pick-up truck with 1 axle trailer. The signature from the Eddy Current sensor has a decrease in the frequency when the Pick-up truck towing a trailer with one axle. The Eddy current sensor detects the pick-up truck has steel belted tires and the trailer wheel assemblies has a non-steel belted tires.

FIG. 2D is an illustration of a Test sample signature using the Eddy Currents sensor (240) with unequal segments as described in FIG. 2C. The start of the vehicle and the front wheel (241) caused a decrease in frequency and the rear wheel (242) caused a decrease in frequency. The sensor returned to its resident frequency (243) at the end of the pickup truck. The trailer axle was detected (244) and the sensor returned to the resident frequency baseline at the end of the trailer (245).

Figure 2E:
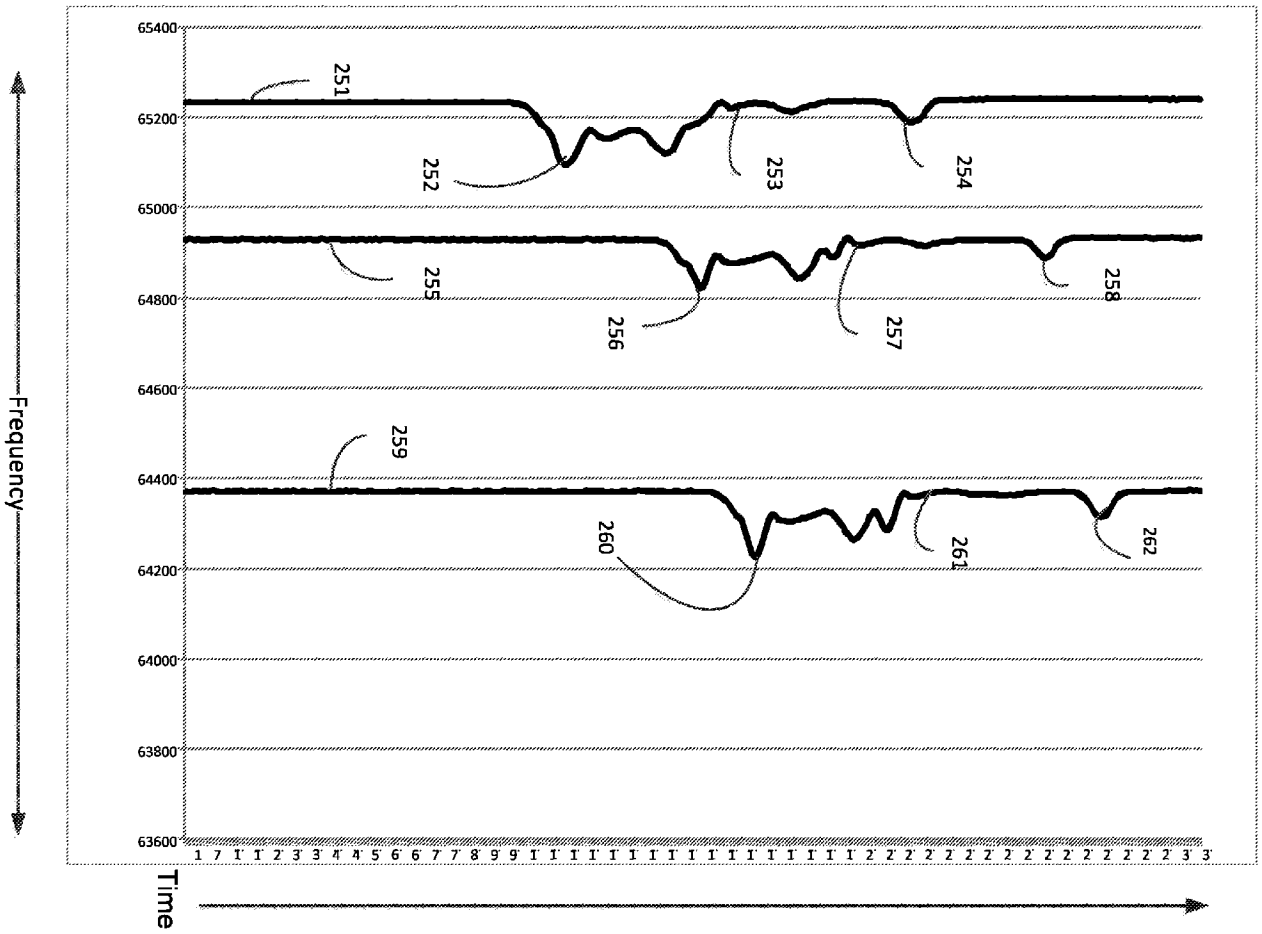
FIG. 2E is a diagrammatic view of Eddy Current Sensors Signatures from three different Eddy Current Sensors with Unequal Size Segments. This illustrates the signatures from three different Eddy Current sensors sizes. All the signatures are from the same vehicle.

In FIG. 2E the following Eddy Current Sensors have segments that are equal. The width and length of the segments in the three sensors are different. They were compared since they have different inductance and different resident frequencies.

Eddy Current sensor (251) with segments that are equal with seven (7) segments 18 inches wide by 30 inches long having 4 wire Turnings.

Eddy Current sensor (255) with segments that are equal with seven (7) segments 18 inches wide by 18 inches long having 4 wire Turnings.

Eddy Current sensor (259) with segments that are equal with seven (7) segments 22 inches wide by 18 inches long having 4 wire Turnings.

Three Eddy Current Effect sensors were compared in FIG. 2E. The vehicle sample is an SUV towing a single axle utility trailer. The sensor (251) is constructed using 7 segments that were 18 inches wide by 30 inches long having 4 wire turnings and had a base frequency of 65,234 Hertz. The start of the SUV front wheels were detected at (252) frequency decreased to 65,094 Hertz. The end of the SUV and start of the trailer was detected at (253) and the frequency was 65,232 Hertz. The non-steel belted trailer wheel was detected at (254) and the frequency decreased to 65,191 Hertz.

The sensor (255) is constructed using 7 segments that were 18 inches wide by 18 inches long having 4 wire turnings and had a base frequency of 64,930 Hertz. The start of the SUV was detected at (256) and the frequency decreased to 64,822 Hertz. The end of the SUV and start of the trailer was detected at (257) and the frequency was 64,933 Hertz.

The non-steel belted trailer wheel was detected at (258) and the frequency decreased to 64,888 Hertz.

The sensor (259) is constructed using 7 segments that were 22 inches wide by 18 inches long having 4 wire turnings and had a base frequency of 64,371 Hertz. The start of the SUV was detected at (260) and the frequency decreased to 64,225 Hertz. The end of the SUV and start of the trailer was detected at (261) and the frequency was 64,368 Hertz. The non-steel belted trailer wheel was detected at (262) and the frequency decreased to 64,316 Hertz.

Figure 2F:
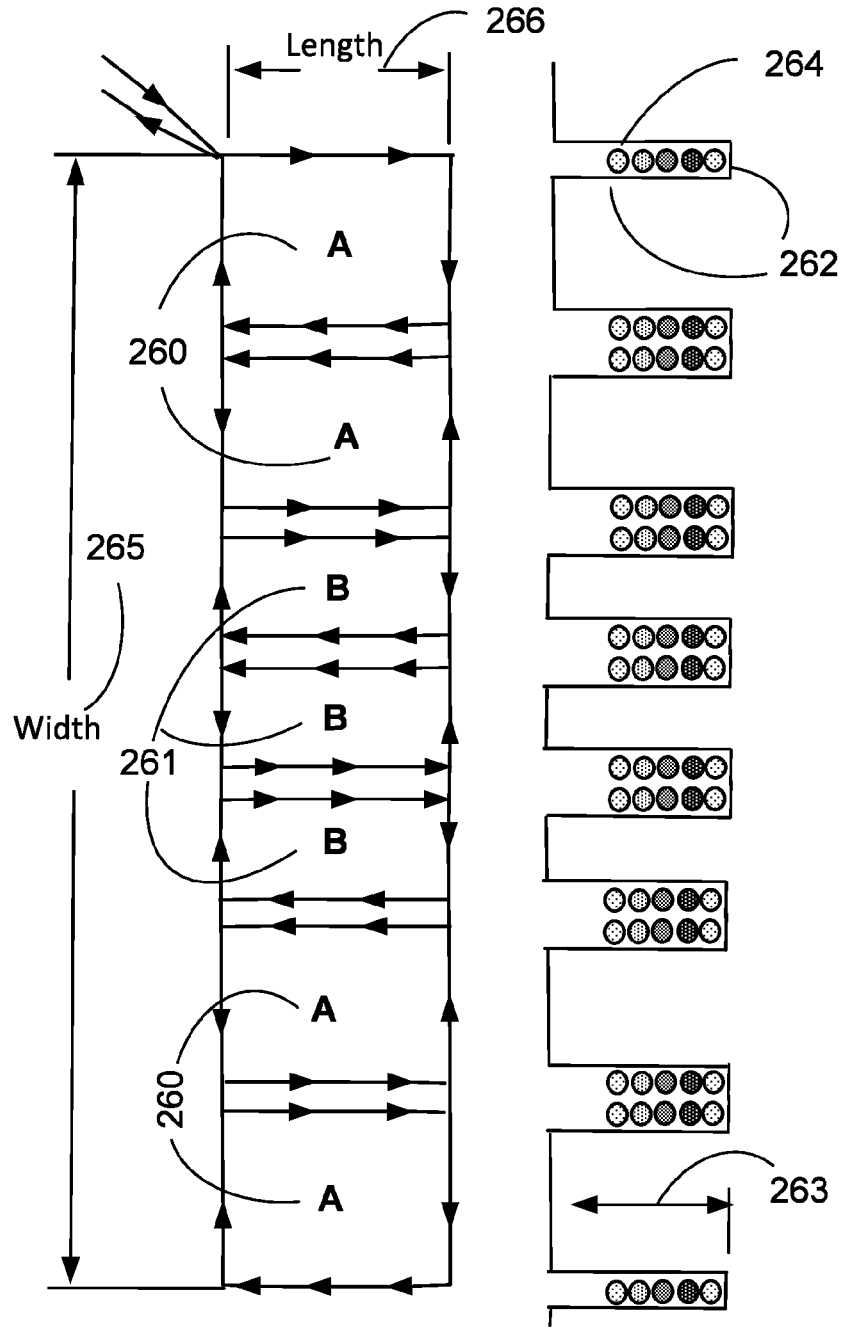
FIG. 2F is a diagrammatic view of Eddy Current Sensor with Unequal Segments four (4)(22W×16L) and three (3)(15W×16L) with five (5) Windings. This sensor is designed for a lane that is 12 feet wide. The sensor has an overall width of 11 feet and 1 inch. The sensor has a length of 16 inches.

The FIG. 2F is an illustration of an Eddy current sensor with unequal segments. This sensor has seven (7) segments consisting of four (4) segments 22"W by 16" L (260) and three (3) segments 15"W by 16"L (261). This sensor has five wire turnings (262). The sensor is installed below the surface of the roadway (263) at a nominal depth of 3 to 6 inches. The wire is 14 gauge multi-stranded copper (264). This sensor has an overall width of 11 feet and 1 inch (265) and can be used in a lane 12 feet wide. This sensor has an overall length of 16 inches (266) and this length could be increased to a length of 30 inches as in the previous signature example (FIG. 2E, detail 251).

Figure 2G:
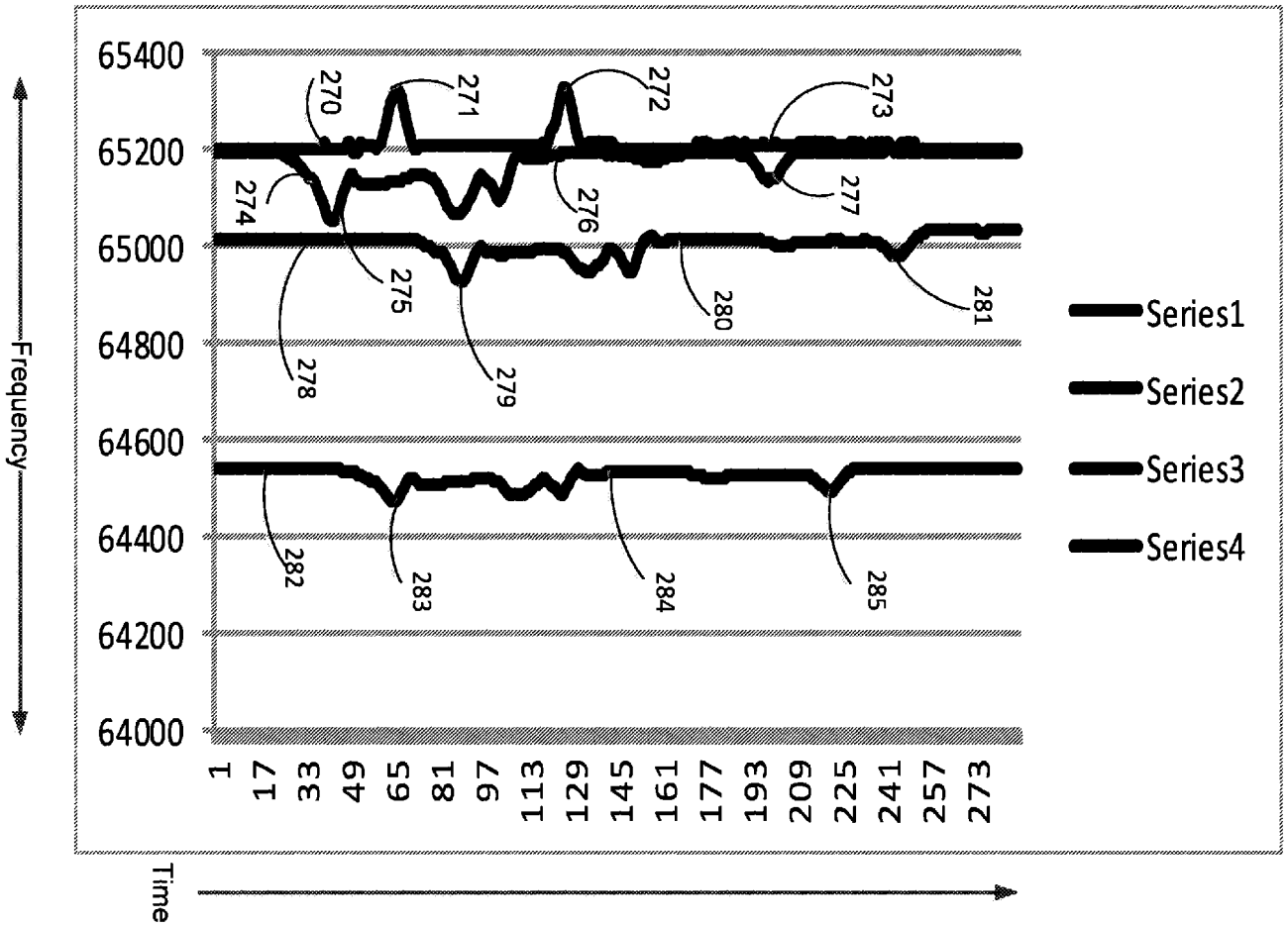
FIG. 2G is a diagrammatic view of eddy current sensors with unequal segments and ferromagnetic sensor. This illustration includes a comparison of a vehicle signature from a Ferromagnetic Sensor and the signatures from three Eddy Current sensors when the same vehicle passes over all four sensors. The Eddy Current sensors frequencies decrease during the detection and the Ferromagnetic sensor frequency increase during the detection.

The FIG. 2G illustrates a signature of a SUV towing a single axle trailer. The tires on the SUV are steel belted reinforced and the trailer tires are non-steel belted. All four signatures are from this same vehicle and it illustrates the Ferromagnetic Sensor increases in frequency when the vehicle passes over the sensor and the Eddy Current sensor decreases in frequency when the vehicle passes over the sensor. The Ferromagnetic Effect tire sensor (270) has a base frequency. The frequency of the sensor increases when the front tire of the SUV passes over the sensor increasing the frequency to 65,322 Hertz (271). This Ferromagnetic sensor was the 2-4-4-2 design. The rear axle of the SUV passes over the Ferromagnetic Effect sensor increasing the sensor frequency (272). The SUV was towing a trailer. The trailer tires were non-steel belted and were not detected in area (273) by the Ferromagnetic sensor.

The Eddy Currents sensor (274) has a base frequency. The start of the SUV (275) was detected and the frequency decreased. The end of the SUV (276) and start of the trailer was detected. The non-steel belted trailer wheel was detected (277) and the frequency decreased. This Eddy Current sensor contained six segments 22" Wide by 16" Long with 5 turnings.

The Eddy Currents sensor detail 278 has a base frequency and is constructed of four (4) segments 22" Wide by 16" Long and three (3) segments 15" Wide by 16" Long as described in FIG. 2A. The start of the SUV (279) was detected and the frequency decreased. The end of the SUV (280) and start of the trailer was detected. The non-steel belted trailer wheel (281) was detected and the frequency decreased.

The Eddy Currents sensor (282) has a base frequency and is constructed of four (4) segments 22" Wide by 12" Long and three (3) segments 15" Wide by 12" Long as described in FIG. 2A. The start of the SUV (283) was detected and the frequency decreased. The end of the SUV (284) and start of the trailer was detected. The non-steel belted trailer wheel (285) was detected and the frequency decreased.

Figure 2H:
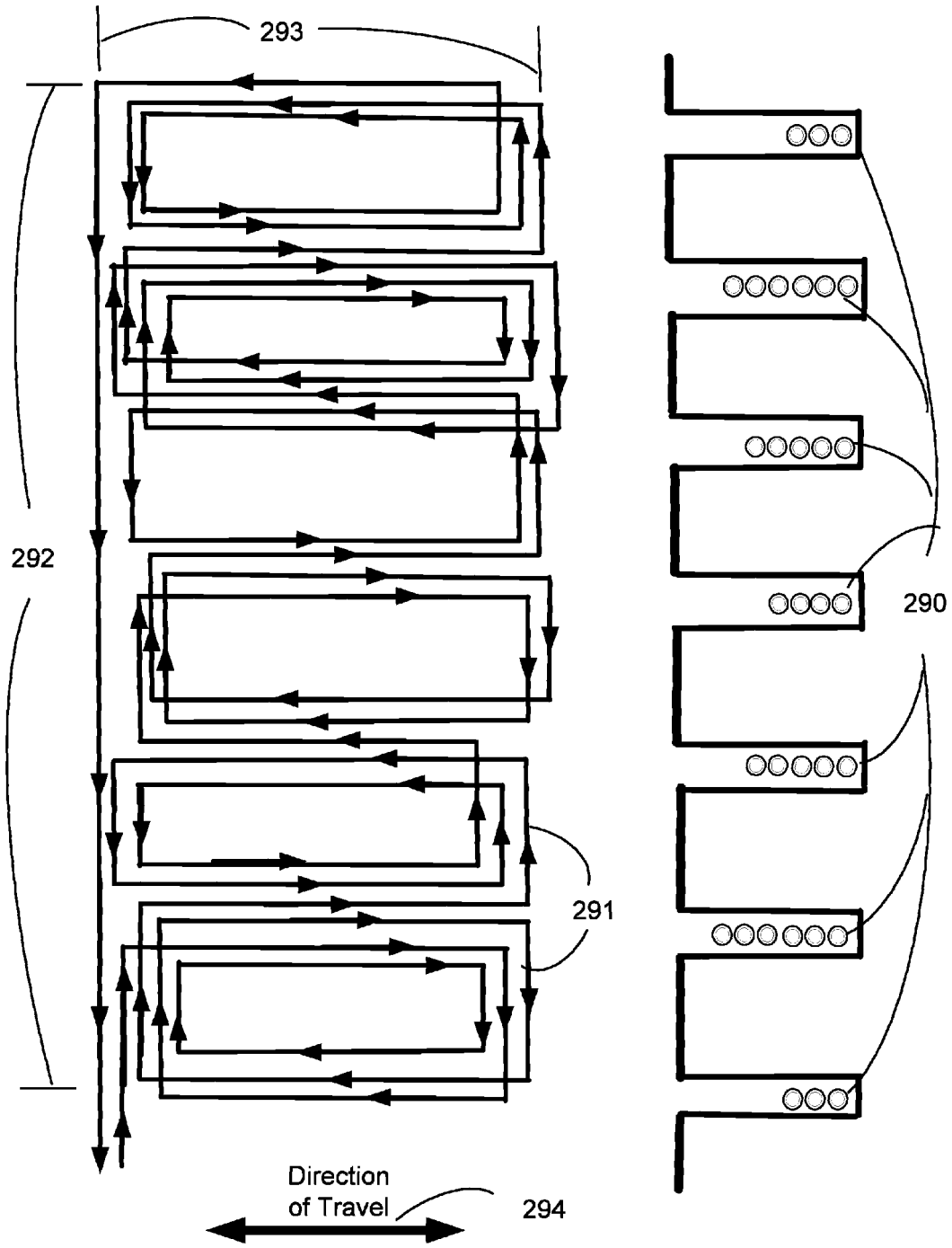
FIG. 2H is a diagrammatic view of eddy current sensor with unequal wire turnings. This illustrates the windings that are formed using counter clockwise and counter clockwise turnings. The rectangular segments are equal in size. The number of wire turnings are forming the rectangular segments is unequal.

In FIG. 2H illustrates an Eddy current sensor having a different the number of turnings that include the range of 3-6-5-4-5-6-3 (290). This is an alternate winding for the Eddy current sensor that forms rectangular loop circuits in a series. This is in contrast to the original Prior Art bicycle loop that used a serpentine winding. When the sensor is formed using a serpentine wrapping the number of turns increases are uniform for all the rectangles. This Eddy current sensor windings alternate from clockwise turnings to counter clockwise turnings (291) forming a series of rectangular loops circuits. The width of each rectangle is equal in size (292). The lengths of the rectangles are all equal (293). The advantage of this wire winding design is it permits the number of turnings of each rectangle to be increased without adding turnings to the whole sensor. This is illustrated in the cross section (290).

This winding design allows for the strongest field to occur in both wheel paths in the lane of the roadway. Typical range for trailers axles is from 5 feet to 9 end to end and this sensor design provides the fields to be strength in these areas. The overall width (292) of the sensor is 11 feet and the length can be adjusted to provide full lane coverage. The length of the sensor is 2 feet (293). The direction of travel is parallel to the strongest field (294).

Figure 3:
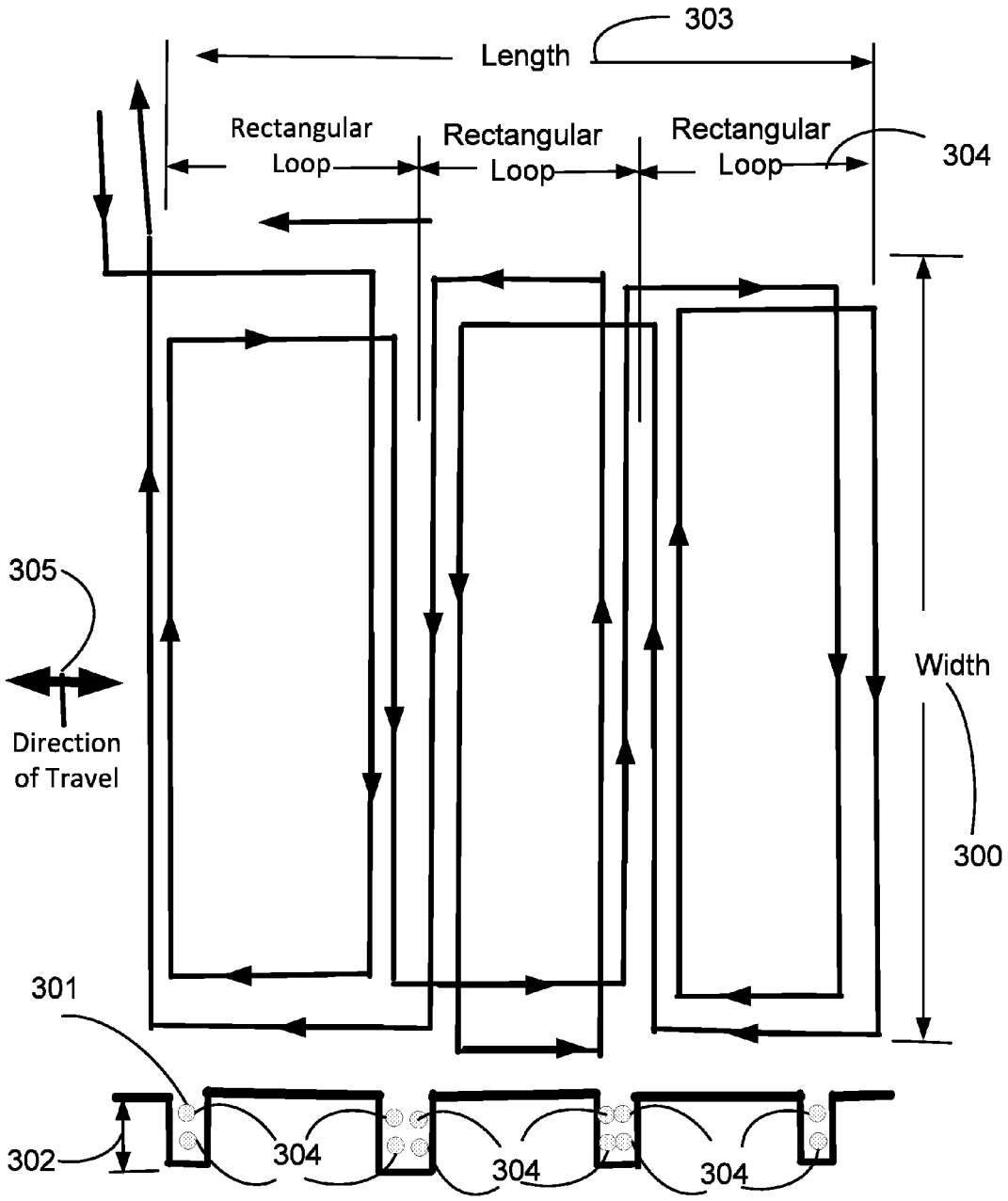
FIG. 3 is a diagrammatic view of ferromagnetic sensor 2-4-4-2 windings. This drawing illustrates the three rectangular loops of the Ferromagnetic sensor. The plan views of the sensors wire turnings are alternated from clockwise direction to a counter clockwise direction. The sensor is typically 11 feet wide by 12 inches long. The plan views of the sensors wire turnings are alternated from clockwise direction to a counter clockwise direction.

Ferromagnetic Sensor There are three sensor designs that optimize the Ferromagnetic effect sensor these designs that have unique wire turnings. These three designs can have the width increased or decreased to provide detection across the full width of the lane. FIG. 3 illustrates a Ferromagnetic Sensor designated as a 2-4-4-2 configuration (2 turns-4 turns-4 turns-2 turns). The sensor is installed in the travel lane and can vary in width from 8 ft. to 16 ft. wide (300). The sensor is designed to have both left and right wheels of a vehicle pass over the tire assembly sensor. The wire turnings are installed on or near the surface of the roadway using 14-gauge multi-strand copper wires (301) for the turnings. The typical depth (302) of the installation is 2 inches below the road surface.

These three designs can have the length of the sensor increased or decreased from leading edge to trailing edge to increase or decrease the length of the vehicle tire assembly signature. These sensors can also have the number of windings increased to adjust the inductance of the sensor this aids in balancing the inductance of the sensor with the length of the lead-in cable. The width of the sensor is measured perpendicular to the direction of travel (300). The length of the sensor is measured parallel to the direction of vehicle travel (303).

The important functions for these designs are their response to the ferromagnetic effect from the tire assemblies and their minimum influenced by the eddy currents from the vehicle chassis.

The present invention first sensor design can have a series of rectangular loops that can be longer than the diameter of the wheel assembly being detector. FIG. 3 contains three rectangular loops. The sensor is designed to be extended into a series connected circuit arrangement of multiple uniform rectangular loop segments (304). Increasing the number of rectangular segments will directly increase the length in time of the sample size when a vehicle wheel assembly passes over the sensor in the direction of travel (305). This increase in the number of rectangular loops in the series does not change the field height of the sensor. This is a very important design function since the sensors field height is optimized to detect wheel assemblies and not the chassis of vehicles.

Figure 3A:
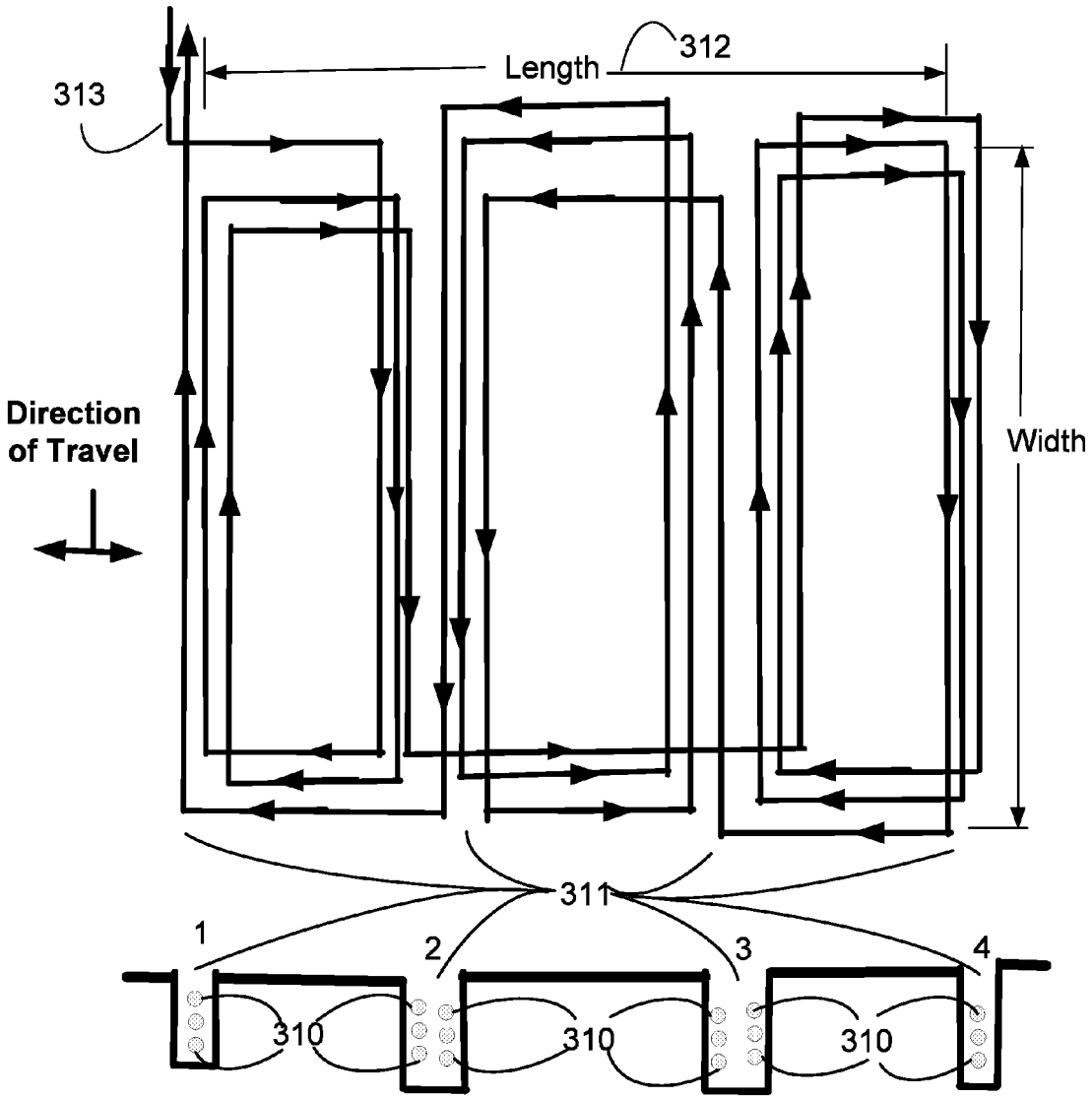
FIG. 3A is a diagrammatic view of ferromagnetic sensor 3-6-6-3 windings. This drawing illustrates the three rectangular loops of the Ferromagnetic sensor has three wire turnings. The plan views of the sensors wire turnings are alternated from clockwise direction to a counter clockwise direction. The sensor is typically 11 feet wide by 12 inches long.
Figure 3B:
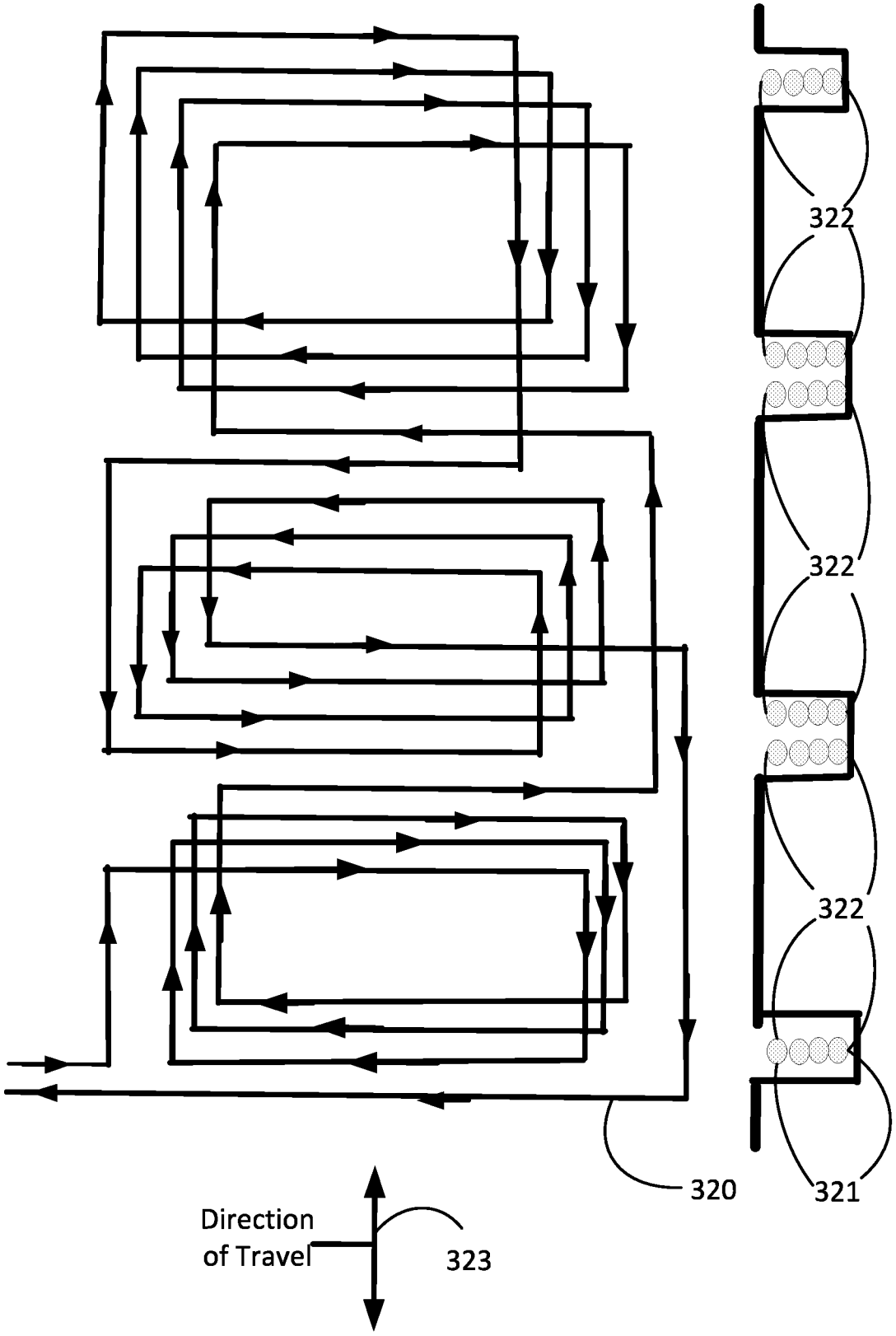
FIG. 3B is a diagrammatic view of ferromagnetic sensor 4-8-8-4 windings. This drawing illustrates the three rectangular loops of the Ferromagnetic sensor has four wire turnings. The plan views of the sensors wire turnings are alternated from clockwise direction to a counter clockwise direction. The sensor is typically 11 feet wide by 12 inches long. The plan views of the sensors wire turnings are alternated from clockwise direction to a counter clockwise direction.

The FIG. 3 illustrates the wheel sensor that contains multiple rectangular loops connected in series (304). This example has the designation of (2-4-4-2) and consists of three rectangular loops connected in series as a single circuit. The rectangular loops alternate the windings from clockwise to counter clockwise or from counter clockwise to clockwise depending on the layout requirements of the lead-in installation in the travel lane. Each of the rectangular loops are 11 ft. wide (300) having a nominal length of four (4) inches long (303). The size of each rectangular loop can vary in length from 3 to 6 inches but are all segments are uniform in length. This loop can have additional wire windings/turnings in example the (3-6-6-3) has three rectangular loops that are illustrated in (FIG. 3A detail 310) each loop has three (3) turnings. The series of the three loops provide four flux thresholds (311). The FIG. 3B (320) illustrates the Ferromagnetic sensor 4-8-8-4 windings having four (4) wire turns (321) in a series in a single circuit having three rectangular loops (322). The direction of travel for the vehicles is perpendicular to the primary flux fields of the sensor (323).

Figure 3C:
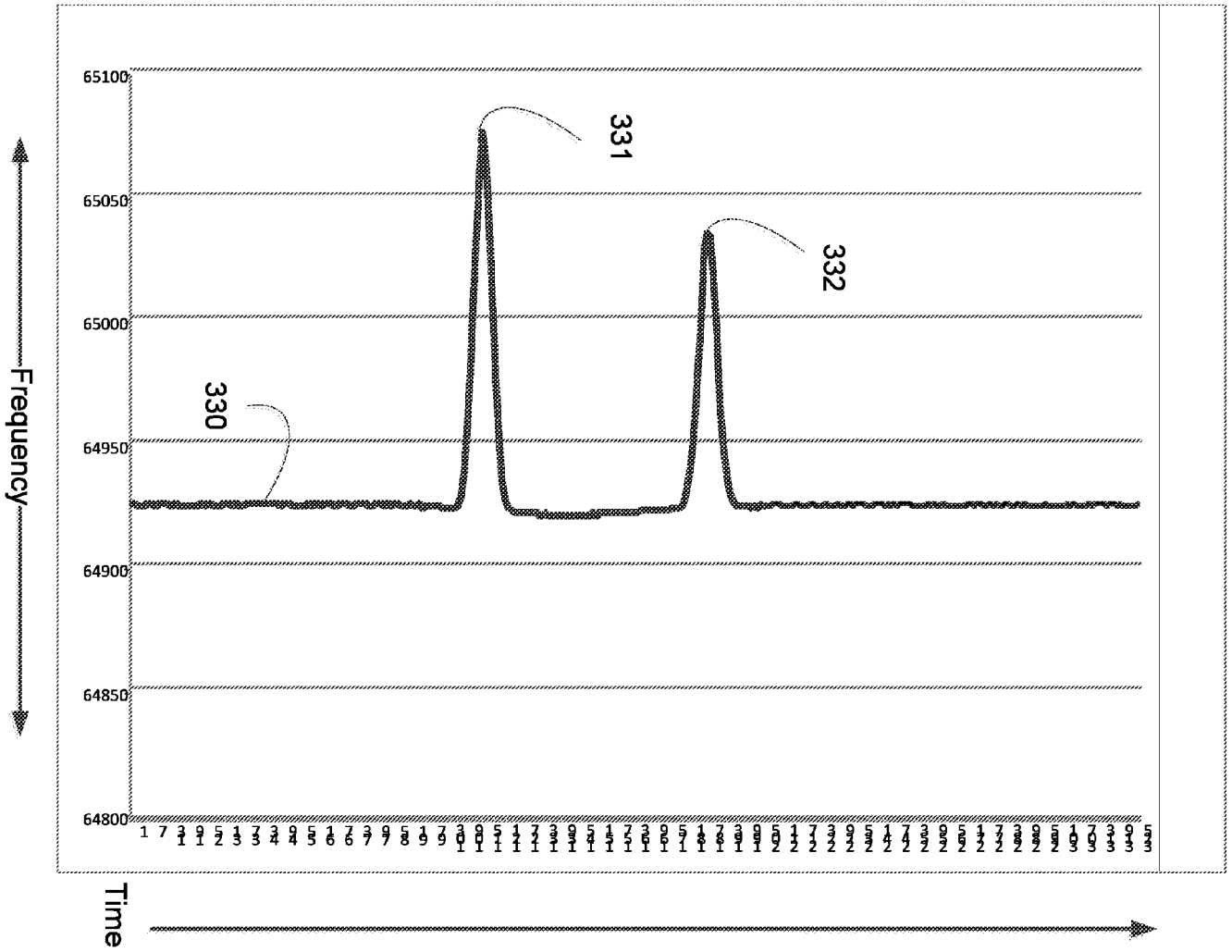
FIG. 3C is a diagrammatic view of the signature from a pickup truck traveling over a ferromagnetic sensor with 2-4-4-2 windings. The frequency of a Ferromagnetic Sensor increases when the vehicle wheels pass over. The sensor is typically 11 feet wide by 12 inches long.
Figure 3D:
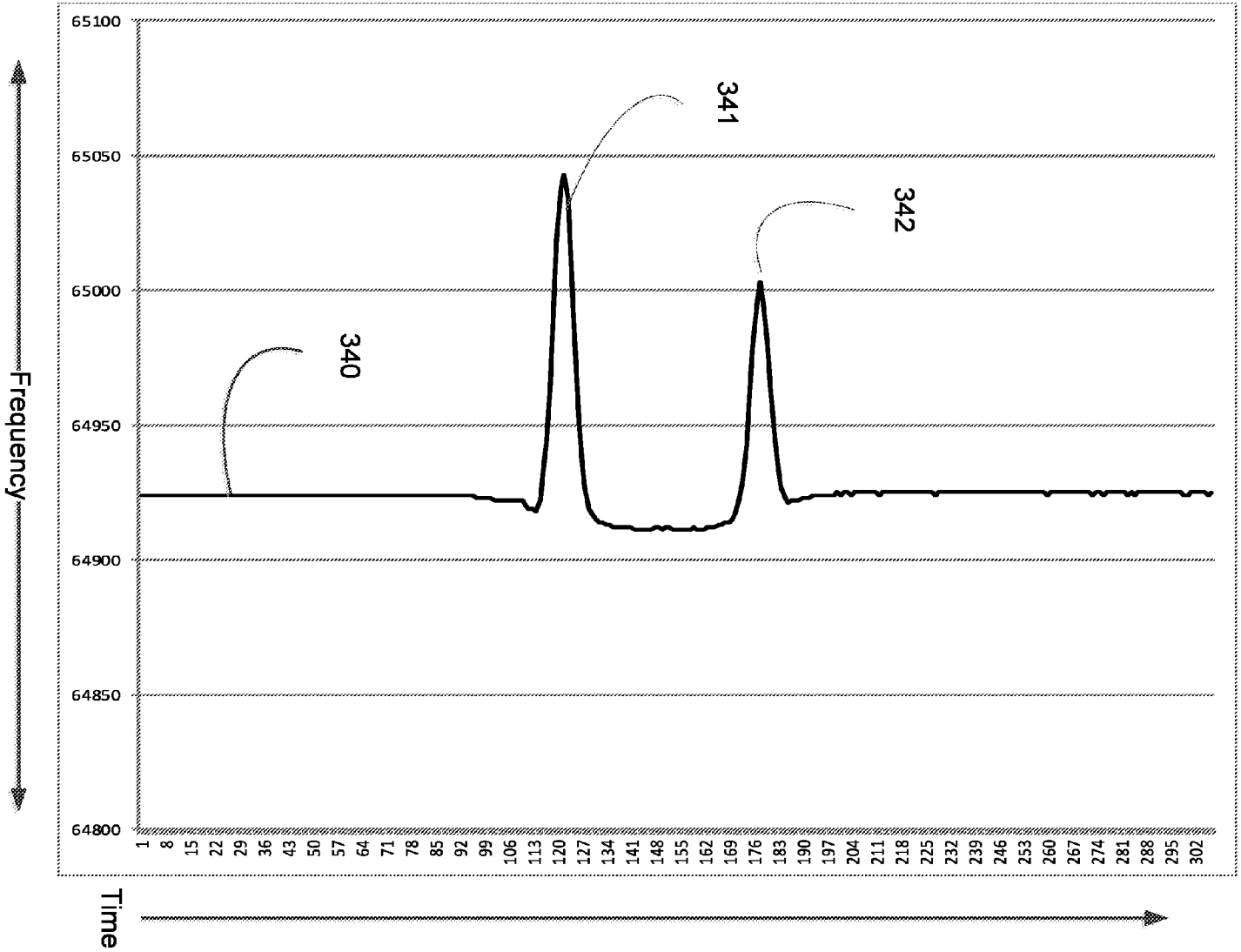
FIG. 3D is a diagrammatic view of a signature of SUV from ferromagnetic 3-6-6-3. The frequency of a Ferromagnetic Sensor increases when the vehicle wheels pass over. The sensor is typically 11 feet wide by 12 inches long.

The preferred size of the 3-6-6-3 (FIG. 3A) in a travel lane that is 13 feet wide has a width (311) of 12 feet and overall length (312) of 12 to 13 inches. The windings for the three rectangular loops are clockwise—counter clockwise—clockwise and are all equal (313). FIG. 3C illustrates a vehicle signature from a pickup truck using the 2-4-4-2 Ferromagnetic sensor (330). The front wheel (331) and rear wheel (332) assemblies cause an increase in the frequency of the sensors when the vehicle travels over the sensor. FIG. 3D illustrates a vehicle signature traveling over the 3-6-6-3 Ferromagnetic sensor (340). The front wheel (341) and rear wheel (342) assemblies cause an increase in the frequency of the sensors when the vehicle travels over the sensor.

Figure 3E:
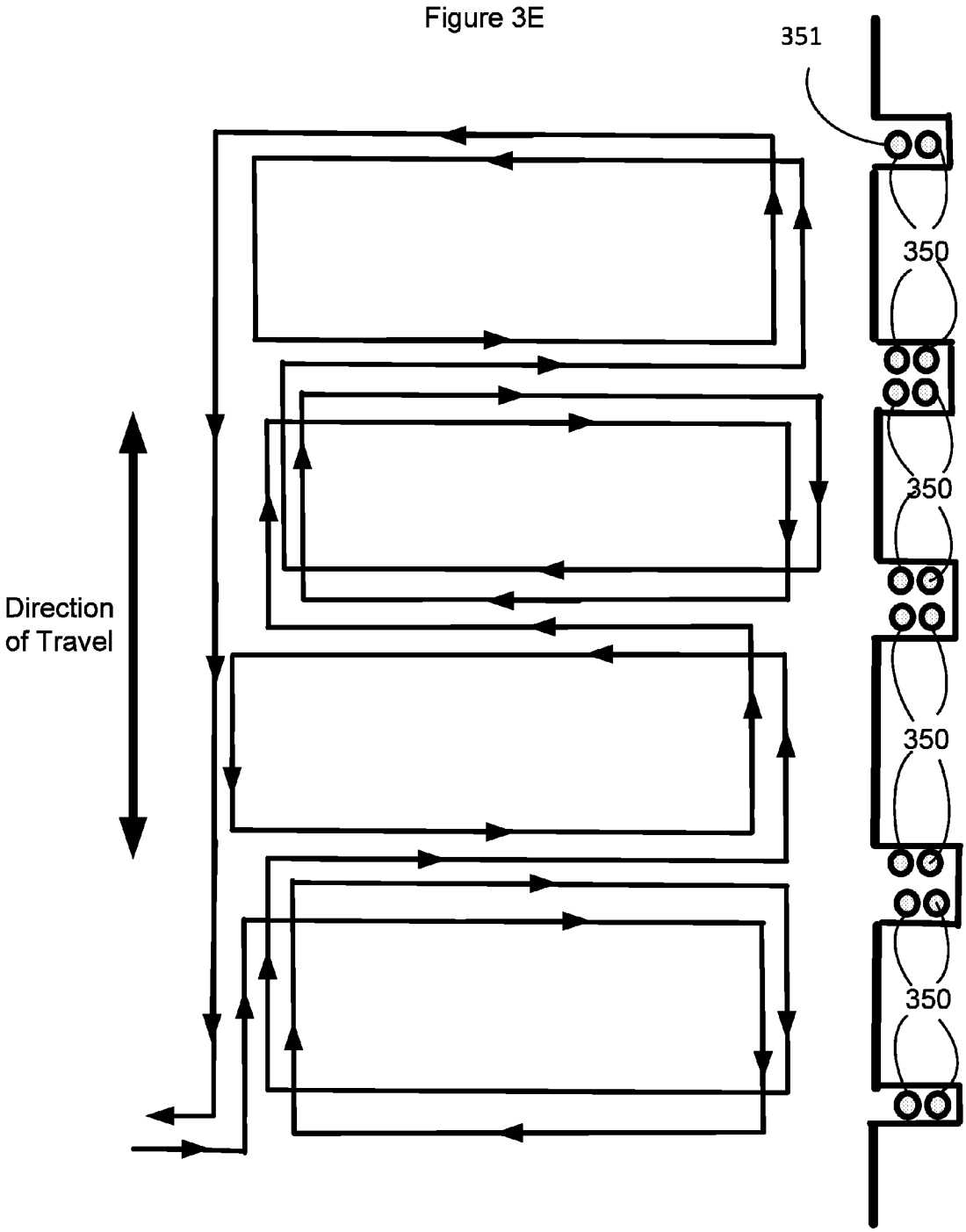
FIG. 3E is a diagrammatic view of ferromagnetic sensor 2-4-4-4-2 windings. This drawing illustrates the four rectangular loops of the Ferromagnetic sensor. The sensor is typically 11 feet wide by 16 inches long. The plan views of the sensors wire turnings are alternated from clockwise direction to a counter clockwise direction.
Figure 3F:
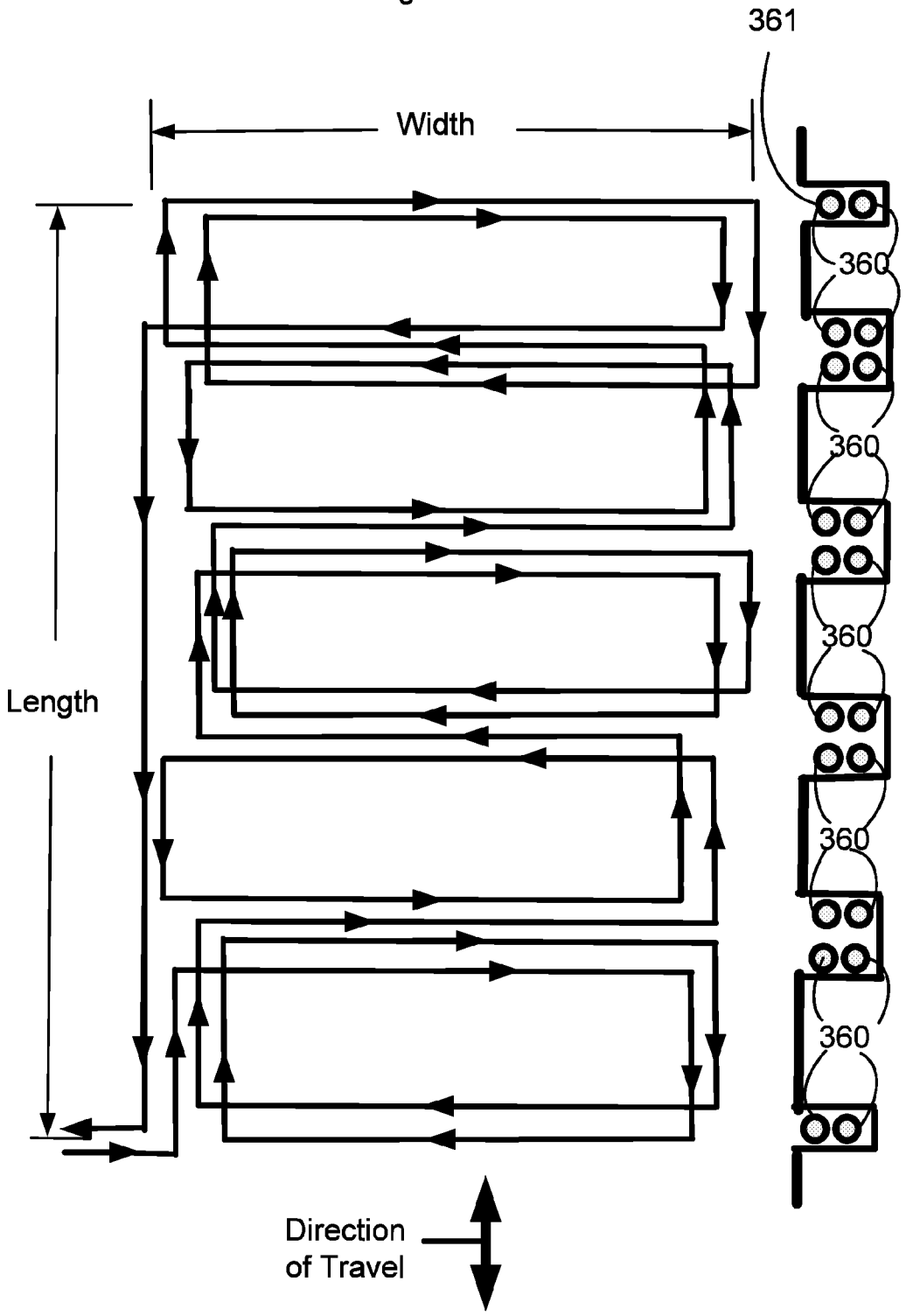
FIG. 3F is a diagrammatic view of ferromagnetic sensor 2-4-4-4-4-2 windings. This drawing illustrates the five rectangular loops of the Ferromagnetic sensor. The sensor is typically 11 feet wide by 20 inches long. The plan views of the sensors wire turnings are alternated from clockwise direction to a counter clockwise direction.
Figure 3G:
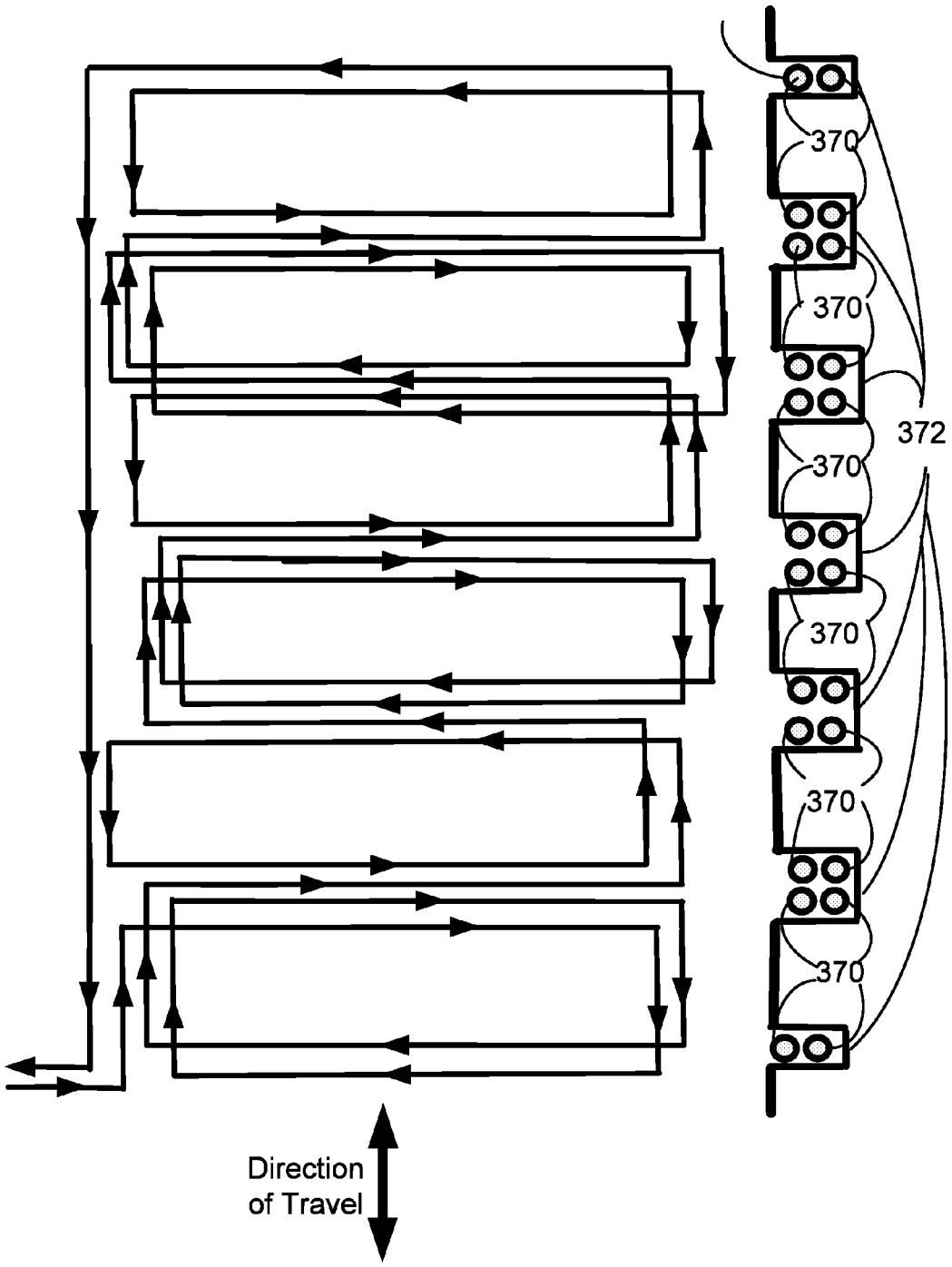
FIG. 3G is a diagrammatic view of ferromagnetic sensor 2-4-4-4-4-4-2 windings. This drawing illustrates the six rectangular loops of the Ferromagnetic sensor. The sensor is typically 11 feet wide by 24 inches long. The plan views of the sensors wire turnings are alternated from clockwise direction to a counter clockwise direction.

FIG. 3E illustrates an example of four rectangular loops (350) in a series in a single circuit. The plan views of the sensors wire turnings are alternated from clockwise direction to a counter clockwise direction. These loops have the following design designations (351) Ferromagnetic 2-4-4-4-2. FIG. 3F illustrates an example of five rectangular loops (360). These loops have the following design designations (361) Ferromagnetic 2-4-4-4-4-2. FIG. 3G illustrates an example of six rectangular loops (370). These loops have the following design designations (371) Ferromagnetic 2-4-4-4-4-4-2. The number of flux field thresholds (372) increases with the length of the sensor. This design optimizes the ferromagnetic effect to detect the attributes of wheel assemblies.

Each flux field is low and minimizes the influence by eddy currents from the vehicles chassis when the length of the sensor is increased.

Figure 3H:
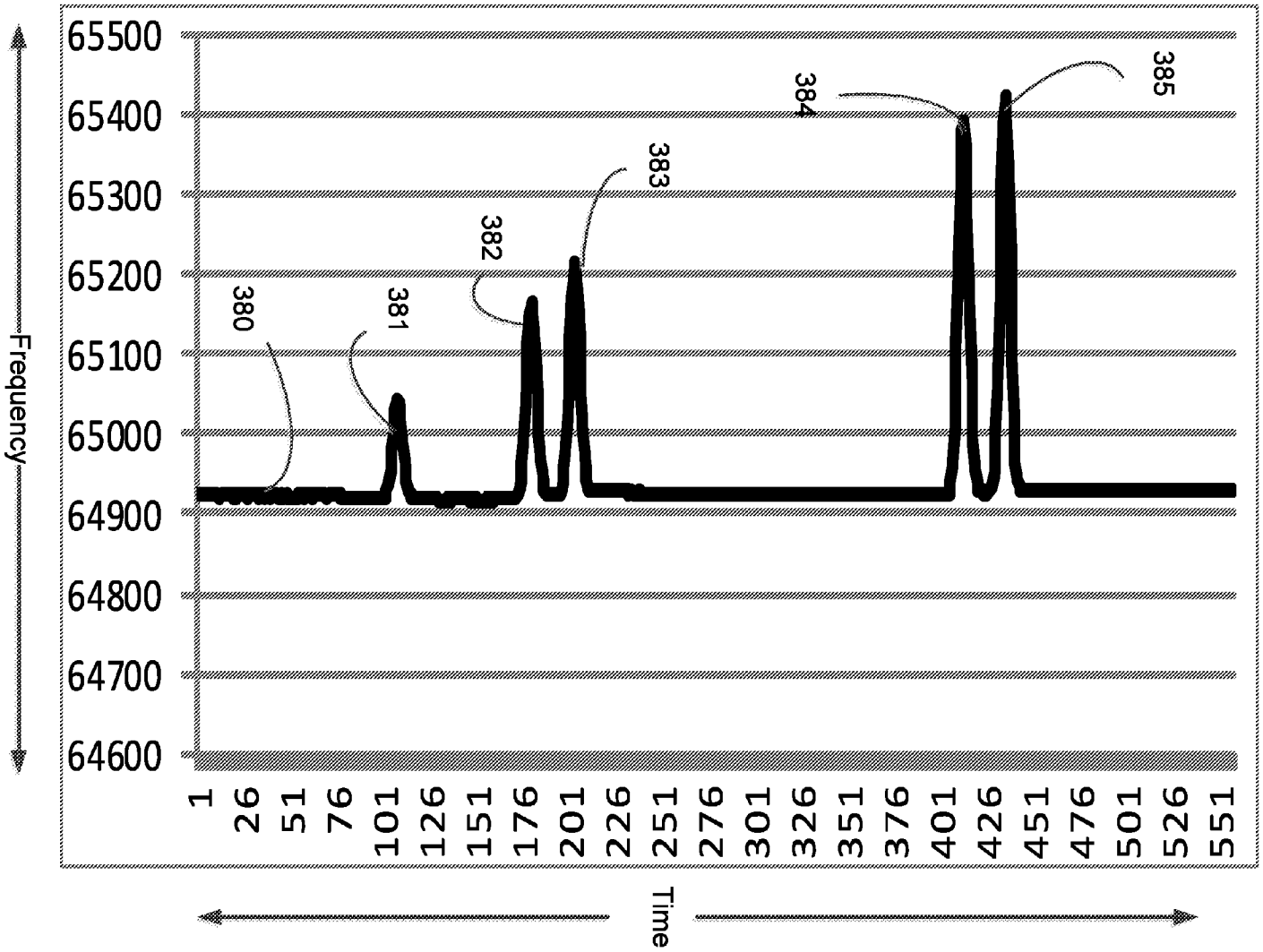
FIG. 3H is a diagrammatic view of signature of a five axle truck from a 2-4-4-4-4-4-2 ferromagnetic sensor. The frequency of a Ferromagnetic Sensor increases when the vehicle wheels pass over. The sensor is typically 11 feet wide by 24 inches long.

FIG. 3H illustrates a signature from a five axle truck the is traveling over a Ferromagnetic Sensor 2-4-4-4-4-4-2 (380) the front wheels cause an increase in the frequency and a peak (381) is present in the signature. The second set of wheels cause an increase in frequency and a peak (382) is present in the signature. The third set of wheel assemblies cause an increase in frequency and a peak (383) is present in the signature. The fourth set of wheel assemblies cause an increase in frequency and a peak (384) is present in the signature. The fifth set of wheel assemblies cause an increase in frequency and a peak (385) is present in the signature.

Figure 3I:
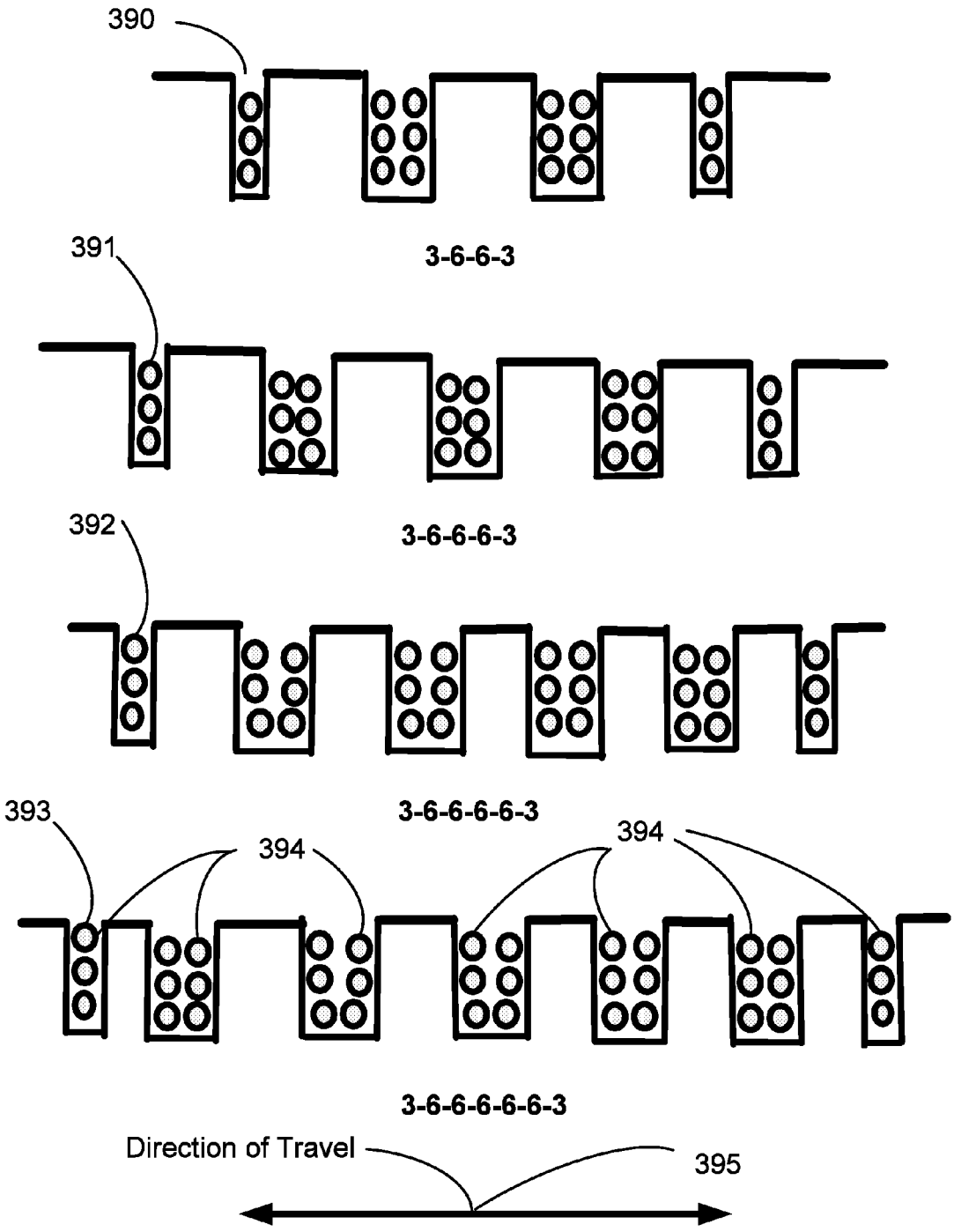
FIG. 3I is a diagrammatic view of cross section of wheel assembly sensors used in multi-lane tolling application using a (3-6-6-3), (3-6-6-6-3), (3-6-6-6-6-3), and (3-6-6-6-6-6-3). This drawing illustrates the Ferromagnetic sensor having three wire turnings. The cross sectional views of the sensors wire turnings illustrate the increasing of the number of rectangular sections having alternating windings from clockwise direction to the counter clockwise direction. The sensor width can be increased or decreased to provide full detection for the width of the lane. The length of the sensor can be increased from (3-6-6-3) that is 12 inches long to (3-6-6-6-6-6-3) that is 30 inches long. The increase in the sensor lengths increases the sensor sample length.

This ferromagnetic sensor design using a series of rectangular loops that allows for the increase or decrease of wire turnings in order to increase or decrease the inductance of the sensor as required. The FIG. 3I illustrates the above ferromagnetic sensors with additional wire turnings. The same pattern alternating pattern of clockwise and counter clockwise of wire turning for the rectangular series of loops is used. These loops have the following design designations Ferromagnetic sensor 3-6-6-3 (390), Ferromagnetic sensor 3-6-6-6-3 (391), Ferromagnetic sensor 3-6-6-6-6-3 (392), and Ferromagnetic sensor 3-6-6-6-6-6-3 (393). The number of flux field thresholds (394) increases with the length of the sensor. The vehicles direction of travel over the sensors is indicated as (395).

Figure 3J:
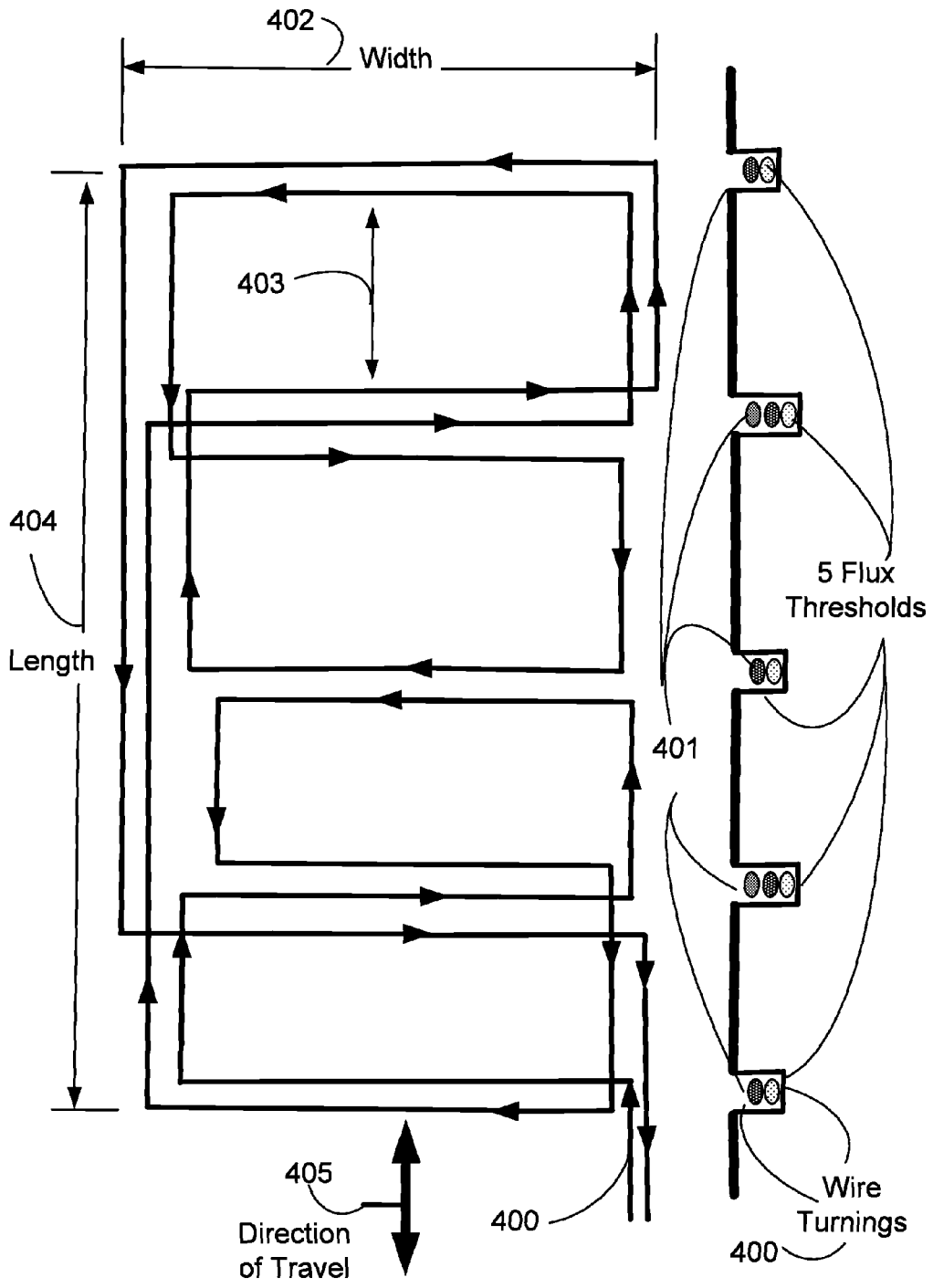
FIG. 3J is a diagrammatic view of Ferromagnetic Sensor 2-3-2-3-2 Windings. This drawing illustrates an alternate design for the Ferromagnetic sensor windings. This different winding pattern produces a different flux field and ratio in the windings. The drawing to provides the pattern for the windings and a cross section of the wire turnings having the designation (2-3-2-3-2) and a length of 16 inches.

The second design has a unique winding FIG. 3J illustrates an alternate design that uses a different winding method (400) to provide a cross section of the wire turnings (401) having the designation (2-3-2-3-2). The wire turnings are installed on or near the surface of the roadway using 14-gauge multi-stranded copper wire. This sensor is a single circuit consisting of rectangular loops. The width (402) of the loop can be increased or decreased to provide detection across the lane perpendicular to the direction of travel. Each of the rectangular segments (403) has a nominal length of 4 inches and all the segments are the same size resulting in a nominal length (404) of 16 inches. The size of each rectangular loop can vary in length from 3 to 6 inches but are all segments are uniform in length. These sensors are installed on or near the surface of the roadway. In FIG. 3J (405) indicates the direction of travel for vehicles passing over the sensor.

Figure 3K:
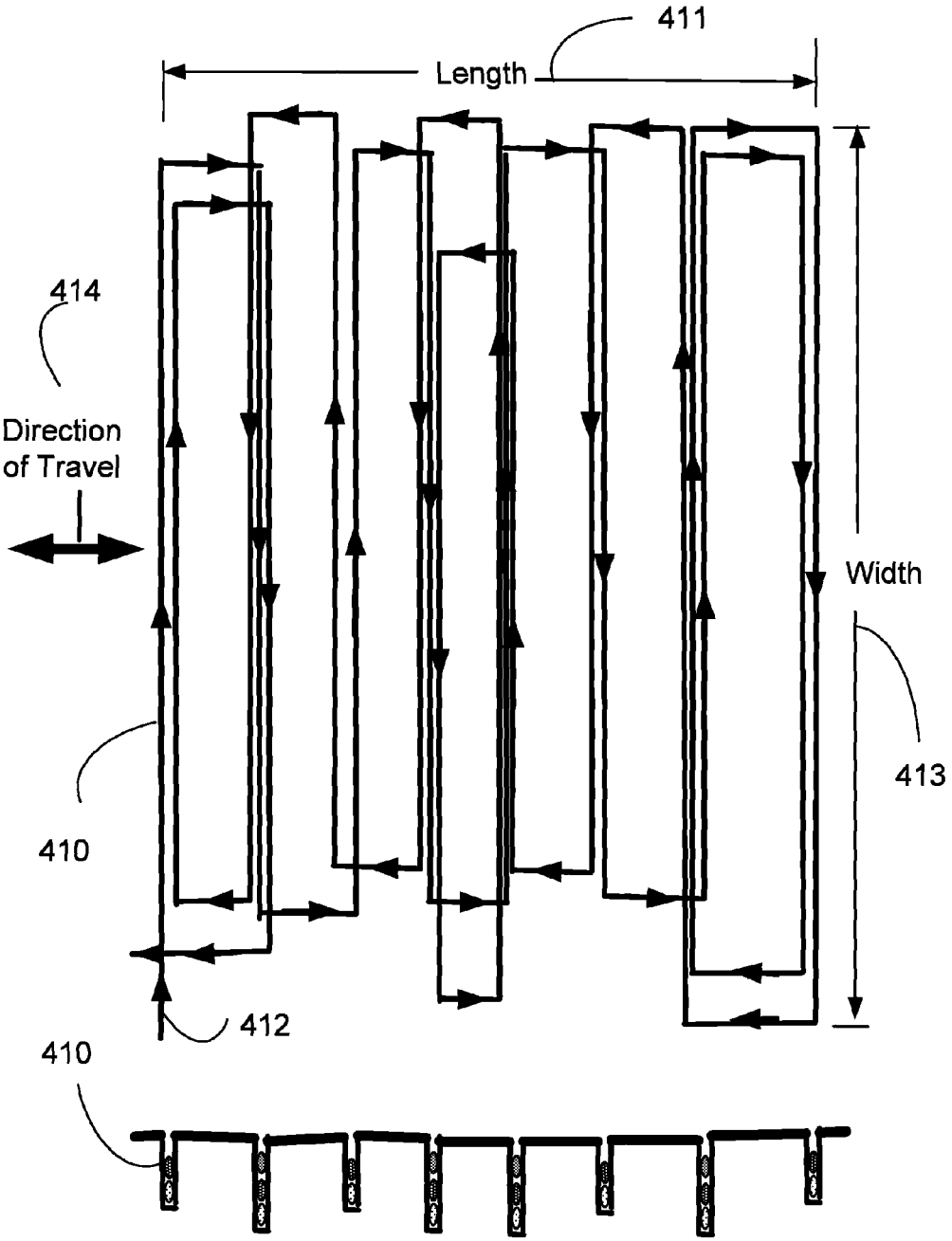
FIG. 3K is a diagrammatic view of ferromagnetic sensor 2-3-2-3-3-2-3-2 windings. This drawing illustrates the Ferromagnetic sensor windings. This winding pattern produces a sensor that is 28 inches long. The drawing provides the pattern for the windings and a cross section of the wire turning having the designation (2-3-2-3-3-2-3-2).

The Ferromagnetic sensor (2-3-2-3-2) can be doubled in length using a single circuit. The doubled sensor results in a Ferromagnetic sensor (2-3-2-3-2-2-3-2-3-2) this double length sensor is illustrated in FIG. 3K (410) and has a nominal length (411) of 36 inches. This doubles the sample length when compared to the Ferromagnetic sensor (2-3-2-3-2) however the sensor cannot be increased by individual segments because of the alternating windings pattern (412). The increase number of samples is beneficial as the vehicle speeds increase. The increase in the number of rectangles does not degrade the optimization of the Ferromagnetic effect. The width of the sensor (413) can be increased or decreased to provide detection across the lane perpendicular to the direction of travel (414).

Figure 3L:
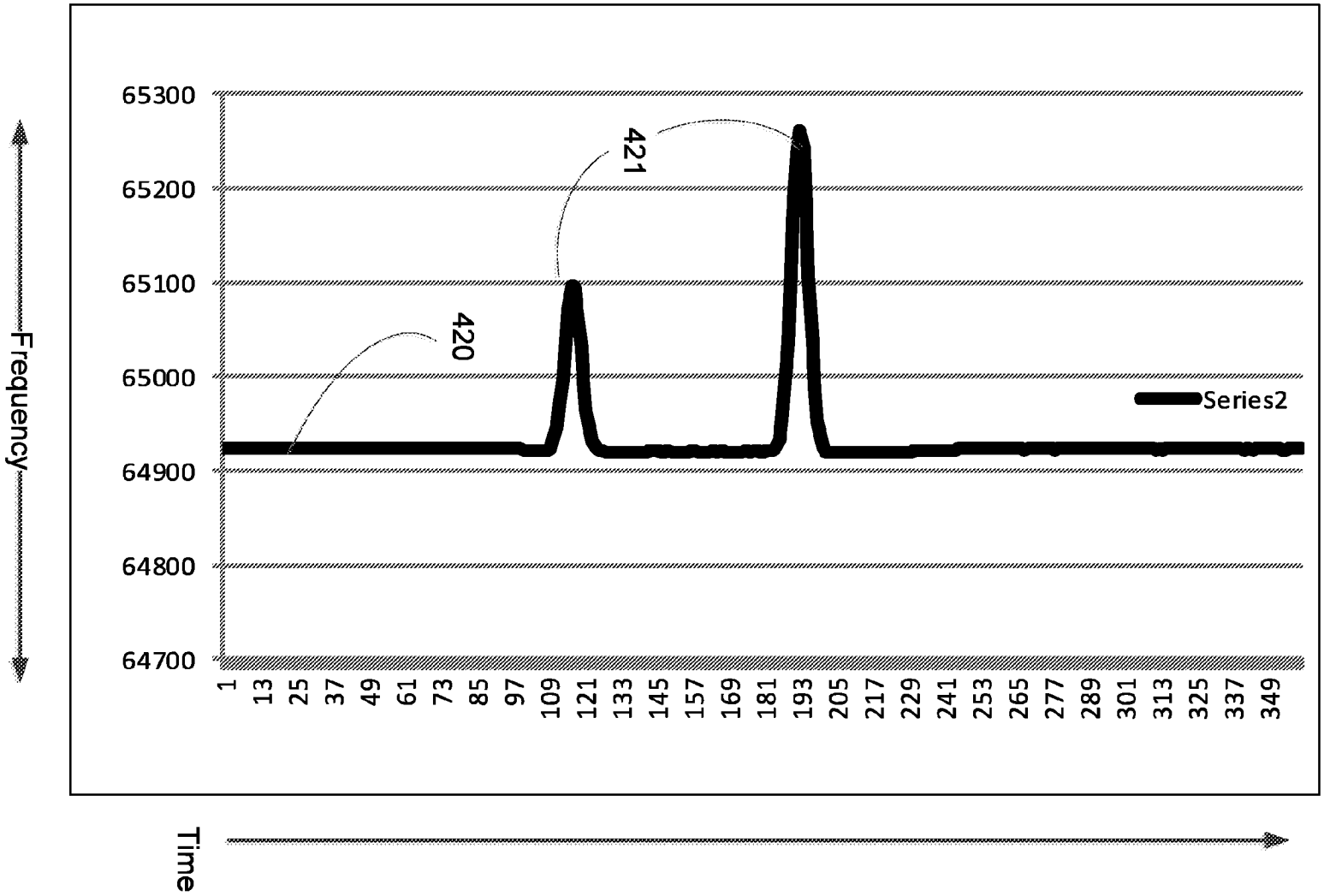
FIG. 3L is a diagrammatic view of signature from a two axle truck with dual tires on an axle passing over a ferromagnetic sensor. is a diagrammatic view of 2-3-2-3-2. This is an illustration of a vehicle signature from a SUV traveling over a Ferromagnetic sensor 2-3-2-3-2 having one winding.

FIG. 3L illustrates a signature from a Ferromagnetic Sensor 2-3-2-3-2 (420) from a two axle truck. The frequency increases when the front and rear wheels pass over the sensor (421). The rear axle (422) has dual tires and this is reflected in the larger change in frequency.

Lane Position Sensor

The Lane Position sensor has two loop circuits each loop circuit has a single wire rectangular loop having from 2 to 6 wire turnings. In FIGS. 4 and 4A each of the loops are 6 ft. wide by 6 ft. long. The two loop circuits are identical is size and can be adjusted in size to provide full coverage in one lane. FIG. 4 illustrates the Lane Position sensor having the loop circuits partially overlapping and providing detection across the entire width of the lane (430). The placement of the first loop circuit (431) is biased to the left of the travel lane. The second loop circuit is biased to the right side of the lane (432). The placement of these loops provides the logic for the vehicle signatures to determine the position of the vehicle as it travels in the lane.

The Lane Position sensor design provides two signatures from the same vehicle that is traveling in the lane. The two signatures are used to determine the vehicle path of travel in the lane. FIG. 4 illustrates the Lane Position sensor. The present invention Lane Position sensor has two rectangular loops (433) that are configured in a single lane of travel.

This combination of two loops provides the detection to determine the position of the vehicle in the lane if a vehicle is in the left side of the lane, center of the lane, or right side of the lane. This information is useful in open road tolling applications. The additional information can be used to associate a vehicle lane position with the electronic toll tag reading, and vehicle photo association. This loop configuration is also beneficial for motor cycle detection since they usually travel in the left or right wheel path of the roadway and not the center of the lane. The combinations of the two loops can also detect wide vehicles traveling in a single lane.

The two loops can be installed using a diamond pattern by having the rectangular loops rotated 45 degrees. FIG. 4A illustrates this installation of two loop circuits partially overlapping (440). This Lane Position sensor detects the travel position of the vehicle in the lane. The Lane Position sensor provides detection across the entire width of the lane (441).

FIG. 4B illustrates the two signatures from a SUV traveling on the left side of the lane. These loops respond to the eddy current effect and the frequency of both loops decrease when the vehicle passes over the sensors. The loop on the left side of the lane has a greater decrease in the frequency (450) from the vehicle traveling on the left side of the lane. The loop on the right side of the lane has less frequency change (451).

FIG. 4C illustrates the two signatures from a SUV traveling in the center of the lane. These loops respond to the eddy current effect and the frequency of both loops decrease equally (460) when the vehicle passes over the sensors.

FIG. 4D illustrates the two signatures from a SUV traveling on the right side of the lane. These loops respond to the eddy current effect and the frequency of both sensors decrease when the vehicle passes over the sensors.

The loop on the right has a greater decrease in the frequency (470) from the vehicle traveling on the right side of the lane. The loop on the left side of the lane has a smaller decrease in the frequency (471).

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims

We claim:

1. A lane sensor for detecting the passage of a vehicle over the lane sensor, the lane sensor comprising:

a first, Eddy Current sensor for detecting wheel assemblies having non-steel belted tires;

a second, Ferromagnetic sensor for detecting steel belted tires;

a controller for receiving information from both the first and second sensors to detect the passage of a vehicle over the lane sensor whether the vehicle has steel belted tires or non-steel belted tires.

2. The lane sensor of claim 1, further comprising:

said second, Ferromagnetic sensor and said first, Eddy Current sensor being installed in a roadway, with said second Ferromagnetic sensor being installed on top of said first, Eddy Current sensor.

3. The lane sensor of claim 2, further comprising:

said second, Ferromagnetic sensor and said first, Eddy Current sensor being installed in a single lane of travel of roadway, with said second Ferromagnetic sensor being installed 1-2 inches below a surface of the roadway; and said first, Eddy Current sensor being installed 3-6 inches below the surface of the roadway.

4. The lane sensor of claim 1, wherein said second, Ferromagnetic sensor includes a series of three or more rectangular sensors connected in series.

5. The lane sensor of claim 1, further including a lane position sensor, wherein said lane position sensor includes a left sensor loop and a right sensor loop installed in a lane of travel to determine the position of a vehicle within the lane of travel.

6. The lane sensor of claim 1, wherein each of said first and second sensors detect frequency changes caused by the wheel assemblies with steel belted tires or non-steel belted wheel assembly.

7. The lane sensor of claim 1, including at least two Eddy Current sensors and two Ferromagnetic sensors for detecting a direction of travel of the vehicle over the lane sensor.

8. The lane sensor of claim 7, further including a lane position sensor, wherein said lane position sensor includes a left sensor loop and a right sensor loop installed in a lane of travel to determine the position of a vehicle within the lane of travel.

9. The lane sensor of claim 8, wherein said controller detects from said first and second sensors and from said lane position sensor, the vehicle direction of travel and speed over the lane sensor, the number of axles on the vehicle, the presences of double tire wheel assemblies ("dualie tires"), the vehicle length, the axle spacing, the vehicle travel position in the lane, and a vehicle classification for the vehicle.

10. A method of detecting objects passing over a location, comprising:

providing a first, Eddy Current sensor installed at the location for detecting wheel assemblies having steel belted tires or non-steel belted tires passing over the location;

providing a second, Ferromagnetic sensor for detecting steel belted tires passing over the location;

providing a controller in communication with the first and second sensors, said controller receiving information from both the first and second sensors, and interpreting the information from the first and second sensors to detect the passage of steel belted tires and wheel assemblies having non-steel belted tires over the location.

11. A method of detecting objects passing over a location, comprising:

providing a first, Eddy Current sensor and a second, Ferromagnetic sensor;

providing a controller in communication with the first and second sensors, said controller receiving information from both the first and second sensors;

said first, Eddy Current sensor comprising a wire loop installed at the location for detecting wheel assemblies having non-steel belted tires passing over the location;

applying an oscillating frequency to said wire loop to create flux fields across at least a portion the location;

said first, Eddy Current sensor sensing a change in the frequency when a wheel assembly passes through the flux field changing the resonant frequency of the first, Eddy Current sensor, said second, Ferromagnetic sensor comprising a sensor loop wire installed at the location for detecting steel belted tires passing over the location;

applying an oscillating frequency to said sensor loop wire to create magnetic fields across at least a portion the location;

providing a controller in c said second, Ferromagnetic sensor sensing a change in the frequency when a steel belted tire passes through the magnetic field changing the resonant frequency of the second, Ferromagnetic sensor;

said controller in communication receiving information from both the first and second sensors generated by the change in frequencies sensed by the first and second sensors;

said controller interpreting the information from the first and second sensors to detect the passage of steel belted tires and wheel assemblies having non-steel belted tires over the location.

12. The method of detecting objects passing over a location of claim 11, further comprising:

said controller determining from the information received from the first and second sensors a number of vehicles passing over the location.

13. The method of detecting objects passing over a location of claim 11, further comprising:

said controller determining from the information received from the first and second sensors a vehicle direction of travel and speed over the lane sensor for a vehicle associated with wheel assembly or with the steel belted tires, the number of axles on the vehicle, the presences of more than two tires per axel, the vehicle length, the spacing between sequentially detected axles, the vehicle travel position in the lane, and a vehicle classification for the vehicle associated with wheel assembly or with the steel belted tires.

14. The method of detecting objects passing over a location of claim 11, wherein said second, Ferromagnetic sensor and said first, Eddy Current sensor are installed in a single lane of travel of roadway, with said second Ferromagnetic sensor being installed 1-2 inches below a surface of the roadway; and said first, Eddy Current sensor being installed 3-6 inches below the surface of the roadway.

15. The method of detecting objects passing over a location of claim 11, wherein said second, Ferromagnetic sensor includes a series of three or more rectangular sensors connected in series.

16. The method of detecting objects passing over a location of claim 11, further including a lane position sensor, wherein said lane position sensor includes a left sensor loop and a right sensor loop installed in a lane of travel to determine the position of a vehicle within the lane of travel.

17. A lane sensor for detecting the passage of a vehicle over the lane sensor, the lane sensor comprising:

a first, Eddy Current sensor for detecting wheel assemblies having non-steel belted tires and wheel assemblies having steel belted;

a second, Ferromagnetic sensor for detecting steel belted tires;

a controller for receiving information from both the first and second sensors to detect the passage of a vehicle over the lane sensor whether the vehicle has steel belted tires or non-steel belted tires.

* * * * *